US009937430B2

(12) United States Patent
Kovach, II et al.

(10) Patent No.: US 9,937,430 B2
(45) Date of Patent: Apr. 10, 2018

(54) MODEL TRAIN CONTROL SYSTEM

(71) Applicant: Lionel LLC, Concord, NC (US)

(72) Inventors: Louis G Kovach, II, Belleville, MI (US); Neil Young, Woodside, CA (US); John T Ricks, Lincoln Park, MI (US); Mark E Ricks, Lincoln Park, MI (US)

(73) Assignee: Lionel LLC, New York, NY (US)

( * ) Notice: Subject to any disclaimer, the term of this patent is extended or adjusted under 35 U.S.C. 154(b) by 574 days.

(21) Appl. No.: 14/525,177

(22) Filed: Oct. 27, 2014

(65) Prior Publication Data

US 2015/0108285 A1 Apr. 23, 2015

Related U.S. Application Data

(63) Continuation of application No. 11/940,285, filed on Nov. 14, 2007, now Pat. No. 8,892,276, which is a continuation of application No. 11/187,709, filed on Jul. 22, 2005, now Pat. No. 8,154,227, which is a continuation-in-part of application No. 10/723,460, filed on Nov. 3, 2003, now Pat. No. 7,312,590.

(51) Int. Cl.

| | |
|---|---|
| ***A63H 19/24*** | (2006.01) |
| ***A63H 17/32*** | (2006.01) |
| ***A63H 19/16*** | (2006.01) |
| ***A63H 19/10*** | (2006.01) |
| ***B61L 15/00*** | (2006.01) |
| ***A63H 30/04*** | (2006.01) |
| *A63H 19/14* | (2006.01) |

(52) U.S. Cl.

CPC ..... *A63H 19/24* (2013.01); *A63H 17/32* (2013.01); *A63H 19/10* (2013.01); *A63H 19/16* (2013.01); *A63H 30/04* (2013.01); *B61L 15/009* (2013.01); *A63H 19/14* (2013.01); *A63H 2019/246* (2013.01)

(58) Field of Classification Search

CPC ..... A63H 19/24; A63H 19/16; A63H 19/10; A63H 19/14; A63H 30/04; A63H 17/32; A63H 2019/246

See application file for complete search history.

(56) References Cited

U.S. PATENT DOCUMENTS

| | | | | |
|---|---|---|---|---|
| 5,559,301 A * | 9/1996 | Bryan, Jr. | ..... | G10H 1/0008 345/173 |
| 6,220,552 B1 * | 4/2001 | Ireland | ..... | A63H 19/24 246/122 R |
| 6,530,329 B2 * | 3/2003 | Katzer | ..... | A63H 19/24 105/1.5 |

(Continued)

*Primary Examiner* — Thomas G Black
*Assistant Examiner* — Peter D Nolan
(74) *Attorney, Agent, or Firm* — Fitzsimmons IP Law

(57) ABSTRACT

A model train control system providing a more realistic modeling of the movement, sound, smoke, and lighting effects of a model train is disclosed. A number of dynamic inputs are used to control such effects. Novel features include providing a dynamic variable speed compensator, a dynamic engine load calculator, automatic dynamic momentum, an adjustable train brake, spectrum control, a velocity controller, pressure sensitive effects, a voice activated dispatcher system, a train location and information reporter network, two digit addressing, a traffic control system, accessory control, a model train Central Control Module, and removable memory modules.

23 Claims, 13 Drawing Sheets

(56) References Cited

U.S. PATENT DOCUMENTS

| | | | | |
|---|---|---|---|---|
| 6,536,716 | B1 * | 3/2003 | Ireland | A63H 19/24<br>246/167 R |
| 6,729,584 | B2 * | 5/2004 | Ireland | A63H 19/24<br>246/1 C |
| 7,164,368 | B1 * | 1/2007 | Ireland | G01D 7/12<br>246/167 R |
| 7,210,656 | B2 * | 5/2007 | Wolf | A63H 19/14<br>246/4 |
| 7,215,092 | B2 * | 5/2007 | Grubba | A63H 19/24<br>318/268 |
| 7,885,735 | B2 * | 2/2011 | Katzer | A63H 19/24<br>105/1.5 |
| 8,262,034 | B2 * | 9/2012 | Wolf | A63H 19/14<br>246/1 C |
| 2002/0046675 | A1 * | 4/2002 | Young | A63H 19/24<br>104/295 |
| 2002/0111723 | A1 * | 8/2002 | Katzer | A63H 19/24<br>701/19 |
| 2005/0022688 | A1 * | 2/2005 | Asada | A63H 19/16<br>105/26.05 |
| 2006/0100753 | A1 * | 5/2006 | Katzer | A63H 19/24<br>701/20 |
| 2007/0001058 | A1 * | 1/2007 | Severson | A63H 19/32<br>246/1 R |
| 2010/0145557 | A1 * | 6/2010 | Katzer | A63H 19/24<br>701/20 |

* cited by examiner

700

| | Inputs (702) | | | | Outputs (704) | | | | | | | |
|---|---|---|---|---|---|---|---|---|---|---|---|---|
| | 702a Current Speed (0-5) | 702b Direction of knob rotation (+ / -) | 702c Speed of Knob Rotation (1-4) | 702d Distance of knob rotation (1-10) | 704a Smoke (0-3) | 704b Voice Volume (0-3) | 704c Voice Duration (0-3) | 704d Chug Volume (0-3) | 704e Chug Frequency (0-3) | 704f Brake Volume (0-3) | 704g Brake Duration (0-3) | 704h Train Shuddering (0-1) |
| 700a | 4 | – | 3 | 7 | 0 | 3 | 3 | 0 | 0 | 3 | 3 | 1 |
| 700b | 4 | – | 1 | 7 | 0 | 2 | 2 | 0 | 0 | 1 | 1 | 0 |
| 700c | 4 | – | 1 | 3 | 0 | 0 | 0 | 0 | 0 | 0 | 0 | 0 |

Figure 7

*LAYER 1* MAIN MENU
ENGINE, TRAIN, ROUTE, SWITCH, ACCESSORY, LASHUP, ENGINE #, TRAIN #, ROUTE #, SWITCH #, ACCESSORY #

*LAYER 1A*...ADDRESS TYPES THAT HAVE A NAME
ENGINE TRAIN ROUTE SWITCH ACCESSORY LASHUP
*LAYER 1B*...ADDRESS TYPES THAT HAVE A NUMERIC DESCRIPTION ONLY
ENGINE # TRAIN # ROUTE # SWITCH # ACCESSORY #

*LAYER 2* DESCRIPTIVE MENU
*LAYER 2A*...DEFAULT NAMES FOR ENGINES
*LAYER 2B*...DEFAULT NAMES FOR TRAINS
*LAYER 2C*...DEFAULT NAMES FOR ACCESSORIES
*LAYER 2D*...DEFAULT NAMES FOR ROUTES
*LAYER 2E*...DEFAULT NAMES FOR SWITCHES
*LAYER 2F*...FACTORY COMMANDS FOR MAKING A LASHUP
*LAYER 2G*...FACTORY NUMBERS 1-0 FOR TRAIN NUMBERS
*LAYER 2G*...FACTORY NUMBERS 1-0 FOR ENGINE NUMBERS
*LAYER 2G*...FACTORY NUMBERS 1-0 FOR ACCESSORY NUMBERS
*LAYER 2G*...FACTORY NUMBERS 1-0 FOR ROUTE NUMBERS
*LAYER 2G*...FACTORY NUMBERS 1-0 FOR SWITCH NUMBERS
*LAYER 2G*...FACTORY NUMBERS 1-0 FOR TRAINLINK ROLLING STOCK ID#

NOTE: DEFAULT DESCRIPTIONS ARE REPLACEABLE WITH CUSTOM ONES

*LAYER 3* COMMAND MENU
*LAYER 3A AND 3B*...COMMANDS FOR ENGINE AND TRAIN, ENGINE # AND TRAIN # ARE SIMILAR
THESE ARE FACTORY COMMANDS THAT CAN'T BE CHANGED

| | |
|---|---|
| 1. CONTROL PANEL | Goes to parameter softkeys and graphs |
| 2. UNCOUPLE FRONT | Fires front coupler |
| 3. UNCOUPLE REAR | Fires rear coupler |
| 4. SHUT-DOWN | Shuts down railsounds |
| 5. START-UP | Starts up railsounds |
| 6. CREWTALK | Goes to +/- buttons |
| 7. TOWERCOMM | Goes to +/- buttons |
| 8. RESET | Resets to forward |
| 9. DIRECTION | Changes direction |
| 10. STALL | Goes to stall speed |
| 11. CAUTION SPEED | Goes to caution speed |
| 12. HIGH SPEED | Goes to high speed |
| 13. RED FLAG | Emergency stop sequence |
| 14. RAMP-UP | Diesel RPMs up |
| 14A. RAMP-DOWN | Diesel RPMs down |
| 15. TRAINLINK | Enter Trainlink # to command cars |

Figure 9

MODEL TRAIN CONTROL SYSTEM

CROSS-REFERENCE TO RELATED APPLICATION

This patent application is a continuation of U.S. patent application Ser. No. 11/940,285, filed Nov. 14, 2007, which issued as U.S. Pat. No. 8,892,276 on Nov. 18, 2014, which is a continuation of U.S. patent application Ser. No. 11/187,709, filed Jul. 22, 2005, which issued as U.S. Pat. No. 8,154,227 on Apr. 10, 2012, which is a continuation-in-part of U.S. application Ser. No. 10/723,460, filed Nov. 26, 2003, which issued as U.S. Pat. No. 7,312,590 on Dec. 25, 2007.

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

The present invention relates to a model train control system. Conventional model train command control systems comprise a simple direction control and a throttle, along with a brake or boost feature. Command systems that send commands to specific engines or other accessories, tracks, trains, etc. are commonly known in the art. In addition, microprocessor based digital sound systems that play back records of real train sounds assembled by algorithms based on state and user input are commonly known in the art, as are smoke and lighting systems that attempt to model a train in motion. The present invention provides advantages in the area of model trains to achieve the goal of realism during operation.

A control and motor arrangement for a model train that simulates the effects of inertia is disclosed in U.S. Pat. No. 6,765,356 issued to Denen et al. The control arrangement is coupled to receive speed information from the motor and is configured and arranged to provide a control signal to the motor for controlling the speed of the motor. A command control interface receives commands from a command control unit. A process control arrangement is configured and arranged to control a rotational speed of the motor in response to rotational speed information received from the motor.

Slow speed operation without stalling the drive motor of a model train system is disclosed in U.S. Pat. No. 6,190,279 issued to Squires. A power transmission system enables a motor to start and continue to run while the locomotive is not moving. The power transmission system is located between the existing motor and the worm gearset of a standard model railroad locomotive eliminating the long standing problems of start-up motor stall and lunging movement during a slow, variable speed operation under load. Furthermore, Ames U.S. Pat. No. 6,539,292 discloses a model train where the back emf energy of the engine motor is monitored to give an indication of the load. Knowing the load, it responds quickly to a minor variation of power or braking applied if there is a light load. A fully loaded train has more momentum and responds much slower. Adjustments can be made as a result of changes of load received due to the train climbing a grade.

In real trains, as opposed to model trains, adaptive brake control is used to vary the air pressure for the brakes for different cars in a train to control the braking. See, e.g., U.S. Pat. No. 4,859,000 and U.S. Pat. No. 5,405,182. A system for braking an engine in a model train is shown in U.S. Pat. No. 4,085,356.

U.S. Pat. No. 5,480,333 issued to Larson discloses a locomotive control simulator assembly for a model train controller where train speed is controlled by rotation of a protruding shaft. A realistic throttle or speed control for a model train is used by a model train user to regulate the starting, acceleration, running speed and deceleration of a model train. The model train controller has sliding actuators for switches regulating conditions of operation, such as direction, braking, and/or momentum. U.S. Pat. No. 4,085,356 shows a capacitor connected to the motor control circuit of a model train locomotive for controlling the rate of deceleration.

U.S. Pat. Nos. 5,441,223 and 5,749,547 issued to Neil Young et al. show a variety of mechanisms used to control the velocity of model trains and are incorporated by reference herein for all purposes. Conventionally, power may be applied by a transformer to a track, where the power is increased as a knob is turned in the clockwise direction, and decreased as a knob is turned in the counter-clockwise direction. In another type of control system, a coded signal is sent along the track, and addressed to the desired train, conveying a speed and direction. The train itself controls its speed, by converting the AC voltage on the track into the desired DC motor voltage for the train according to the received instructions. Furthermore, commands such as signals instructing the train to activate or deactivate its lights, or to sound its horn, can be controlled. Due to this increase in complexity of model railroading layouts and equipment, it is desired to exercise more precise control over the velocity of locomotives. NCE Corporation of Webster, N.Y., has introduced into its model railroad controllers, the velocity control mechanism known as "ballistic tracking". According to this ballistic tracking scheme, the faster a control knob is turned, the faster the velocity of the train will be increased or decreased.

A model train horn simulating the realism of a moving train is disclosed in U.S. Pat. No. 4,293,851 issued to Beyl, Jr. The horn may be activated at specific selected locations on a track as a model train travels along the layout. A model train whistle is also disclosed which is activated by a ramp voltage to provide the intensity and frequency variation normally associated with a steam whistle. Conventional model train locomotives also include "chuff" sounds of a steam locomotive and other train sounds, such as bells, whistles, announcements, brake squeals, etc. These sounds strive to simulate real train sounds and to provide realism in the use of the model train. The "chuff" sound of a steam locomotive has been generated for a model train by use of digitized locomotive sounds that are stored in a memory. As a magnet mounted on a train wheel passes a reed switch during each revolution of the wheel, a pulse is generated by the switch causing a "chuff" sound to be output from the memory and converted to an audible sound. While changes in the train speed cause the "chuff" sound to be generated at a faster or slower rate, the resulting sound still has a staccato sound which does not vary in pitch or volume.

Train sounds have also been synthesized from electronic white noise generators which produce a deeper, more throaty sound which better reflects real train sounds than stored sounds since the stored sounds give a monotonous, staccato noise that is typically non-realistic. Sounds synthesized from white noise are richer in tone and not as repetitive due to the chaotic output characteristic of the white noise system. Other sounds effects use separate trigger mechanisms to generate the sound of a whistle or the sound of a bell. In some conventional model train systems, the bell and whistle sounds are not tied directly to the speed of the train and are usually produced whenever the train passes by a magnetic field located in close proximity to and at a particular location on the track. The magnetic field, typically generated by a device activated by a pushbutton controlled by the user and located near the speed controller of the model train, closes a reed switch on the train to activate the bell or whistle.

With regard to using voice activated commands in a model train system, U.S. Pat. No. 6,466,847 discloses a remote control system for a locomotive using voice commands. An input is designed for receiving a voice signal. The voice signal is processed by a processing unit that generates data corresponding to a command to be executed by the locomotive. A communication link interface transmits the command from the remote control to the locomotive. The processing unit includes a speech recognition engine that attempts to match spoken words to a list of pertinent vocabulary words in a speech recognition dictionary.

Furthermore, sound generating components have been employed with model train systems, to generate sounds simulating the realistic sounds produced by an actual train, train station, etc. An example of a known sound effect producing model railroad car is described in U.S. Pat. No. 5,267,318 to Severson et al. A speech synthesis circuit for playing selected cow voices stored as digital data in an EPROM is disclosed. In a random mode of operation, a state generator provides a pseudo-random count that is used to select among four different cow voices, one of which is silence. The resulting audio output is perceived as random contented cow sounds. A pendulum motion detector provides an indication of lateral motion of the system. An up/down motion counter maintains a motion count reflecting the level of excitation of the system and the cows. The motion counter increments responsive to motion and decrements gradually in the absence of detected motion. A motion count of at least four invokes a triggered mode of operation in which the counter output is used to select among four different excited cow voices.

Model train engines having smoke generating devices are well known. It is desirable to have current smoke generating devices for model trains mimic the generation of smoke of a real train. Real trains generate smoke at a rate proportional to the loading of the engine of the train notwithstanding the speed at which the train is moving. Many prior art smoke generating devices create a puffing smoke pattern through the use of a piston. The piston forces smoke out of a smoke unit and creates the puffing action.

Conventional motor speed control systems change the smoke and sound effects with intensity triggered from the amount of work done by the servo motor. If the servo motor is adding power, the smoke and sound effects are more intense, whereas if the servo is decreasing power, the smoke and sound effects become less intense. A conventional servo motor quickly overcomes a force acting against it, making the duration of the laboring/drifting effect much smaller than that of a real engine fighting full-scale forces. If the servo motor of the conventional model train system is not working to maintain a speed, the smoke and sound effects are at the default or normal level. Thus, in conventional systems, there are three levels of sound effect intensities which may be triggered. The three levels are called laboring, normal, and drifting.

U.S. Pat. No. 6,485,347 discloses a puffing fan smoke unit for a model train. The smoke unit described produces smoke in a puffing pattern that is characteristic of actual trains. The unit includes a smoke generator including an exhaust hole and a fan operative to create a flow of smoke form the smoke generator out the exhaust hole. A blocker intermittently restricts the flow of smoke through the exhaust hole to create a puffing action. U.S. Pat. No. 6,676,473 discloses a smoke generating unit for a model train comprising a fan. Puffs of smoke can be generated by engaging a fan at a certain velocity for a short period of time, and then reversing the current to a motor controlling the fan to stop the fan.

The switching of model train tracks is disclosed in U.S. Pat. No. 4,223,857. The tracks of the model train layout are arranged in multiple closed paths which are connected together so that they have at least one section of track in common. Located in the common track section is a signaling device that is actuated by the passage of the model train and produces an output signal proportional to the time it takes the train to pass. The paths of the model trains may be automatically and randomly switched.

Accessories for model train sets have been manufactured to give realism to a model train layout Such accessories have included train stations, crossing gates, signal lights, and other items to simulate real life situations. Many of the items are actuated by sensors, such as an electric eye. Another example of a model train accessory includes crossing gates which are lowered when a train approaches a crossing and raised after the train has completely passed the crossing. Other types have been provided which require the hobbyist who is using the train to participate in some manner, such as operating a loader. U.S. Pat. Nos. 4,020,588 and 4,004,765 disclose accessories for use with model trains.

BRIEF SUMMARY OF THE INVENTION

The present invention provides effects which more realistically model those of a real train. For example, the motor in a model train is proportionally much more powerful compared to its scaled load than the engine of a real train, and thus does not labor noticeably as a real train would. A model train engine quickly accelerates to a new speed even when going uphill with a long train attached. Embodiments of the present invention control the speed, braking, and related effects of engine and brake noise and smoke to more realistically mimic a real train. A remote control unit is adapted to integrate with this system, including user controls and feedback that add to the realism, such as a unique combination of voice and keypad commands, force feedback and force dependent controls.

In one embodiment of the present invention, the user moves a throttle to a "target speed" on a remote control unit. The system, knowing that the motor can almost instantly reach that speed because of the strength of the motor, instead sends a series of "command speeds" that gradually accelerate the engine to the target speed. The rate of acceleration is determined based on factors such as the load on the engine, whether the engine is going level, uphill, downhill, around a corner, at a particular angle of travel, etc. This information can be obtained, for example, from a force sensor in a coupler, which may also be referred to as a force sensing module. The amount of the force can indicate the load, such as the number of cars, and if the force is toward the engine, to indicate that the engine is going downhill. Alternately, an inclinometer could detect hills in real time, information on the location of hills could be loaded into the system memory, or variations in force as the train goes around the layout could be used to teach the system where the hills and level spots are. Such information could be used to create a 3D map of the model train layout and/or relayed to the user.

Furthermore, an automatic dynamic momentum effect is provided. When a real train with a large load is going downhill, it cannot slow down quickly because of the momentum of the load. This is mimicked by adjusting the command speed in such a situation to adjust the target/command speed relationship. Additionally, the momentum effect is used to drive the train at a at slow speed, as a real train would, and not have it stopped by friction, breaks in the tracks, or other aspects in a model train layout that aren't realistically scaled.

In addition, the acceleration and momentum, as reflected in the target/command speed relationship, are used to provide different intensities to sound, smoke and light effects. For example, a slow acceleration indicating a laboring engine can have intensified chuffs of smoke and laboring sounds.

An adjustable train brake is also provided in one embodiment, responsive to the measured load and momentum to provide a realistic braking deceleration with accompanying realistic sound effects. Optionally, instead of simply slowing the train motor, an actual brake may be provided in a braking car (the engine or another car) to provide a more realistic dragging effect. In a real train, brakes are provided on each or at least multiple cars, with the braking force spread over the train. One effect of this is that the train stretches out, since each independent braking car elongates its coupling with the next car. This can be duplicated on a model train with one or more strategically placed braking cars. For example, brake commands could be sent over a communication link to braking cars; causing the braking cars to apply the brakes.

Another embodiment of the present invention provides a remote control unit which takes advantage of and complements the realistic features. The brake lever, or other brake control input mechanism, acts as a trim on the throttle, and the sensitivity of the throttle is adjusted. If the brake limits the maximum speed, the throttle is adjusted so the full range of throttle rotation or movement goes to the limited speed, giving more sensitivity to the rotation by the user. A display on the remote control unit may receive feedback regarding the simulated strain of the train, showing the difference between the target speed input by the user, and the actual or command speed sent to the train engine. This may be done, for example, with a gray bar (representing the command/actual speed) shown approaching a black bar (representing the target speed). Feedback to the remote control unit could reflect the forces being felt by the model train. For example, some examples of force feedback are, but not limited to, vibration of the remote control unit body, applying a force through a lever by a servo motor that can be felt by a user, vibrations created when a locomotive accelerates to simulate the realistic weight of the locomotive, increasing/decreasing vibration levels based on the weight of the cars the locomotive is pulling determined by force sensing modules, and increasing/decreasing vibrations levels based on whether a locomotive is traveling uphill/downhill determined by an inclinometer or a like device measuring an incline. It should be appreciated that force feedback could also be used on stationary controls within the model train system.

The remote control unit allows the model train user to use voice commands in combination with buttons to control model train system components. Rather than using just buttons, or just voice, an unique combination is provided that allows a user to activate realistic actions within the model train system. In one embodiment, a hierarchy of commands/addressing is used. A first layer in the hierarchy is accessed with a button, which may be discrete or on a touch-screen. For example, different buttons can select either an engine, train, switch, accessory or route. The second layer or level is the address information for the button selected, such as a train number or route number. The address information can be accessed via a voice command. The number "five," for example, can mean train 5 or switch 5, depending on which physical button was pressed. A third layer or level, which may also be accessed via a voice command, is the command for the addressed device. The command could either be specific to a single function, or could access a macro configured to activate a series of commands for an addressed device.

In another embodiment of the present invention, a variety of other features are included, as described in the following detailed description. Such features include modular memory cards for providing new announcements for a train station, updated effects for an engine, software updates, etc. The information for the memory cards can be downloaded from a website through the Internet. A two digit addressing system for train engines is described, as well as a datarail reporter (a network for sharing information about a train) and a novel traffic control system. Pressure sensitive controls are also described, along with other features.

BRIEF DESCRIPTION OF THE DRAWINGS

FIG. 7 shows a simplified schematic view of a look up table utilized by an embodiment of a model vehicle control system in accordance with the present invention.

FIG. 9 illustrates a simplified command tree of a model train voice activated system in accordance with the present invention.

DETAILED DESCRIPTION OF THE INVENTION

System

Figure 1:
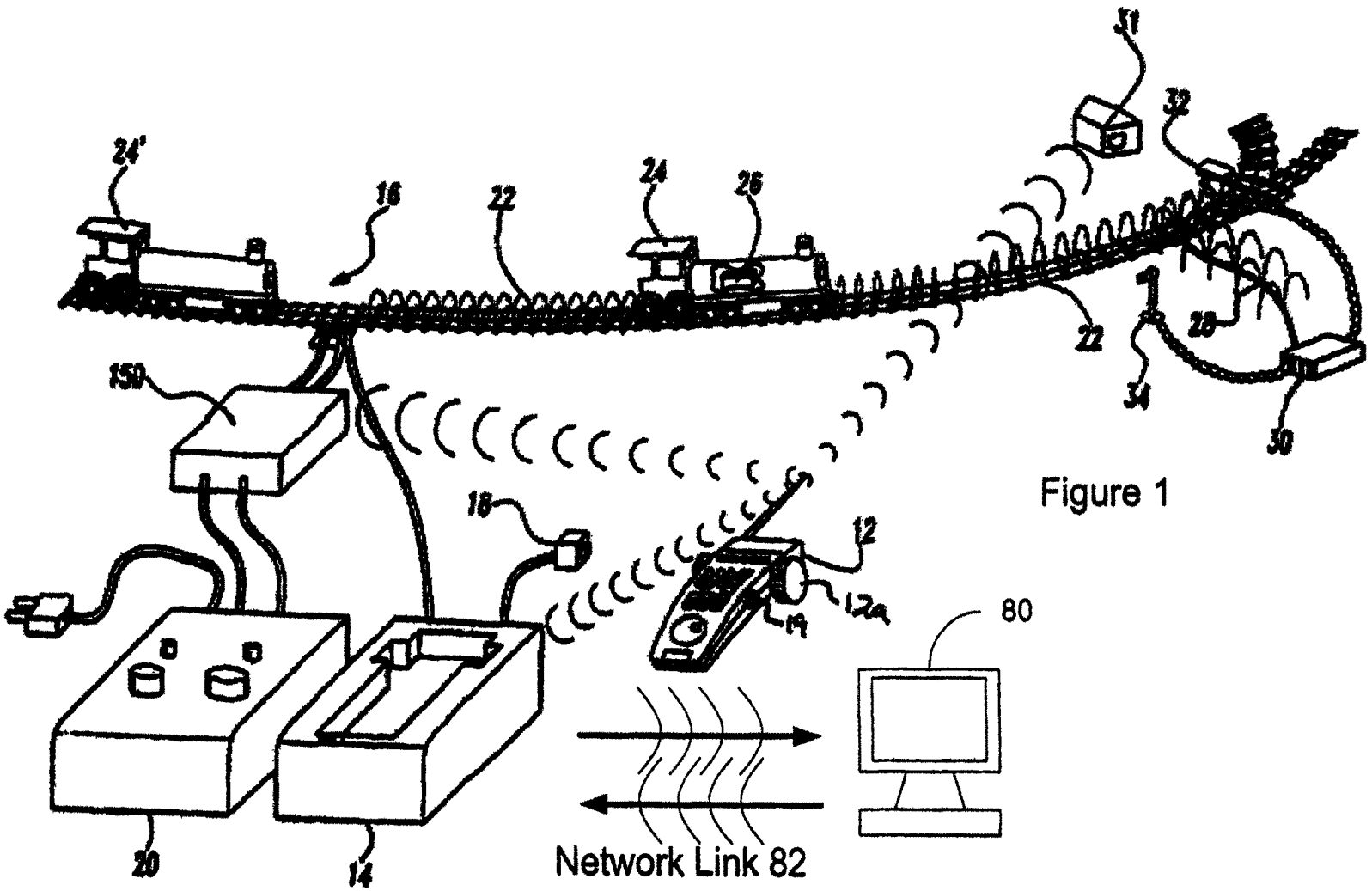
FIG. 1 is a perspective drawing of an exemplary embodiment of a sample model train layout of a model train track system in accordance with the present invention.

FIG. 1 is a perspective drawing of an exemplary embodiment of a sample model train layout of a model train track system in accordance with the present invention. A hand-held remote control unit 12 including control input apparatus 12*a* is used to transmit and receive signals to and from a Central Control Module 14, model locomotive 24, and trackside accessory 31. A power signal is created between the rails of the track by power supply 20 or by Central Control Module 14. Central Control Module 14 can superimpose control signals on the track power signal. Locomotive 24 is configured to receive, decode, and respond to superimposed signals over train track 16.

Central Control Module 14 is equipped to receive and transmit RF signals, also known as RF control commands. RF control commands can originate from Central Control Module 14, remote control unit 12, trackside accessory 31, or locomotive 24'. RF control commands received by Central Control Module 14 may then be processed within. According to one embodiment of the present invention, Central Control Module 14 may superimpose commands along track 16. Locomotive 24 or trackside accessory 31 may receive superimposed signals and react accordingly. Locomotive 24 can also be equipped to transmit and receive RF signals directly to/from remote control unit 12, Central Control Module 14, trackside accessory 31, other locomotives, switch controller 30, and other layout objects. In accordance with another embodiment of the present invention, remote control unit 12 may communicate with locomotive 24 through a direct wireless communication link. In an alternative embodiment of the present invention, remote control unit 12 may communicate with bi-directional command control cars via a direct wireless communication link, such as an RF wireless communication link. For example, the 900 Mhz band could be used, or 2.4 Ghz.

The superimposed signal generated by Central Control Module 14 can propagate along track 16. Switch controller 30 and trackside accessory 31 can receive superimposed commands and perform actions accordingly. Switch controller 30 and trackside accessory 31 may be equipped to receive and transmit RF signals in addition to communicating with superimposed signals found on and/or around track 16.

Central Control Module 14 may also transmit and receive data directly to/from a computer 80 and/or over a network link 82. In one embodiment of the present invention, network link 83 comprises the Internet. Central Control Modules may connect to each other over network link 82 and share control and feedback between two remote model train layouts. Streaming video and sound may be shared between Central Control Modules allowing for shared remote interaction and control. A website may be internally hosted by Central Control Module 14 allowing users to "visit" a specific model train layout. According to one embodiment of the present invention, on the website, information about the model train layout objects can be viewed. Streaming video, audio, and layout control could be accessed through the website. In addition, the website could be indexed at a central website accessible through network link 82, allowing users to find many different layouts from one central website/location.

Many communication links could be located on the model train layout. The various communication mediums available may be used to create a network, wherein any device can communicate with any other device that is connected to the network, regardless of the medium or mediums it must travel through. This includes information channeled through the network link (i.e., Internet) to another Central Control Module. Commands may be sent by broadcast, by location, by medium type, etc. to specific groups of devices, to an individual networked device, or any other combination of devices.

Train Description

Figure 2:
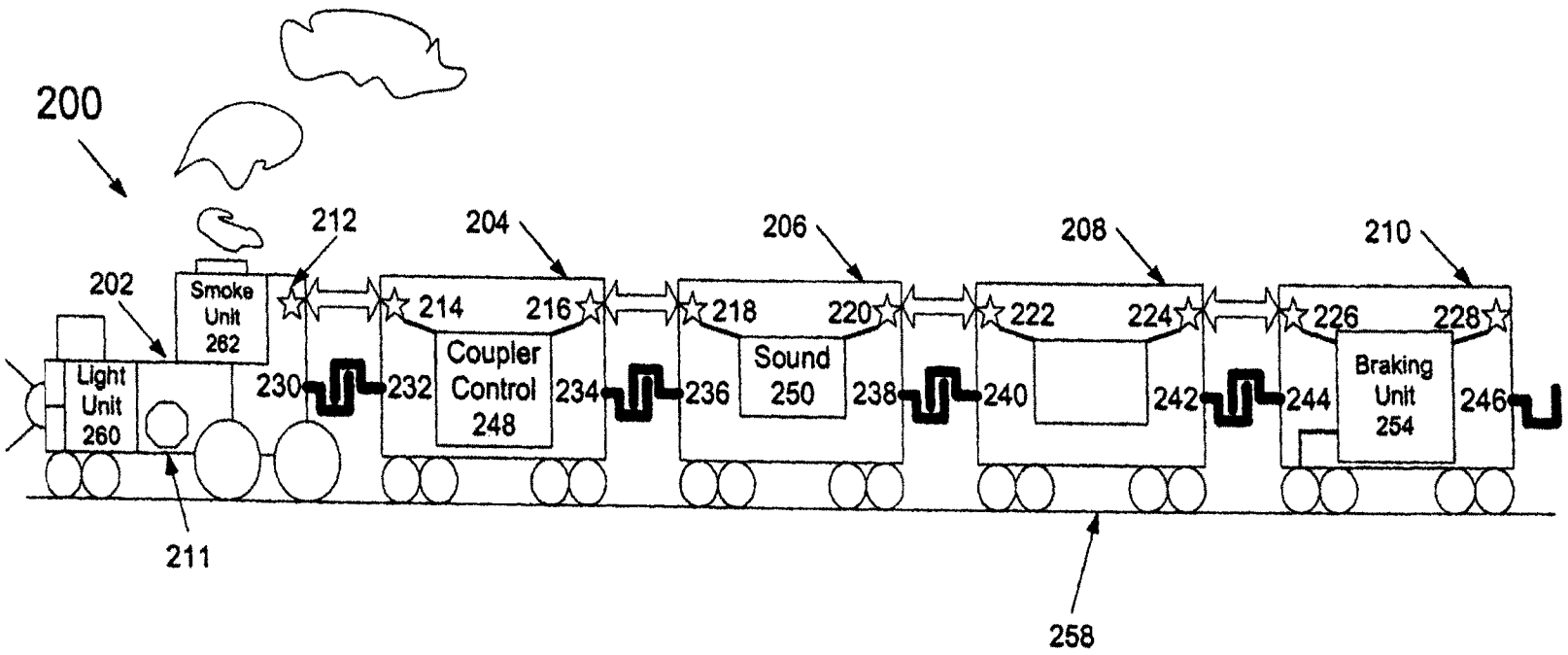
FIG. 2 illustrates an exemplary embodiment of a model train in accordance with the present invention.

FIG. 2 illustrates an exemplary embodiment of a model train in accordance with the present invention. Locomotive 202 contains a motor to pull locomotive cars 204-210. Located within locomotive 202 is transceiver 211, which has the ability to transmit/receive signals to a Central Control Module, where a user can use a remote control unit and send commands to the train (i.e., locomotive 202 and the locomotive cars 204-210). It should be appreciated that the train may comprise only a locomotive or a locomotive (also referred to as engine) along with any number of locomotive cars (also referred to as train cars, rail cars, cars, etc). Examples of commands sent to the train are, but not limited to, opening couplers automatically when cars get close enough to one another, sending commands using an encrypted error byte front/back protocol, etc. A hand-held remote control unit 12 (FIG. 1) may be used to transmit signals to a Central Control Module 14 (FIG. 1) which is connected to train track 258. Superimposed signal originating from Central Control Module 14 travel along train track 258. Locomotive 202 is equipped with transceiver 211 configured to receive superimposed commands traveling along track 258. In some embodiments of the present invention, transceiver 211 could replaced with a receiver. Locomotive 202 may generate a superimposed response to Central Control Module 14 verifying that each superimposed command has been processed. Locomotives may be equipped with a wireless transceiver identical to that found in remote control unit 12. Locomotive 202 may "listen" and "talk" using both superimposed signals and wireless communication to help improve the communication and eliminate "dead spots" commonly found in some model train layouts. In alternative embodiments of the present invention, any other communication method to the model train may be used. A microcontroller and memory located in the engine receive commands from receiver 211 and do the processing described herein. A communication link may also be established in the model train. The model train in FIG. 2 contains a series of wireless transceivers 212-228 which transfer data from car to car (alternately, wired transceivers or one-way transmitters and receivers or just connectors could be used). These wireless transceivers may communicate with "datarail reporters." More description regarding datarail reporters are provided in subsequent sections of the detailed description of the present invention. Microcontrollers or other circuitry may be located on each train car with the ability to process such data and forward this information through the communication link. The result may be thought of as a dynamic networking scheme. One feature of the communication link occurs upon detection of a link from two approaching rail cars, wherein onboard couplers may automatically open to accept an incoming rail car, creating the illusion that a brakeman has opened the coupler for the train operator. As new communication methods may be developed, new cars may be equipped to communicate over new mediums. These cars would have the ability to interject commands into the locomotive via a communication link or network. Various bi-directional communication mediums may be used to create a network, wherein any device can communicate with any other device that is connected to the network, regardless of the medium or mediums it must travel through. An example of one of these devices is a stationary control unit that allows the user to either control the whole model train layout or specific model train components (such as switches for a dispatcher station). Examples of commands to be sent to locomotive 202 are opening/closing couplers (such as couplers 230 and 232, or couplers 238 and 240) that connect cars together using a coupler control circuit 248, producing a bell or whistle sound (sound unit 250), activating a smoke unit 262, turning on/off lights (light unit 260), applying a brake to the wheels of a braking unit 254, sending out information about a particular rail car, etc. The braking unit could be located in a special braking car that has a rubber wheel for braking (i.e., braking unit 254). Each car on the train may have the capability of executing such commands. Locomotives may store commands in memory for later processing. For example, locomotive 202 could store a series of commands and delays that cause the locomotive to travel around the layout once, and then have the locomotive blow its horn. Locomotive 202 may be programmed to process the stored commands at intervals, by triggers such as passing a specific datarail reporter, the time of day, or on request. An illusion may be created that the locomotive is running itself.

These series of commands may also be stored and triggered to play back based on an input. For example, a library of different warning signal codes could be stored in memory. A command such as "Play warning signal #4" could be issued. Upon reception, locomotive 202 would play a series of commands associated with warning signal #4. Locomotive 202 may play various long and short warning signals with various delays in between. The end result may be thought of as a series of commands and timing that associate with a single command.

In accordance with an embodiment of the present invention, locomotive 202 contains a battery (not shown) or other device for maintaining voltage during a gap (for example, using a capacitor) in power while the model train is operating. The battery maintains the sound, communication, lights, and other functions of the train. This is especially useful if a command train is running in conjunction with a standard conventional train. In conventional train operation, the voltage applied to the track is proportional to the power applied to the train motors. In order for the user to change direction, the voltage is taken to zero, and then raised again. The train interprets this action as a voltage change. The command train may lose power shortly while the conventional train changes direction. Due to the battery, the model train will not appear to have any gaps in operation although there is not power available to the model train. In an alternative embodiment of the present invention, the battery may or may not provide power to a motor of a model train, wherein the battery is used mainly to power a sound and lighting unit of the model train. The battery could also be used to power sensor(s) used to drive model train effects. It should be appreciated that a mechanical flywheel could be used to provide energy to the model train, replacing the need for the battery.

In one embodiment of the present invention, a model train Central Control Module may transmit a 455 kHz and/or a 2.4 GHz expanded direct communication signal for backwards compatibility with older components and trains and new components. The benefit of the direct communication signal (such as a 455 kHz and 2.4 GHz wireless signal) is the ability to gather information at the location in which it occurs, as well as having a two-way communication ability that keeps track of the state of switch turnouts, operating cars, and accessories. In addition, the same direct communication is part of the traffic control system, most notably the datarail reporter section. All direct signals may go to traffic control base 1105. In an alternative embodiment of the present invention, two receivers or transceivers may be located in a locomotive or accessory, wherein the two receivers or transceivers are used to receive commands from a remote control unit or the Central Control Module through two different mediums. One medium may comprise, for example, an "original medium" of 455 kHz used to maintain backwards compatibility with older model train systems. The second medium may comprise, for example, a "newer medium" of 2.4 GHz and/or 900 MHz used to expand features of the model train system. Thus, two receivers or transceivers can expand and maintain backwards compatibility with older model train systems.

Train Electronics

Figure 3:
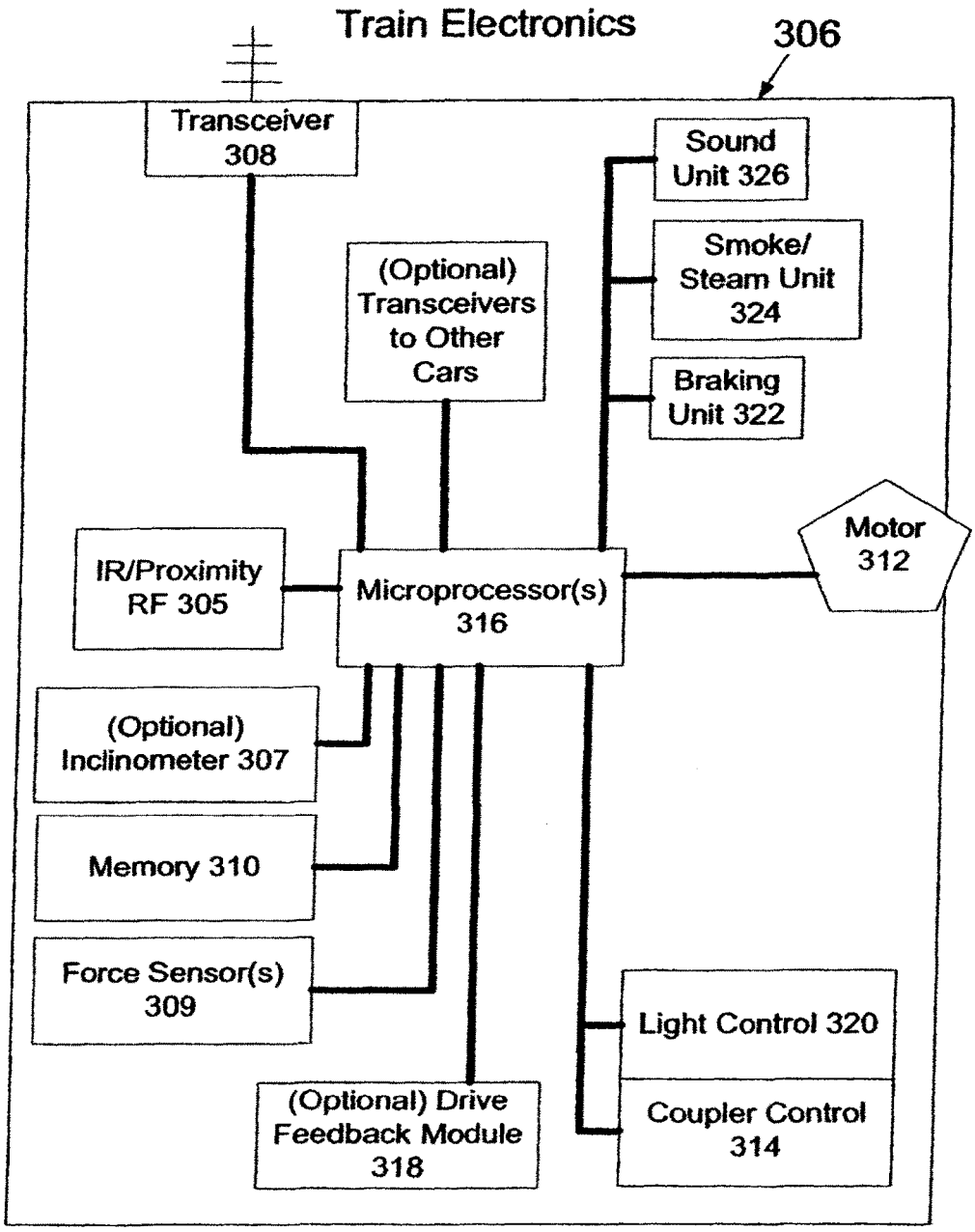
FIG. 3 illustrates an exemplary embodiment of a model train electronics system in accordance with the present invention.

FIG. 3 illustrates an exemplary embodiment of a model train electronics system in accordance with the present invention. System 306 is used to create a lifelike train operation experience incorporating the physics involved in model train operation, using force sensitive inputs/sensors, location sensors, angle detection mechanisms, etc. in conjunction with realistic effect generators such as sound units, steam units, microprocessor controlled lighting units, etc. System 306 may be located within a model train locomotive. Transceiver 308 receives commands sent from a model train controller (also known as a remote, remote control, remote control unit, etc.). In one embodiment of the present invention, system 306 uses a receiver in place of transceiver 308. IR/proximity RF transceiver 305 is configured to receive commands when a user directly points and sends commands to system 306. In alternative embodiments of the present invention, IR/proximity RF transceiver 305 could simply be a transmitter broadcasting a model train's identification number to a receiver in a remote control unit. Commands are sent to microprocessor(s) 316 for processing. It should be appreciated that microprocessor 316 may comprise a plurality of microprocessors. Optional inclinometer 307 may be used to input data providing elevation information (i.e., the train is moving downhill, uphill, etc.). In an alternative embodiment of the present invention, a special car equipped with an inclinometer or other elevation detection device could be sent around a track layout, wherein the special car could report locations of hills to a model train controller. This information could then be transmitted to another model train or datarail reporter. An angle detecting mechanism/circuit could be used to determine the angle of certain horizontal planes within the model train layout. Examples of using the angle detecting mechanism/circuit may involve determining where track curves are located in order to map a complete model train layout, providing appropriate model train sound/light effects, or other purposes. Force sensor(s) 309 is configured to provide data input indicating the load (i.e., number of cars) the locomotive is pulling. Force sensor 309 could be located in the couplers of a rail car. It should be appreciated that these data inputs/commands may be stored in memory 310.

Microprocessor(s) 316 has the ability to take in commands and other data inputs and perform desired model train commands. For example, a light command turning on the lights on a locomotive involves microprocessor 316 activating light control unit 320. In one embodiment of the present invention, light control unit 320 may use low voltage threshold LED's to keep the lights on under low track voltage conditions. Light control unit 320 could also be adjusted by microprocessor 316 to compensate for a voltage change. A coupler command opening the coupler on a locomotive involves microprocessor 316 activating coupler control unit 314. When motor commands are sent, microprocessor 316 controls motor 312. In addition, microprocessor 316 is configured to control braking unit 322, smoke/steam unit 324, and sound unit 326. In one embodiment of the present invention, smoke/steam unit 324 comprises a non-squirrel cage propeller fan. In another embodiment of the present invention, smoke/steam unit 324 uses an atomizer to generate smoke/steam effects. Commands may also be sent through a communication link (i.e., to transceivers of other cars), where a command is to be implemented on another car. Examples of other devices that could be used in the model train system are, but not limited to, an optional drive that could be used to generate a moving bell, and an optional IR transceiver/ultrasonic detector acting as a collision avoidance system that could be used to detect if objects are in front/behind the train by reflection of IRJultrasound, thereby automatically slowing a train to a "coupling speed" (i.e., a speed wherein neighboring cars can couple to each other). In addition, an optional video module may wirelessly broadcast video from inside the train containing adjustable stereo sound, camera pitch, angle, and direction by a remote control unit, wherein the camera may automatically look around track corners. The video could appear on a display on the remote control, as a separate display, be transmitted to a computer, or be transmitted over the Internet. In other embodiments of the present invention, other devices that could be used in the model train system include a drive feedback module 318, an optional driver for moving rain wipers, doors, windows, etc., an optional audio/FM transmitter in the train that broadcasts engine sounds which could be tuned into by a stereo to create louder train sounds, an optional ultrasonic steam generator/other steam unit, and an optional high pressure gas system for generating a steam blow-off effect. Still in other embodiments of the present invention, other devices that could be used in the model train system include an optional voltage coupler doubler circuit that allows couplers to fire under low track voltage conditions.

In one embodiment of the present invention, a compass or other type of directional sensing mechanism (directional radio transmitter, potentiometer, encoder, capacitive encoder, or other type of rotational sensor) may be mounted in a model locomotive/car so that the directional sensing mechanism can detect turns, thereby allowing the model locomotive to detect changes in direction. This information may be combined with the known rate of travel of the model locomotive to map out the locational movement of the model locomotive around the model train layout. In another embodiment of the present invention, it is possible to use the locational information to create an image of the model train layout on a remote control unit, computer, website, etc. A datarail reporter may be used to "zero" out the location of the model locomotive, or the model locomotive could electrically detect a special piece of track that will "zero" its location. The purpose of zeroing the location is to correct any miscalculation that may take place over time as the locomotive travels around the model train layout. It should be appreciated that the directional sensing mechanism may be mounted in the train as well as in the trucks of a model train system.

In one embodiment, a train can have two controllers or processors to divide up the work. A first processor can be configured to perform a first function, with a second processor configured to perform a second function related to the first function. For example, on processor may monitor sensors, such as the current applied to the motor, and the other processor may control effects, such as generating smoke, whistle sounds, lights, etc. The first processor can pass status information regarding the sensors to the second processor, which then acts on the information. A bidirectional communication link can be used between said first and second processors, allowing synchronization. Alternately, the processors could share tasks, or have any other division of labor, such as dividing up monitoring, controlling, communicating with a base unit or remote control, etc.

Smoke Unit with Propeller Fan

Figure 13A:
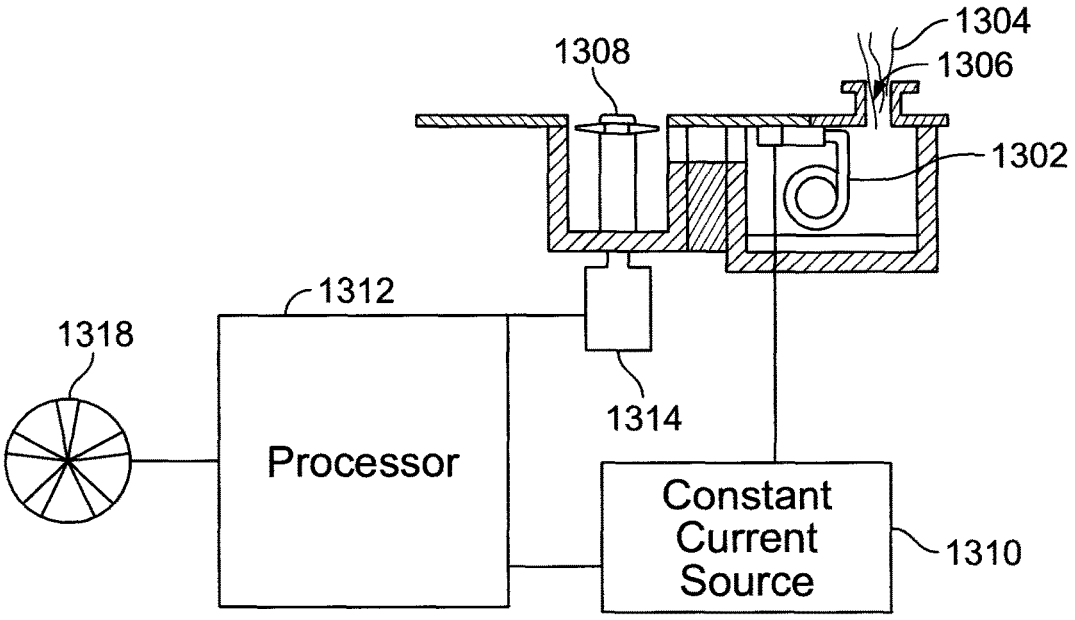
FIGS. 13A and 13B illustrate an embodiment of a smoke unit with a propeller fan according to the invention.
Figure 13B:
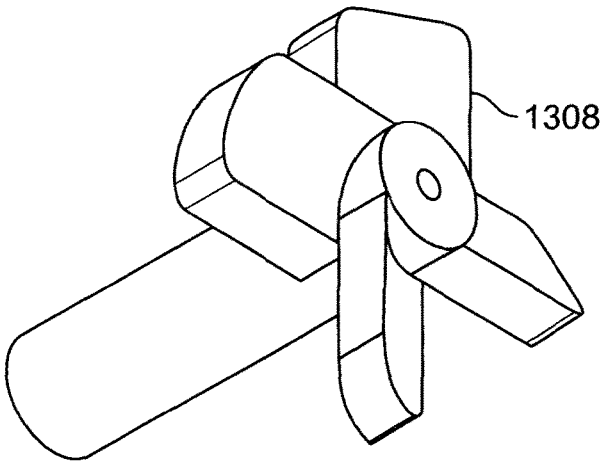

In one embodiment, illustrated in FIGS. 13A and 13B, a smoke unit has the ability to forward/brake/reverse a fan to generate diesel engine pulses or smoke puffs on locomotives, where it is also possible to channel smoke from the smoke/steam unit to cylinders to create the illusion of steam from pistons. It should be appreciated that smoke/steam unit 324 of FIG. 3 could comprise a propeller fan configured to control air flow and/or obstruct an air path in order to create chuffs. FIG. 13A illustrates a smoke unit with a smoke generating element 1302 for creating smoke 1304 which is emitted through opening 1306. A propeller fan 1308 draws air in, and forces air through the inside of the housing, across smoke generating element 1302, and out opening 1306. It has been discovered that a propeller-type fan is more efficient than the squirrel cage fan of the prior art. Smoke generating element 1302 is heated by a current from a constant current source 1310. By using a constant current source, rather than a voltage source as in the prior art, the temperature of the smoke generating unit can be precisely controlled, giving consistency in the amount of smoke provided. The current source is activated by a controller or processor 1312, which also controls a motor 1314 which drives propeller fan 1308. The controller 1312 receives a signal from a sensor 1318 which is coupled to a wheel of the train. This can be a cam switch, a proximity switch, a microswitch over a cam, a photo interrupter encoder, or any type of encoder. Alternately, instead of providing a signal to the controller, the sensor could directly control the fan motor, with the on and off of the smoke generating element being used to control when there is and is not smoke. Thus, the fan could run even when there is no smoke generated. In either way, the smoke is synchronized to the wheel rotation speed. The microprocessor can alter this synchronization. By using a sensor with more sensitivity, the microprocessor can choose different ranges of times the smoke is on and off. Also, the smoke can be made proportional to the dynamic loading or other effects noted herein, not just the wheel speed.

In one embodiment, the fan is reversed not just to stop the fan as in the prior art, but to actually reverse the air flow for a short period of time to give a cleaner brake between chuffs of smoke. Also, the propeller fan could be run in reverse for a long duration, filling a locomotive chassis with smoke and simulating a fire. This would be accomplished by the inlet of the fan being connected to the interior of the locomotive, drawing air from there, and filling it with smoke in reverse. This also allows the reversal to cut off chuffs by hiding the smoke in the cab for the short time of such a cut-off reversal. Other embodiments of the present invention include an optional cam switch or encoder for synchronizing smoke and sound chuffs or other mechanical noises. In addition these detectors may be used to detect wheel slippage and an optional photosensor used to detect ambient light levels, adjusting lighting/sound effects accordingly. The smoke unit could alternately use an atomizer to generate the smoke/steam.

Remote Control

Figure 4:
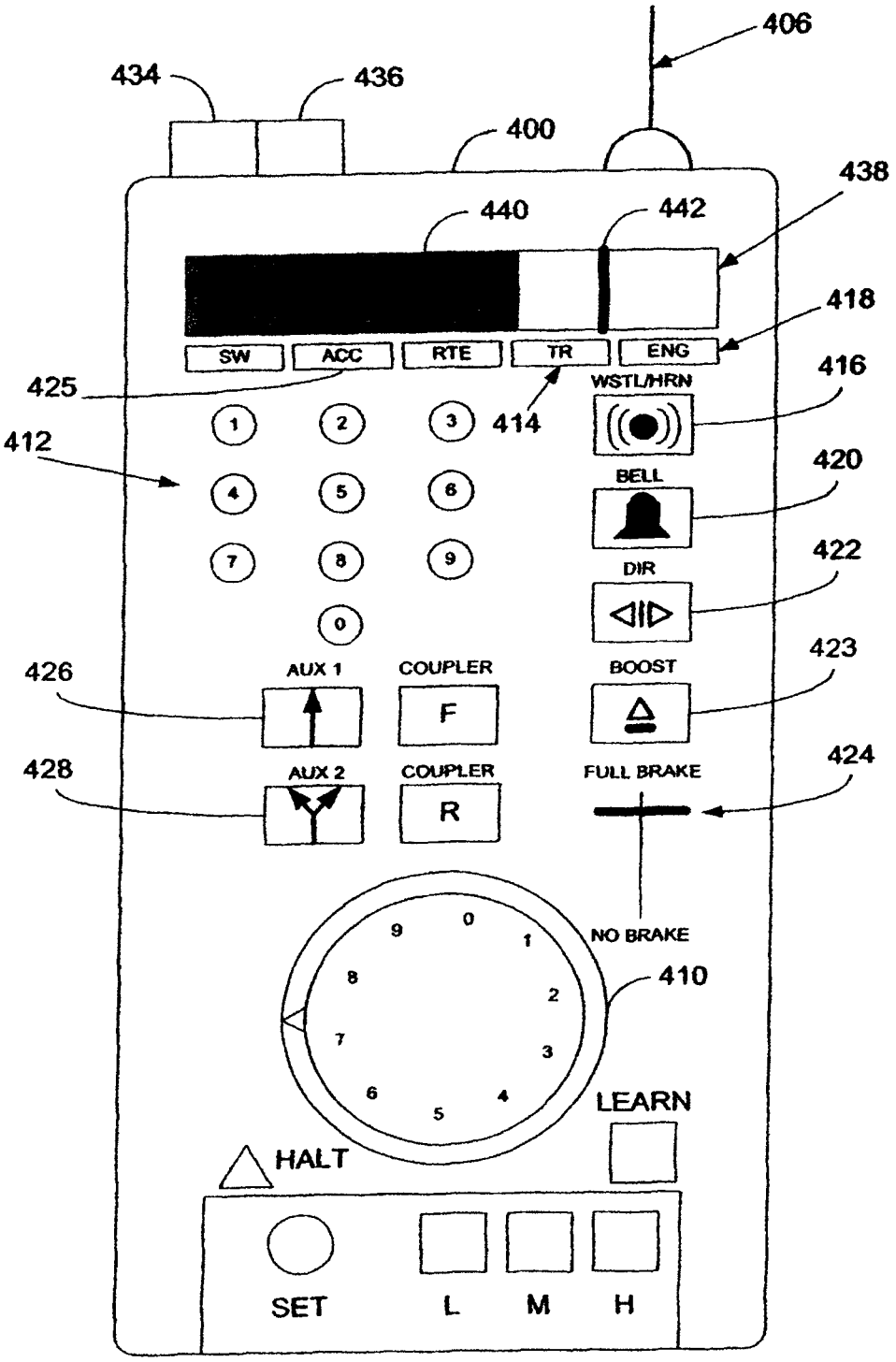
FIG. 4 illustrates an exemplary embodiment of a model train controller in accordance with the present invention.

FIG. 4 illustrates an exemplary embodiment of a model train controller in accordance with the present invention. Controller 400 may also be referred to as a remote, remote control, remote control unit, etc. Remote control 400 includes a throttle dial 410 and a numeric keypad 412. A number of other control buttons are provided including, but not limited to, throttle levers, pressure sensitive buttons, multifunctional buttons, sliders, triggers, touch screens, and touch pads. For example, a train button 414 is pressed to select a particular train, with the train identification (ID) number then being punched in on the keypad 412. Once the train has been selected, certain functions of the train can be activated by pressing other buttons, such as a whistle/horn button 416, an engine button 418 for activating an engine, a bell button 420, a direction button 422 for controlling the direction of a train, and a brake throttle 424. Also provided is an accessory button 425 which can select a particular accessory, such as a signal light or a switch. An accessory can be selected by pressing ACC button 425, and then selecting the ID number of the particular accessory. The functions of the accessory can then be controlled by pressing auxiliary buttons 426 and 428. It should be appreciated that different buttons associated with different functions may exist, and the stated functions and buttons may be changed and/or rearranged. For example, additional address items may be addressed such as, but not limited to, voice commands, address IDs, factory names, user names, numbers (such as a 4 digit label) on the side of a model train component, relative location in reference to another model train component, physical location, road names, model train type (i.e., diesel, steam, etc.), point and play items, and memory modules.

Remote control device 400 includes an IR receiver 434, and optionally a transmitter 436 for detecting IR signals by IR detector 434. It should be appreciated that remote control device 400 could include other types of transceivers to transmit/receive information, such as a proximity RF transceiver. Antenna 406 is used for RF transmissions to a Central Control Module, or directly to trains/accessories.

In one embodiment of the present invention, a user may hold remote control unit 400 within a small distance (such as 120 cm or 48 inches) to a desired device (i.e., engine, accessory, etc.) so that the appropriate device is detected. To send a command to that particular device, the user could press one of the command buttons (i.e., buttons 416, 420, etc.), selecting which type of device is being operated without entering the device ID. Subsequently, the device ID is sent by remote control unit 400 and received by the appropriate device, wherein a transmitter within remote control unit 400 automatically sends the device ID when the command is transmitted. In another embodiment of the present invention, the device ID could be indicated by press a learn button on the remote control unit. This button would open the remote control unit to look for a desired device ID. A broadcasted command that states "transmit ID now" could be sent out to model train devices when the user desires to find the ID of a particular device. Once the desired device ID is found, a microprocessor of the remote control unit could "memorize" the device ID, eliminating the need to manually enter the device ID and reducing IR "chatter."

The IR link could also be used to identify the proximity of the remote control to the train. This could be used to tailor effects based on the location of the operator. For example, U.S. Pat. No. 6,457,681 describes a Doppler effect to have the sound increase then decrease from a certain point. This invention allows that certain point to be where the user is. Alternately, the location of the remote could be picked up from the IR link by whatever IR enabled train or accessory is closest, with the information being shared with other trains and accessory, allowing sounds such as the Doppler effect to be customized to the location of the user. Alternate methods of determining the location of the remote could be used, such as the use of simple triangulation sensors on the train layout.

In another embodiment of the present invention, a display 438 is provided. In this embodiment of the present invention, when remote control unit 400 is pointed at a particular train, the train ID number could be detected, and a microprocessor inside remote control unit 400 may instruct display 438 to show the train ID number. Display 438 could also display text that indicates that the ID number corresponds to a train, and not an accessory. In addition, other parameters, such as a name, road number, and engine parameters could be transmitted over a communication link, which may then be stored in remote control 400 or a Central Control Module. Other examples of interacting with display 438 include, but are not limited to, activating a command to display an icon or words on display 438 to confirm an action, using a graph, such as point-line, pie, bar, etc., to display non-Boolean values pertaining to model train layout objects, wherein the graphs may display more than one value at a time. Icons may be toggled to display Boolean type values pertaining to model train layout objects. Icons may be shown in various sizes, intensities, or flash rates to display non-Boolean values of model train layout objects, wherein many different icons may be shown in the same location to represent information. An example of this comprises an icon of a gauge with the needle moving to various positions, where the information is displayed by selecting a correct gauge/needle icon based on a layout object parameter such as throttle position of the remote control or an onboard oil pressure value stored in memory on a model locomotive. Additional examples of interacting with display 438 include, but are not limited to, displaying a train on display 438, where the train displayed could show whether a smoke unit is turned on, headlights are on, etc., and using a touch screen where touching corresponding areas of the displayed train could generate a corresponding command. For example, touching the smoke stack shown on a train displayed on display 438 could toggle the smoke unit. In one embodiment of the present invention, remote control unit 400 can be put into a "silent mode" where remote control unit 400 will vibrate in response to commands. Other displays could be used for accessories, such as an alpha display of the word "switch" along with the switch number. Thus, the user is given visual confirmation that the appropriate train accessory has been selected, and can then directly activate other buttons, such as bell button 420, directional button 422, etc. In addition, display 438 on remote control unit 400 gives feedback about the physical operation of a train such as strain, showing the difference between a target speed input by the user, and an actual or command speed sent to the train engine. This may be done, for example, with gray bar 440 representing the command/actual speed, approaching black bar 442, wherein black bar 442 represents the target speed. In one embodiment of the present invention, the use of display 438 allows for the user to name various devices that may be displayed upon selection, and having the remote control unit keep a queue of previous addressed items. For example, a user could push one of the type buttons (i.e., SW, ACC, RTE, TR, ENG) twice to access the previous item that was addressed. Each additional push after the initial selection within a certain timeframe could result in a toggle between the last and previous item addressed. It should be appreciated that, toggling is not limited to the last and previous item addressed. Thus, toggling could also occur between the last item and the third, fourth, etc. previous addresses used. In one embodiment of the present invention, numeric keypad 412 and other buttons may light up to confirm selections. Remote control unit 400 may adjust the light intensity of the buttons to create a visual alert for the user. For example, if a locomotive experiences a simulated mechanical strain, the ENG button 418 may blink back and forth from half intensity to full intensity to create a visual alert. In addition to adjusting the intensity of individual backlit buttons, remote control unit 400 can also adjust the light intensity of display 438. In one embodiment of the present invention, a photosensor is used to automatically adjust the backlight intensity based on the current ambient light levels.

Remote control unit 400 may also be configured to receive and generate force specific effects. Remote control 400 may be equipped with servos in levers and throttle knobs configured to generate vibrations that can be felt in the user's hand. For example, if a locomotive crashes, large movements in the remote control unit including the buttons and throttles may be felt. In one embodiment of the present invention, if two users are controlling the same locomotive using two distinct remote control units, as motor throttle 410 is moved on a first remote by the first user, a second motor throttle located on a second remote may move itself to match the movement on the first remote.

Remote 400 may also display detailed information about a controlled model train device being controlled by remote 400. For example, as a locomotive is being controlled by remote 400, the locomotive may display a number of "gauges" on screen 438. Detailed information about the locomotive such as engine temperature, oil/water pressure, vacuum/throttle level, etc. could be displayed. The locomotive may change the level of these parameters to alert the user. One example of parameters changing comprises a simulated engine problem occurring on selected locomotive, wherein the oil pressure begins to drop. In addition, other effects could occur, such as producing beeping sounds on the locomotive and/or remote unit, flashing ENG button 418 on remote 400, flashing an oil gauge on display screen 438 of remote 400 to alert the user of a train problem, etc. Remote 400 may also display text messages to the user such as "Oil pressure below normal, proceed to service station as soon as possible." It should be appreciated that the above examples are merely illustrative, and many other examples exist.

Remote Control Electronics

Figure 5:
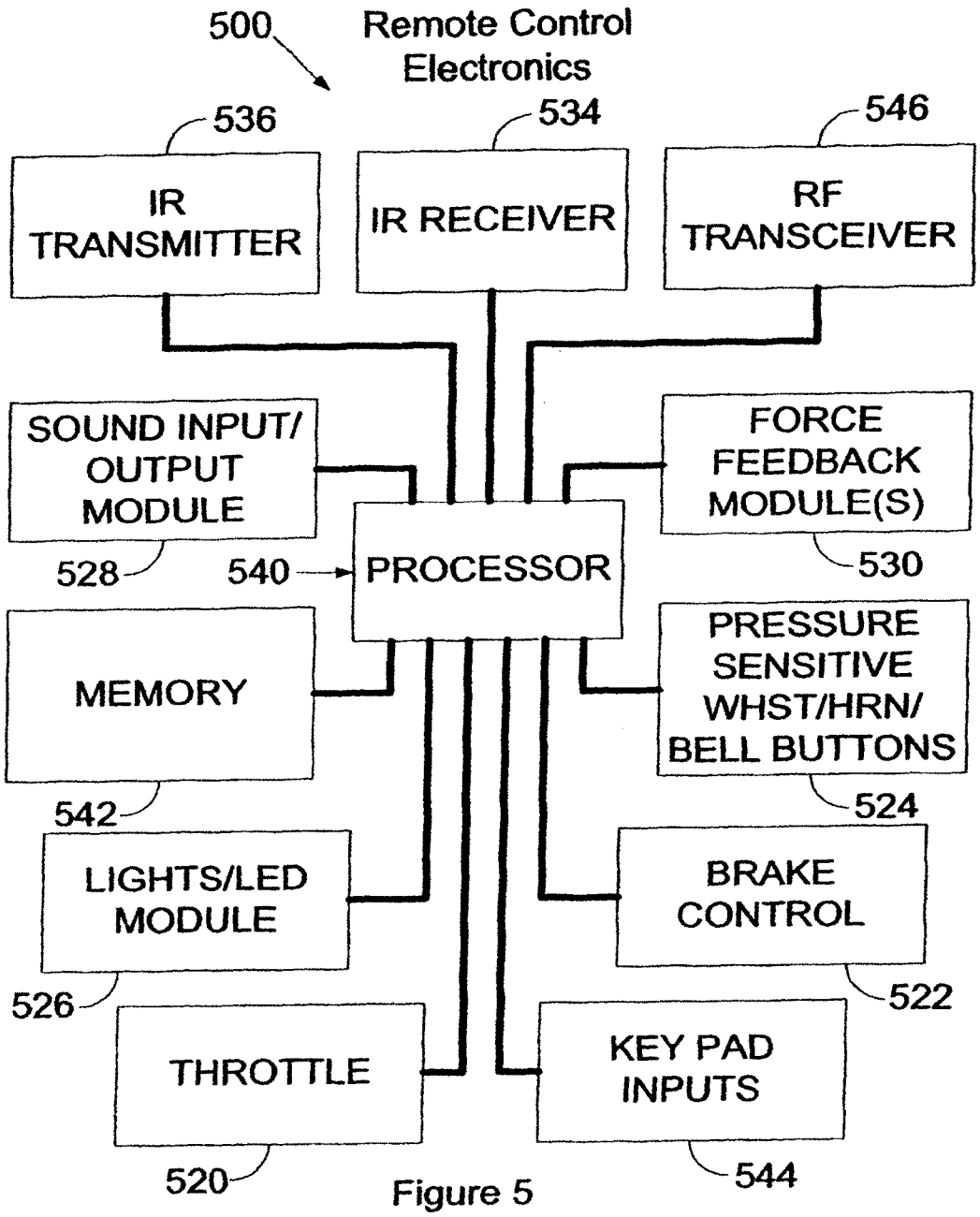
FIG. 5 is a simplified diagram illustrating an embodiment of the electronics in the remote controller of FIG. 4.

FIG. 5 is a block diagram illustrating the electronics and the interior of remote control device 400 of FIG. 4. A processor 540 controls the remote control unit with a program stored in the memory 542. In one embodiment of the present invention, memory 542 is inserted through external memory slots. Keypad inputs 544, as well as throttle input 520, brake control input 522, and pressure sensitive inputs 524 controlling whistle/horn and bell effects are provided to the microprocessor to control it. The microprocessor controls an RF transceiver 546 which connects to RF antenna 406 to transmit commands to a Central Control Module or directly to trains and accessories. IR receiver 534 and IR transmitter 536 are also controlled by the processor. Throttle input 520 may comprise a rotary encoder used in conjunction with the motor throttle of the remote control unit. Other optional devices in the electronics of remote control device 400 include, but are not limited to, levers and sliders, force feedback module(s) 530 (i.e., vibration/lever/slider servo/resistance generator), display screens, lights/LED module 526, touch screens, touch sensitive (pressure sensitive) inputs, sound input/output module 528 comprising speakers and microphones, etc. Pressure sensitive inputs could control motion, smoke, and sound of the model train. In one embodiment of the present invention, it may be possible to remove a section of the remote control unit and replace it with another section specific to a train or accessory. In this manner, sections of the remote control unit are modular and have "plug and play" like capabilities adding features such as voice generation/recognition, additional controls, additional outputs, and additional network interfaces. External ports may exist configured to connect keyboards, mice, and joysticks together. Lights/LED module 526 may comprise various lighting circuits that exist behind an LCD screen and individual keys. A touch pad could respond to movement of the user's finger to move through menu choices, with varying pressure or varying finger speed accelerating the movement through the menu, or otherwise varying the input.

Dynamic Engine Loading Calculator

Model train operation traditionally was operated in a "conventional" mode, wherein voltage applied to a track was increased and decreased to speed up and slow down a model train respectively. The standard method for controlling the voltage to the track was via a throttle lever on a transformer. Conventional engines had simple operations and were susceptible to variations in speed when a constant voltage was applied to the track. For example, a train engine running at 10 volts would noticeably slow down when traveling up a steep incline or around a curve in the track. The operator would have to take notice of the upcoming conditions and manually adjust the voltage to attempt to have the engine maintain a somewhat constant speed up the hill, down hills, around curves, etc. The voltage operation range of the engine would also change depending on the load that the engine was pulling. For example, an engine that was not pulling any cars would begin to move when about 6 VAC (volts AC) was applied. However, a train that was pulling a large amount of cars may not begin to move until about 8 VAC was applied. The extra voltage applied was the extra power needed to overcome the inertia of the motor in addition to the weight of the cars being pulled. The goal of the Dynamic Engine Loading Calculator is to seamlessly allow realistic motor operation of the engine taking into consideration the forces acting against the engine. The Calculator takes into consideration the level of incline the train is traveling, the weight of cars being pulled, the train brake applied, and other factors that calculate the amount of power to be added or removed for the train to reach the "target speed" entered by the user. This removes the need for the user to manually adjust for such conditions. The Dynamic Engine Loading Calculator does these operations in such a way as to mimic real train operation.

Figure 6:
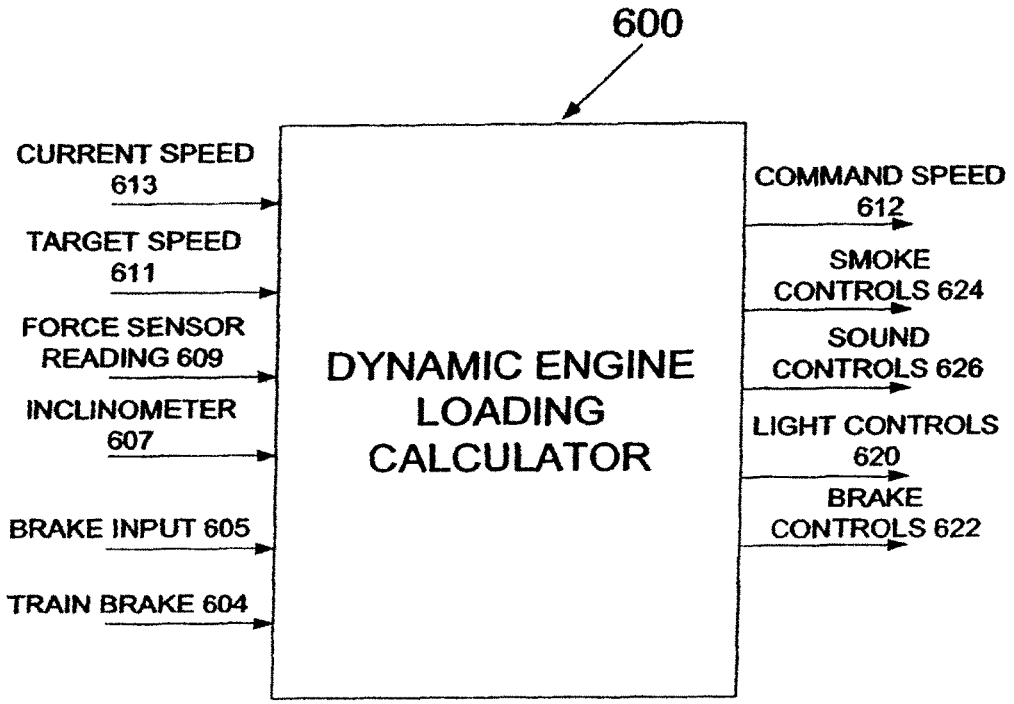
FIG. 6 is a diagram of a Dynamic Engine Loading Calculator in accordance with the present invention.

FIG. 6 is a diagram of a Dynamic Engine Loading Calculator in accordance with the present invention. This Calculator can be in software and/or hardware in the remote control unit, Central Control Module, or even the train itself. The Dynamic Engine Loading Calculator 600 may comprise one or more processors/systems. One or more of the inputs shown on the left side of FIG. 6 (i.e., inclinometer 607, force sensor reading/input 609, train brake input 604, brake input 605, etc.) are used to produce one or more of the outputs shown on the right side of FIG. 6 (i.e., command speed motor output 612, light controls 620, brake controls 622, smoke controls 624, sound controls 626, etc.) according to an embodiment implemented in the present invention. It should also be noted that current speed input 613, target speed input 611, force sensor reading 609, inclinometer input 607, train brake input 604, and brake input 605 are not exclusive to the Dynamic Engine Loading Calculator, and can be shared with other aspects of the systems simultaneously. It should be appreciated that train brake input 604 acts more like a trim rather than a brake (brake input 605). The goal of the Dynamic Engine Loading Calculator is to create realistic engine operation taking into consideration the factors that would effect a real train's operation. In order to do this, different forces that would affect a real train are also measured on the model train or set via user input. Using this information, the Dynamic Engine Loading Calculator can produce effects and sounds that mimic those of a real train. An example of such effects is the sounds and level of smoke a real train would produce when struggling to overcome the force of a large load hindering acceleration. The difference between the target speed and the current rate of movement can be used to determine an acceleration profile, or a fixed acceleration could be used regardless of the difference. In alternative embodiments of the present invention, target speed input 611 and force sensor reading 609 can be used to determine the acceleration to attain the target speed depending on the amount of force sensor reading 609, which would correspond to the load of the model train engine. In other alternative embodiments of the present invention, instead of using force sensor reading 609, a user could indicate and store the number of cars in a particular addressed train, and a force or load proportional to the number of cars could be assumed by the Calculator. The basic acceleration that is derived from the current rate of movement of the engine and the target speed to be achieved is then modified with the inputs of the train brake, inclinometer, and force sensor to create a new acceleration profile. Due to this, the same engine without a heavy load may accelerate quicker and with more ease in comparison to the same train with a heavy load. Also, the amount of smoke and the labor of sounds of the train may increase based on the calculations that the train must overcome greater forces wherein the motor would realistically be under a greater labor and strain.

Optionally, an inclinometer or another type of angle detection circuit such as a digital pendulum could indicate the elevation of a train, showing whether the train is on a hill, and provide this to the Calculator. In alternative embodiments of the present invention, the location and height of hills on the model train layout could be entered by the user, or a special car equipped with an inclinometer or other elevation detector could be sent around the model train layout to generate this elevation information. For example, the Calculator can take into account the length of the train, providing a load value when the engine reaches the top of a hill, and a different load value when the middle of the train reaches the top of the hill. Other inputs to Calculator 600 may include force sensitive inputs from a remote control unit, the number of cars the train carries (determined by a datarail reporter and sent to the locomotive), and the engine current draw, which could also be used to detect binding, wherein this information can be used to improve starts.

The following describes an example of an embodiment of the present invention. It should be appreciated that the example in no way limits the essential characteristics of the present invention. A user may input a desired or "target" speed level using a motor throttle of remote control unit 400. For example, a target speed level of 100 (out of a scale of 200) may be input by the user. This target speed is provided to the Dynamic Engine Loading Calculator 600, which determines an appropriate acceleration and power level applied to the motor in order to reach the target speed, and outputs a series of command speeds to reach that target speed, over a finite period of time. It should be appreciated that the target speed is provided regardless of power input simulating an increase in the load of a model train. According to an embodiment of the present invention, the power of the track does not control the speed of a model train. For example, if the previous target speed level was set to 80, commands of 81, 82, 83, on up to 100 may be issued every ½ second. These command speeds are transmitted sequentially (e.g., every ½ second) to the locomotive. These command speeds are received by transceiver 308 (FIG. 3), sent to microprocessor 316 and stored in memory 310. It should be noted that microprocessor 316 may comprise one or more microprocessors working together to control the train. The microprocessor provides control signals to motor 312 to adjust its power. Incrementing speed levels are sent to the motor until the engine reaches the target speed level. In one embodiment of the present invention, the incrementing speed levels may comprise commands being sent out (if the Calculator is located within the remote or central control unit), or may be in the form of increasing the power to the motor of the train over a finite period of time (if the Calculator is located within the train). In one embodiment of the present invention, using the remote control unit to increment speed levels could result in the graphing such an increase, or providing a numeric representation of such an increase, without confirmation from the remote control unit. In an alternative embodiment of the present invention, the speed levels could be displayed on the remote control unit, where the speed levels are read from the train via a two-way communication link. In accordance with an embodiment of the present invention, when the speed level information is first processed, the "command speed" level does not match the "target speed" level. As with the speed of a real train, if locomotive 202 were to travel up a hill, the train would move slower due to the force of gravity, and locomotive 202 would "try harder" to reach the top of the hill. In accordance with an embodiment of the present invention, it is possible for the forces acting upon a train to limit the maximum speed the engine can travel. For example, the train could attempt to reach a target speed that is not attainable, due to factors opposing the movement of the train (such as a heavy load, a large amount of train brake, a steep incline, etc.), wherein the train may in effect plateau at the present maximum speed the train can travel given the present power input. In another embodiment of the present invention, when the sum of the negative factors are removed (i.e., the train with a heavy load ascends a hill and is now traveling down an incline), it is possible for the train to exceed the target speed due to the engine not being able to back off power fast enough to compensate for both the real and simulated positive forces toward movement.

As mentioned above, in keeping with the goal of creating a realistic train operating experience that is more accurate in the modeling of movement and laboring sound, lighting, and smoke effects of a train, Dynamic Engine Loading Calculator 600 takes the target/command speed relationship of a model train locomotive and other factors to produce a laboring value to drive the sound, lighting, and smoke effects. In one embodiment of the present invention, Dynamic Engine Loading Calculator 600 receives the target/ command speed relationship from microprocessor 316 (FIG. 3), evaluates the condition of force sensor, inclinometer, brake input, and train brake levels, and provides different intensities to sound, lighting, and smoke effects of a model train system based on the current state of the system. In one embodiment of the present invention, Dynamic Engine Loading Calculator 600 is configured to receive feedback, wherein such feedback may include an integral term, a derivative term, and a proportional term of the motor control. These inputs can be used in conjunction with current speed input 613, target speed input 611, force sensor reading 609, inclinometer 607, brake input 605, and train brake input 604 to influence different events and scenarios of the train as well as incite additional changes to the intensities of sound, lighting, and smoke effects.

Dynamic Engine Loading Calculator 600 decides the intensity of sound and smoke effects by evaluating the relationship between the "set" or "target speed" and the "command speed" being measured. As defined above, the "target speed" is the ultimate speed value that is to be achieved, whereas the "command speed" is the present speed information being sent to the servo motor to reach the "target speed." By measuring this varying relationship, the intensity of the smoke effects produced by smoke unit 324 and the engine/chuff sound produced by sound unit 326 can be calculated into multiple different levels. Also, a Dynamic Variable Speed Compensator of the present invention does not immediately overcome the effect of loading on the model train, a longer duration of laboring or drifting smoke and sound effects can be triggered. More details regarding the Dynamic Variable Speed Compensator are discussed in subsequent sections of the detailed description of the present invention. With multiple different levels of smoke and sound effect intensity and duration, as compared to the three levels of intensity provided in conventional systems, a higher resolution and more dynamic result of realistic smoke and sound effects may be achieved Thus, Dynamic Engine Loading Calculator 600 implements a gradually changing speed, tempo, and cadence, with a much higher resolution of smoke and sound effects, resulting in a more realistic sound and movement of a working model train.

It should be appreciated that Dynamic Engine Loading Calculator 600 does not directly control the motor of a train. The Calculator 600 sends what would be considered the attempted speed for the train, in terms of motor power with all the factors of force and load taken into consideration. This information is sent to the Dynamic Variable Speed Compensator of the present invention. The Compensator is configured to strive to maintain within a reasonable varying range the target power level provided to achieve the target speed entered by the user. In this manner, the "responsibility" of engine speed control is divided amongst these two units (i.e., the Dynamic Engine Loading Calculator and the Dynamic Variable Speed Compensator).

Dynamic Variable Speed Compensator

The Dynamic Variable Speed Compensator of the present invention can exist in either software and/or hardware. In one embodiment of the present invention, the basic form of the Compensator comprises an apparatus and method configured to control a model train motor of a model train locomotive, a medium for receiving the target speed or target motor power level, an apparatus and method configured to estimate the current level of movement of the train, and an algorithm for compensating the motor movement.

According to one embodiment of the present invention, the Compensator uses pulse width modulation as the method for controlling the motor. A pulse width modulator (PWM) has many different possible configurations. In one embodiment of the present invention, a method for controlling the motor involves using a random number generator (i.e., a white noise generator) to vary the frequency of the PWM. A continuous generation of random numbers will produce numbers that are evenly distributed throughout the sample pool. Thus, the average of the PWM frequency will be the value that is set for the power output. The other advantage of using the random number generator for controlling the motor is that harmonics that would normally be generated throughout the system are reduced so that their effect is effectively removed. In addition, the motor could operate in the audio spectrum without a distinct tone, or the motor could run without a human hearing the motor. In one embodiment of the present invention, in addition to PWM, a constant voltage output can also be used to enhance low speed operation where the PWM becomes inefficient.

The Dynamic Variable Speed Compensator receives the target power/target speed information from the Dynamic Engine Loading Calculator. It should be appreciated that the Dynamic Engine Loading Calculator could exist in two separate microprocessors in separate systems and use a method such as serial communication to transfer the power/speed information between the systems. In another embodiment of the present invention, the Calculator and Compensator could be two separate systems operated by one microprocessor. In the one microprocessor embodiment of the present invention, the power/speed information would be passed between the two systems via a software stack, RAM, or nonvolatile memory within the microprocessor. In still another embodiment of the present invention, the Dynamic Variable Speed Compensator would comprise hardware in the form of an analog system. In this embodiment of the present invention, information would be supplied to the Compensator in the form of a DC voltage level or sine wave.

The current movement of the model train may be estimated to allow for the Compensator to understand whether the target speed has been attained/reached. The traditional method employed to measure motor speed involves using an encoder. An encoder takes the rotation of the motor and converts this information into a pulse wave. The time between one or more like edges of the pulse wave is measured to evaluate the speed. Another method employed to measure motor speed involves using a Hall effect sensor, wherein the Hall effect sensor is placed on the to encode the magnetic feedback of the motor. Still another method involves using a light strip on the head of the motor and using a single photosensor to read the light and dark stripes. The photosensor method may have the drawbacks of not having symmetry. An encoder with 24 pulses without symmetry receives 24 pieces of information in one rotation of the motor. An encoder with symmetry that has 24 pulses receives 48 pieces of information in one rotation of the motor. The drawback to achieving symmetry is that the amplifier on a transducer of the photosensor must be tuned for each particular engine. To overcome this problem, according to an embodiment of the present invention, the motor is rotated at a constant speed and the distance between the rising and falling edge of pulse waves is measured and compared with the distance between the same falling and next rising edge. The amplifier on the transducer is then adjusted by the microprocessor until these two distances are the same. Allowing the microprocessor to automatically adjust for symmetry removes much of the cost associated with having a person manually adjust the system during manufacturing. Having more data per revolution is integral to a low ending operation and control of the train. In accordance with an embodiment of the present invention, a feedback system with greater than 60 pulses per revolution of the motor is necessary. With the addition of symmetry, the amount of data available per revolution may provide for improvements compared to current systems in the marketplace. Another improvement involves using dual sensors. The sensors are placed slightly offset of each other so that the pulses generated occur shifted 90 degrees from each other. With the addition of symmetry, the system is now able to receive 4 times the amount of information about the motor. A standard 24 pulse per revolution motor would have 96 pieces of information about the motor. A more exact method of evaluating a motor is to use a resolver. A resolver comprises a moving transformer that generates two signals. The first signal is a sine wave representing the current motor position, and the second signal is a cosine wave representing the current motor position. With these signals, the resolver is able to estimate with high accuracy (such as, but not limited to, 14 bit accuracy) the current position of the motor. This information is then sampled at a regular interval, and the speed of the motor revolution is calculated. In one embodiment of the present invention, an additional method of recovering the rotary and speed information of the motor may involve using three individual capacitors placed in an orientation allowing a calculation to be performed referring to the speed and position of the motor.

In accordance with an embodiment of the present invention, the Dynamic Variable Speed Compensator uses a modified version of a ND (proportional integral derivative) control loop to compensate forces that inhibit motor movement. Traditionally, the PID loop is used to precisely and accurately maintain constant motor speed. Other current methods of motor control strive to maintain a given speed at a given track voltage with little or no variation of speed. The control systems continuously monitor the rotation of the motor and adjust to maintain a speed with variation in as little as one revolution of the motor. In accordance with an embodiment of the present invention, the Dynamic Variable Speed Compensator uses a PID loop that is designed to allow the motor speed to vary. Traditionally, when a user would operate an engine in command or conventional mode without a closed loop motor control system, the user would have to manually adjust the speed of the engine to compensate for forces that inhibited the movement of the train (i.e., a steep incline or a large number of cars/heavy load). This is also indicative of real life operation of train engines. In a real life situation, the train operator must adjust the speed to compensate for varying conditions that the train may encounter. According to one embodiment of the present invention, a user/engineer controlling the model train cannot immediately compensate for the decrease or increase of speed associated with varying conditions. It should be appreciated that it takes time for the user to recognize that a change has occurred within the train system, wherein the user first evaluates a cause, makes adjustments, considers the results, and then ends the adjustment process or continues to make more adjustments. As a result, the model train of the present invention will slow down or speed up for a period of time before the adjustments can be made to compensate. In addition, Dynamic Variable Speed Compensator causes the engine driving the model train to vary in RPMs without allowing the engine to completely stop. The Dynamic Variable Speed Compensator is made to mimic a real life interaction of cause and effect.

When no new target speed is being entered by the user, a command engine with speed control (i.e., a Lionel™ Odyssey engine or an MTH™ Proto2 engine) will maintain its commanded speed regardless of load, hills or other conditions. The present invention provides a Dynamic Variable Speed Compensator that allows the speed to realistically vary due to forces acting on the engine, and does not instantly correct the motor speed. The Compensator does not try to maintain a desired set or target speed, and is only activated when the microprocessor calculates that the actual speed deviates from the "target speed" by a factory or user preset percentage before gradually checking the decrease or increase in speed to hold the motor rotational speed from drifting further. As the forces acting on the motor subside, the train gradually returns to the "target speed" and maintains this speed until a new set of forces begins affecting the train speed again. The Compensator may be implemented in software and/or hardware in the remote control unit, Central Control Module, model train locomotive, or another part of the train system, and use digital and/or analog data transmission.

In one embodiment of the present invention, when the rotational speed of the motor moves below a predetermined threshold, such as 90% of the target speed, the Speed Compensator is activated and acts as a speed boost for the locomotive. The predetermined threshold may be selected by the user or automatically chosen by the system. The Speed Compensator has the ability of applying a different percentage of speed control/compensation. For example, if the current speed is at speed level 50, the Speed Compensator could be at 80%. If the motor is at speed level 10, then the Speed Compensator could be at 100%. Due to the Speed Compensator, a model train should not entirely stall at any time.

The above example can be referred to as "unreliable speed control" or a "dynamic variable speed compensator." As the model train slows to a lower speed level, this "unreliable speed control" is implemented. The present invention allows for a model train to have personality and varies the speed of the train, whereas conventional methods produce model trains with no struggles while a train is moving up a grade, no slippage of the wheels on the track, no variation of speed of a train with a load, etc. This approach works to mimic the speed of a real train. The realistic slowing and gaining of speed in a model train, along with the respective sound and smoke effects associated with the slowing and gaining of speed may be maintained. The respective sound, smoke and light effects vary depending on the data provided by Dynamic Engine Loading Calculator 600.

Furthermore, one or more Dynacoupler™ force sensing module units could be used along with control system 306 to determine how the Speed Compensator is activated. In other words, a force sensing module could measure the force acting between two model train cars, and depending on the force between these cars, a signal for the Speed Compensator to be activated could be sent through a communication link to control system 306.

Additional embodiments of the present invention include allowing the Speed Compensator to send speed burst signals, where locomotive 202 performs short speed bursts. A user could also use the present invention to add a "turbo mode" to locomotive 202. Such capability provides a dynamic variable speed compensation of a model train system. This could involve using boost button 423 on remote control unit 400 to override the Dynamic Variable Speed Compensator and the Dynamic Engine Loading Calculator.

Use of Current Sensor for Force Calculations

As stated in previous sections, the Dynamic Variable Speed Compensator allows for the change in speed of a train to occur to simulate realistic train operation. The speed change may be measured by one or a combination of methods which include, but are not limited to, change in speed from the base line desired speed setting, the amount of force being registered by a force sensing module, the amount of electrical power being used by a motor as measured in voltage and current flow, and the size/weight of the train being pushed/pulled.

Force Sensor

A Dynacoupler™ force sensing module unit measures the force acting between two model train cars, and is described in more detail in copending application Ser. No. 11/187,593, filed even date herewith, entitled "Force Sensitive Coupler for Trains." The force sensor is used to add realism to model train objects. Force sensors allow layout objects to generate lifelike feedback to the forces that act upon it. It should be appreciated that force sensors could be placed in many locations on the model train layout besides on couplers of locomotives. Force sensors could be placed inside of a strain point in a drive train of a model train. Force information could be relayed to system on the train. Lifelike effects could then be generated, such as a clash sound, when spikes in the force sensing module readings occur. Other various effects could also occur. Force sensors can also be applied to non-train effects such as effects located on accessories. Examples of such accessories include, but are not limited to, pressure sensing traffic signals, a coal loader/coal power plant that only powers a model city as long as the coal is supplied, a saw mill/lumber factory that reports daily production based on the weight of the logs that were processed/dropped off, an oil refinery that reports daily production based on the weight changes in the oil containers when "oil" is added, etc. Furthermore, force sensors could be placed in model train scenery objects, such as shrubs, trees, rocks, walls, buildings, fences, railings, road signs, etc. for detection of forces that may act upon them. An example comprises a guard rail that plays crashing sounds when objects bumped into it. Force sensors may also be used under a track to detect and weigh locomotives as locomotives pass a certain piece of track or datarail reporter. Loading cars on a track may use force sensors to detect the amount of cargo the loading cars are holding. Effects can then be generated from information obtained and/or relayed over the network for use by other systems. In one embodiment of the present invention, a force sensor is used as a weigh station which may display a weight of a locomotive on a display screen. The information may also be sent through the network, wherein a locomotive's Dynamic Engine Loading Calculator may determine that the locomotive is heavy, generating effects accordingly.

In another embodiment of the present invention, the force sensor may be used to create lash-ups. A lash-up comprises two or more locomotives connected together and used as one. Traditionally, locomotives had to have identical gearing, tire size, motors, and electronics. If unmatched locomotives were lashed together, they would fight each other due to the drive differences. The force sensor allows for connected locomotives to sense strain between each other. This allows for any locomotive to be seamlessly lashed together. For example, when a head and tail unit are lashed together, as the head locomotive increases power or the load increases, the tail locomotive senses that more strain is being created between the two. The tail locomotive then increases power until the strain forces are shared between the locomotives. In this manner, any number of different locomotives could be lashed together and act as one seamlessly.

In accordance with another embodiment of the present invention, a force sensor may be used to detect large and almost instantaneous forces applied to the train, wherein the force sensor is used to trigger effects/sounds. For example, when a train moves too fast and is physically derailed from a track, the train has a battery that would allow the sounds to operate for a time while the power is removed. The almost instantaneous change in force detected by the force sensor could result in the sound system of the model train playing derailing sounds. It should be appreciated that the force sensor may be placed in the middle of the train configured to generate front, rear, and side to side force readings.

Automatic Dynamic Momentum

The hobby of model railroading creates a fantasy world for the user/operator. Model railroaders strive to achieve realism in order to maintain the model railroading experience. It is important to note that the difference between a model train and a real locomotive involves the power of the motor with respect to the size of the engine. The motors in a model train are significantly more powerful than the motors of a real locomotive. This characteristic can detract from the realism of model railroading because the model train will not give off the appearance of the motor working to move the enormous weight of the engine. With the introduction of command control in conventional model railroad systems, the problem described above was partially solved. Previous solutions involved using the addition of three momentum settings for the engine. This would allow the train to run as though it was under the effect of three different types of weight. The downside to using this method was that the effect does not always fit the situation and does not adapt and change as the scenario of the train changes. The Automatic Dynamic Momentum Unit of the present invention uses inputs from the force sensor(s), train brake, inclinometer, etc. and adjusts the Momentum applied to the system accordingly. In other words, a model train may act differently depending on how much weight (i.e., number of cars) is being pulled. For example, a train will accelerate faster when the engine is not pulling 10 car loads of coal. The model train motor may have the available power to accelerate at the same rate with or without the loads of coal. In order to maintain the realism of model railroading, the acceleration must be slowed intentionally to present the illusion of size and weight of the train. According to one embodiment of the present invention, the Automatic Dynamic Momentum Unit is adjustable by the user. In other words, the Automatic Dynamic Momentum Unit allows the user to adjust how much dynamic momentum influences the user's model train experience. The Automatic Dynamic Momentum Unit can be adjusted from 0% to 100%, providing dynamic momentum effects (such as smoke, motion, and sound). The Automatic Dynamic Momentum Unit also affects the Dynamic Variable Speed Compensator. When the dynamic momentum is set to a high level, the Dynamic Variable Speed Compensator allows for trains to vary in a greater magnitude from the target speed set by the user, because the weight of the train has a greater effect on the ability to overcome changes that inhibit movement. If the user sets the Automatic Dynamic Momentum Unit to a lower percentage, the Dynamic Variable Speed Compensator may reduce the range that the train is allowed to vary from the target speed. In this manner, the illusion of weight and size of the engine is maintained through all aspects of model railroad operation. This same concept also applies when the train encounters a steep incline or decline. In the of a steep incline, the engine will slow down, then gradually speed up to attempt to once again reach the target speed set by the user. Depending on how much dynamic momentum is applied by the user settings, the train may or may not reach the target speed until the incline is fully traversed. When the train approaches a steep decline, the train will speed up. The locomotive will then gradually reduce power to the motor to attempt to once again reach the target speed set by the user.

When model train locomotive 202 travels at a very slow speed, an Automatic Dynamic Momentum Unit will make it seem as though the engine is more difficult to stop because of the "weight" of the engine carrying it forward. The "weight" is a simulated feel. At the same time, when the engine is traveling at its slowest possible speed, it will not stop because the Dynamic Variable Speed Compensator will prevent a train from stopping if the train was not issued a stop command. Locomotive 202 may contain a large load and travel slowly, but will not stop rolling. This gives the illusion of mass and weight, modeling the inertia of a large moving train, creating a momentum effect at super slow speeds that is very realistic. The Automatic Dynamic Momentum effect is activated by the target speed/command speed relationship (i.e., difference) calculated by microprocessor 316, and is further affected by train speed relative to a stop condition.

Furthermore, a model train at any speed pulling or being pushed by a heavy load, may use one or more Dynacoupler™ force sensing module units to measure the amount of load of a model train locomotive, and add this data to the Automatic Dynamic Momentum Unit resulting in a change in the motor throttle response. The motor throttle response is directly affected by the Automatic Dynamic Momentum Unit, with response to adjustments varying according to the load of the model train locomotive being measured by a force sensing module, and the illusion of power under strain is reinforced by the extreme loading sounds produced by sound unit 326, playing a "sluggish chuff sound." During operations, a user can view speed graph 438 located on a controller unit 400, monitor the new target speed against the gaining (or decreasing) command speed, and make adjustments, if needed, to motor throttle 410 located on controller unit 400 to affect the target speed. The motor throttle of the present invention is described in more detail in subsequent sections in the specification. In this way, turning the motor throttle introduces a speed change over time yet introduces and/or intensifies loading sounds and smoke effects immediately to model the effort required to accomplish the desired speed changes. As the train reaches the desired target speed, the sound and smoke effects may subside to some degree depending on the forces being measured by the force sensing module.

Thus, a dynamically changing acceleration/deceleration rate occurs as a result of the force sensing module monitoring the positive or negative forces being applied to the engine pulling the train. This yields the "dynamic momentum effect" in a train and/or controller and a varying "feel" to the motor throttle changing the sound and smoke effects, putting the operator/user in touch with the train's physics in a new way. A good illustration of this effect involves a train traveling downhill, being pushed by a heavy load from behind, where the sound and smoke effects will be dramatic with a sharp decrease in the target speed (i.e., a sharp counterclockwise motor throttle turn), yet the train movement will not slow down very quickly. Dramatic sound and smoke effects are produced as the model train fights to slow down against the forces being modeled.

Adjustable Train Brake

Train brakes are used in real trains to slow a train by applying brakes to the wheels in the rolling stock being pulled by a locomotive. Each car will typically have its own brakes, and the braking is spread out over all the cars of the train. Train brakes are also used to stretch out the cars (i.e. take out the slack) so that the cars do not bang into each other traversing the upgrades and downgrades along the rails. Passenger trains may employ the train brake to avoid jostling of passengers. Therefore, train brakes are used to generate a smoother ride.

In keeping with the goal of creating a realistic train operating experience using the actual controls a real train would use, as opposed to a simple speed and direction control as found in conventional model train systems, an Adjustable Train Brake of the present invention is a trim that reduces speed values and compresses throttle related milestone events, such as RPM (revolutions per minute) sound and smoke simulation levels, into an adjustable reduced top speed envelope. In FIG. 4, an Adjustable Train Brake may be represented by the combination of motor throttle 410 and brake throttle 424, and is located within remote control unit 400. The train brake input can simply control the train speed, or can be sent to an optional braking car(s) in the train, or a combination of both. When train brake throttle 424 is engaged, a braking command is processed, along with other inputs, and a new command speed (and/or brake command for a braking car) is sent from remote control unit 400, and received by transceiver 308, which may be located within locomotive 202. In one embodiment of the present invention, brake throttle 424 could be placed in the full brake position, motor throttle 410 could also be placed in the full RPM position, and the engine would not move but would produce loud straining sounds, such as a maximum smoke/steam output, and the remote control unit and/or the train could vibrate corresponding to a large mechanical strain/shudder. In another embodiment of the present invention, train brake unit 254 located in the model train system 200 as shown in FIG. 2 may restrict movement of the wheels in response to the braking command, simulating a real train brake. In another embodiment, brakes may be applied to rolling stock cars equipped with brakes. Adjusting the train brake takes the slack out of the train, modeling real train applications.

The Adjustable Train Brake of the present invention affects loading calculations done by the Dynamic Engine Loading Calculator, Speed Compensator, and Automatic Dynamic Momentum, which in turn affect the engine sound system produced by sound unit 326. In some situations, applying the Adjustable Train Brake may slow the train by slowing the engine, but not trigger engine brake sounds. Train brake equipped cars with a sound system may play the sound of screeching brakes relative to the amount of train braking applied, as well as produce smoke to simulate the heat generated by the amount of train braking applied. Thus, the illusion of the train brake slowing the train by increasing drag is created. In one embodiment of the present invention, train brake cars are not necessary to create the illusion of a train brake. Merely using the adjustable train brake motor throttle 410 located on model train controller unit 400 is suffice. The train brake cars add more realism to the experience.

Sometimes, merely using engine brake throttle 424 to stop a train consisting of many train cars will not work well. The momentum and weight being simulated by the pushing from behind may be too large for engine brake throttle 424 to handle and the train cars may bang into one another as the load shifts on crests, etc. To enhance the operation of a model train and provide a far more realistic operating experience, the Adjustable Train Brake of the present invention and sound effect control unit 326 is a new addition to model train throttles. Motor throttle 410 of the Adjustable Train Brake acts as a trim. Applying train brake throttle 424 slows the train. The more train brake throttle 424 is applied, the lower the top speed, compressing the motor throttle control "area" of the motor rotational speed while keeping all the milestone trigger events in place relative to one another by reducing the value of each speed step as the trim is added.

When train brake throttle 424 is applied to a train moving downgrade, the model train will stop from "running away" and produce a laboring sound from the engine as the model train pulls downgrade against train brake throttle 424. Brake cars with rubber wheels may be used in one embodiment. The train brake cars may restrict or lock the rubber tired wheels and emit a screeching brake sound at varying levels depending on how much the train brake is applied or generate smoke simulating this effect. A low level of train brake will be relatively quiet, while a high level of train brake can result in a loud sound effect. Flat wheel sounds, the sound of a wheel damaged by train brake overuse, etc. may be heard from some train brake cars when the brakes are not in use.

Another embodiment of the present invention involves taking data from the Variable Speed Compensator, data from the Dynamic Engine Loading Calculator, data from the Automatic Dynamic Momentum Unit, data from the Adjustable Train Brake, and data from one or more Dynacoupler™ force sensor units all together, to model the total effect of loading placed on a model train to calculate a realistic movement and synchronized dynamic of sound, smoke, and lighting effects. Dynamic Engine Loading Calculator 600 may be used with or without the force sensing module loading input and/or adjustable train brake levels to calculate the intensity levels and duration of smoke, light, and sound effect intensity. In this regard, if a controller unit does not contain an adjustable train brakecontrol function, and a force sensing module is not part of a model train engine system, loading can still be calculated to drive the levels and duration of smoke and sound effects. Furthermore, the Variable Speed Compensator, Dynamic Engine Loading Calculator, Automatic Dynamic Momentum Unit, Adjustable Train Brake, and force sensing module systems can beused alone or in combination with one another to create a unique movement, throttle feel, light, sound, and smoke effect experience in operation of a model train.

Spectrum Control of Model Train Throttle

In accordance with an embodiment of the present invention, spectrum control is provided, wherein spectrum control comprises a combinational use of various effects available in the model train environment. These effects include, but are not limited to, mechanics, lighting, sound, and smoke. These effects are used to simulate the prototypical operation of real trains. For example, these effects could be used to simulate a model train encountering a heavy load situation when pulling a large load up a hill.

Spectrum control allows the user to set various operational and control limits of the model train being operated. For example, the user may apply simulated train brakes from the remote control while operating the model train. This could cause the model train to simulate the drag caused by the brakes being applied. The model train's velocity range could be limited by this action. Thus, the motor throttle placed on full could produce less than full throttle results. The lighting, smoke, and sound systems could also be stimulated to increase outputs based on the brakes being applied. The above description may be thought of as a simulation of a braking condition.

In one embodiment of the present invention, the condition of braking could be further enhanced by the use of a braking car located in the model train. The car would introduce actual friction similar to the braking action of a real train. The braking car could also produce lighting, smoke, and sound effects appropriate to the situation. It should be further noted that the motor output of a model train far exceeds the output of a real locomotive of proportional size. This creates the need to simulate large loads that are present in the real world. This may be done by controlling the output of various effects.

FIG. 4 illustrates a perspective view of an example of spectrum control of a model train throttle in accordance with the present invention. The system of FIG. 4 is compatible with the train set shown in perspective view in FIG. 1.

Remote control unit 400 may act as the master controller for a model train system. Within controller 400, hardware circuitry and/or software is implemented to take in commands from a user. The remote control unit is linked to train system components through a communication link, which may be implemented with wires or be a wireless system. Examples of commands to be sent to train system components are controlling the velocity of a model locomotive, switching train tracks, opening/closing couplers that connect cars together, producing a bell or whistle sound, turning on/off lights, etc.

Remote control unit 400 controls the movement of model train locomotive 202. Model train locomotive 202 may pull other model train railcars within a model train. In one embodiment of the present invention, model train motor throttle 410 and model train brake throttle 424 are located within remote control unit 400. Furthermore, model train motor throttle 410 may comprise a rotary dial which controls the target speed of the model train motor of model train locomotive 202.

In some situations, a model train user may desire to have the motor of model train locomotive 202 simulate a high output, but have the brake throttle fully applied. The present inventions allows for motor throttle 410 and brake throttle 424 to work in conjunction to act as a trim providing a spectrum control of the speed of locomotive 202, as well as limit the velocity output of the locomotive along with simulating the light, sound, and smoke effects associated with a given condition. For example, if a user moves brake throttle 424 to fully apply the brake, and then moves motor throttle to the '8' position (a high output setting), locomotive 202 would simulate high output effects like output sound, smoke, etc., but operate at a very slow velocity. This action simulates the locomotive being under extreme load because the brake is fully applied. Furthermore, motor throttle 410 and brake throttle 424 may act as trims to increase the resolution in control of the overall speed of a model train. It should be appreciated that the velocity range that is condensed by the braking action still contains the same amount of resolution, just compressed into a smaller operating area. In addition, with a force feedback ability, the remote control unit and/or other devices could have vibration/shudder capabilities. Therefore, simulating a high load condition may be both felt and seen.

Another example of a model train simulating high output with little forward movement occurs when model train 202 pulls a very large load. It is possible for the model train to pull a very large load, and have the motor simulate a high output situation, where the overall speed of locomotive 202 could be very slow. It should be appreciated that the control of the output of the motor can come from a user and this output control is not automatic.

Additional embodiments of the present invention include producing a sound based on the simulated output of the model locomotive. Thus, even though a train is moving slowly, if train is pulling a large load, sound reflecting this could produce a large "chug" sound. Another example is lighting up the number indicators on motor throttle 410 as the velocity level is reached. For example, when a model train motor reaches a velocity corresponding to level '8', the numbers '1' through '8' could light up.

The present invention can be embodied in other specific ways without departing from the essential characteristics of the invention. For example, brake throttle 424 could also consist of a rotary dial or a linear device such as a sliding potentiometer, while maintaining the essential characteristics of the present invention. In addition, a pressure sensitive button could be used to control the model train throttle. More details on embodiments of a velocity controller are set forth in copending application Ser. No. 10/723,460, filed Nov. 26, 2003, entitled "Model Railroad Velocity Controller," the disclosure of which is hereby incorporated herein by reference.

Velocity Controller

Remote control unit 400 of FIG. 4 includes a velocity control knob 410. Control knob 410 controls the magnitude that the control system could apply to the motor in the locomotive, and may occupy a range of positions corresponding to the rotation of knob 410. Movement of knob 410 in a clockwise direction results in application of power resulting in forward movement of the model train. Movement of knob 410 in a counterclockwise direction results in application of power resulting in backward vector movement (i.e., slowing down) of the model train.

In one embodiment of the present invention, throttle operation may comprise a clockwise movement of the motor throttle, wherein the clockwise movement would create forward motion of the model train. A counterclockwise motion of the motor throttle would first slow the model train, and an increased counterclockwise motion of the motor throttle would produce a "dead zone area" for stopping the model train. Further counterclockwise motion of the motor throttle would create increased reverse motion of the model train.

Processor 540 receives the input from the control knob, calculating therefrom the amount of power ultimately conveyed to the model train. This velocity calculation is based not only upon the number of pulses received from the control knob sensor in a predetermined period of time, but also upon the elapsed time between these pulses. The shorter the elapsed time between pulses, the greater the power communicated to the train.

Application of a voltage multiplier to govern train velocity can occur over a range of control wheel rotation speeds. For example, in accordance with one embodiment of the present invention, rotation of the wheel at speeds corresponding to a movement in greater than 50 ms in duration could result in a multiplication factor of one. Rotational movement of a time of between about 25-50 ms could result in a multiplication factor of two, rotation of a full turn over a time of between about 12-25 ms could result in a multiplication factor of three, rotational movement of between about 6-12 ms could result in a multiplication factor of four, and rotational movement of a time less than 6 ms could result in a multiplication factor of eight. For example, the full 200 velocity steps could be achieved in 180 degrees of rotational movement depending on the rotation speed. Additionally, the speed of rotation feature can be set to not kick in until a predetermined knob speed threshold is exceeded, allowing a user fine control at slower turning speed without having to worry about activating the speed feature. It should be appreciated that the factor could be increased or decreased by any factor, such as decreasing all times by a factor of 10.

Initially, a user can rapidly rotate the knob to attain coarse control over a wide range of velocities, and then rotate the knob more slowly to achieve fine-grained control over the coarse velocity. Utilizing the control scheme in accordance with embodiments of the present invention, in a compact and uninterrupted physical motion, a user can rapidly exercise both coarse and fine control over velocity of a model train.

It is important to note that velocity adjustment in accordance with the present invention is operable both to achieve both acceleration and deceleration of a moving train. Thus movement of the control wheel in an opposite direction can rapidly and effectively reduce the amount of power provided to the locomotive, causing it to stop, and even accelerate in the reverse direction if necessary.

While FIG. 4 depicts a velocity controller wherein the control knob is rotatable about an axis perpendicular to the plane of the controller, this is not required by the present invention. Alternately, a dial which is rotatable about and axis parallel to the plane of the remote controller can be used.

And while the specific embodiment described above causes greater power to be delivered by knob rotation beyond a threshold speed, this is not required by the present invention. In accordance with alternative embodiments, knob rotation below a recognized threshold speed may result in the application of greater or less power.

Moreover, while the specific embodiment of FIG. 4 utilizes the same knob to control both train direction and speed, this is also not required by the present invention. In accordance with alternative embodiments, separate knobs/buttons could be utilized to control train direction and train speed.

In addition, the increasing complexity of track layouts and equipment utilized by model railroading hobbyists may feature more than one locomotive running on the same track. In such settings, it may be desired to independently exercise control over the velocity of each train. Accordingly, more advanced model railroading systems may include wireless interface devices allowing selective communication with different engines running along the same track. It should be appreciated that control settings may be unique for each particular engine/locomotive.

While the specific embodiments described above relate to methods and apparatuses for controlling the velocity of model trains moving on a track, the present invention is not limited to this particular application. In accordance with alternative embodiments, the velocities of other types of model vehicles moving on a track could also be controlled, for example the speed of a slot car. The control mechanism in accordance with embodiments of the present invention is also not limited to controlling the velocities of tracked vehicles, but could also be utilized to exercise a remote control over model vehicles such as boats and aircraft.

Correlation of Velocity Control with Other System Outputs

In accordance with still other embodiments of the present invention, the manner of change in velocity control exercised over a model vehicle may be correlated with other system outputs such as audio, visual, and/or kinetic stimulus that mimic corresponding real-life conditions. For example, where a model locomotive set to travel at a high speed receives an instruction to rapidly reduce speed, the velocity change may be accompanied by the activation of an emergency light (visual stimulus), the screech of brakes (audio stimulus), and/or a shudder in the locomotive (kinetic stimulus). Conversely, where a model locomotive set to be at rest or travel at a low speed, receives an instruction to rapidly increase speed, the velocity change may be accompanied by the familiar chugging noise and the emission of large amounts of smoke. The correlation of velocity control with other system outputs is designed to create variation in operation in the areas of motion, light, sound, and smoke, thereby increasing the "play value" for the model train user/operator.

Such correlation of velocity control with other system outputs may be achieved in a variety of ways. One approach is through the use of a look up table.

FIG. 7 shows a simplified schematic view of an excerpt of a look up table in accordance with an embodiment of the present invention, for use with a model railroad control system. Look up table 700 is configured to receive a plurality of inputs 702*a-d*.

First input 702*a* is the set or current speed of the locomotive. The current speed of the locomotive can be determined based on any method, such as (1) by assuming that the previous velocity control commands communicated to the train are the actual velocity, or (2) receiving a sensor signal from the train or a trackside monitor indicating the actual velocity.

A second input 702*b* to look up table 700 is the direction of rotation of a velocity control knob. A third input 702*c* is the speed of rotation of a velocity control knob. A fourth input 702*d* is a distance of rotation of a velocity control knob. Optionally, other inputs can be used, such as a force sensing module input (direction and amount) and an elevation input (from a sensor in the train or preloaded layout information and current train location).

Based upon a combination of inputs 702*a-d*, a matrix of outputs 704*a-h* is referenced. First output 704*a* of look up table 700 is the amount of smoke output by the stack of the locomotive.

Second output 704*b* of look up table 700 is the volume of sound corresponding to a voice of the train engineer. Third output 704*c* is the duration of the sound of the engineer's voice.

Fourth output 704*d* of look up table 700 is the volume of sound corresponding to the chugging of an accelerating train. Fifth output 704*e* of look up table 700 is the frequency of the chugging sound.

Sixth output 704*f* of look up table 700 is the volume of sound corresponding to the screeching of brakes of a decelerating train. Seventh output 704*g* is the duration of the brake screeching sound.

Eighth output 704*h* of look up table 700 is an indication of the physical shuddering of the locomotive. Such a shuddering effect could be achieved by quickly alternating fast and slow speed commands.

One example of the use of look up table 700 in accordance with an embodiment of the present invention is as follows. Referencing row 700*a* of FIG. 7, suppose a model train has been set to travel rapidly, at a relative set speed of 4 out of a possible 5. Accordingly, first input 702*a* is 4.

The velocity control knob is then rotated in a counter-clockwise direction to indicate train deceleration. Accordingly, second input 702*b* is shown as negative (–). This counter-clockwise rotation of the velocity knob occurs rapidly, at a relative rate of 3 out of a possible 4. Accordingly, third input 702*c* is shown as 3.

Finally, the counter-clockwise rotation of the velocity knob covers a relatively large distance of 7 out of 10. Accordingly, fourth input 702*d* is shown as 7. Taken together, the specific inputs 702*a-d* indicate a sudden and prolonged braking of a rapidly moving locomotive.

In response to this combination of inputs 702*a-d*, row 700*a* of look up table 700 indicates a specific combination of outputs 704*a-h* as follows. First output 704*a* of look up table 700 indicates a 0 out of a possible 3, indicating no smoke, as a sudden braking event would not impose demands on the engine.

Second output 704*b* of look up table 700 is the volume of sound corresponding to the voice of the train engineer. Third output 704*c* is the duration of emission of the sound of the engineer's voice. The values of second and third outputs 704*b-c* of 3 and 3, respectively out of a possible total of 3, indicate a loud and prolonged yell as would be expected from an engineer forced to make an emergency stop.

Fourth output 7044 of look up table 700 is the volume of sound corresponding to the chugging of an accelerating train. Fifth output 704*e* is the frequency of this chugging sound. The values of fourth and fifth outputs 704*d-e* of 0 and 0, respectively, indicate an absence of the chugging noise, as is generally expected to be heard only as the train is accelerating.

Sixth output 704*f* of look up table 700 is the volume of sound corresponding to the screeching of brakes of a decelerating train. Seventh output 704*g* is the duration of the brake screeching sound. Again, the values of sixth and seventh outputs 704*f-g* of 3 and 3, respectively out of a possible total of 3, indicate the expected loud and prolonged screeching of brakes associated with a sudden braking maneuver.

Finally, eighth output 704*h* of look up table 700 is the amount of shuddering of the locomotive. A positive value of eighth output 704*h* indicates a shuddering of the locomotive as would be expected to be coincident with the sudden braking action.

Of course, other combinations of inputs to the look up table 700 could produce different outputs. For example, as indicated in row 700*b* of the look up table 700 of FIG. 7, slower movement of the velocity control knob, reflected in a lower value of third input 702*c*, would result in a reduction in the volume and duration of both the engineer's shout and of the screeching brakes. Similarly, as shown in row 700*c* of the look up table 700 of FIG. 7, a smaller range of movement of the velocity control knob, reflected in a lower value of fourth input 702*d*, would eliminate the shouting and brake screeching noise altogether, as would be consistent with a more controlled braking maneuver.

A look up table employed in accordance with an embodiment of the present invention may be located within a microprocessor device, and is well known in the art. Such a microprocessor could be in electronic communication with the controller or other elements of the system via wired or wireless communication.

FIG. 7 and the preceding text have described only one embodiment of a model vehicle control system in accordance with the present invention. Other embodiments would fall within the scope of the present invention.

Thus, while the particular embodiment of the look up table of FIG. 7 is configured to produce the specific outputs described above, the present invention is not limited to these outputs or inputs. An example of a look up table output from another possible system is the volume and duration of a sound of the screech of rubber tires on asphalt, as may be emitted during the control of a model automobile. Other examples of system outputs include, but are not limited to, duration and volume of a train whistle, state of an emergency light, etc.

And while the correlation of system inputs and outputs is described in connection with use of a look up table, this is also not required by the present invention. In accordance with alternative embodiments, the inputs could be applied to a predetermine algorithm, on one of a group of algorithms.

Still other alternative embodiments of model vehicle control systems in accordance with the present invention may employ a filter to dampen or eliminate large changes in velocity associated with the initial contact by the person operating the knob. For example, a user expecting to encounter resistance in turning the velocity knob may unintentionally initially apply excess rotational force. Such an initial contact by the use would generate an initial high velocity signal that was not intended. This can be corrected for in several ways.

One approach is to employ a filter (such as a dead band filter) to ignore or attenuate this initial contact, such that there is no corresponding velocity reaction or a minimal corresponding velocity reaction until user contact with the knob has attained stability. Such stability could be reflected by system recognition of only a rate of rotation within a specified range of values. In one embodiment of the present invention, a mechanical detent may be used to dampen the movement of the knob, thereby creating a filter. Mechanical steps could be configured to match the speed pulses generated to the system, wherein one "click" of the mechanical detent could correspond to one speed pulse.

An alternative approach to overcoming user contact issues is through the use of the look up table itself. For example, where inputs such as knob speed and rotation distance are both at large values, the look up table could be programmed to cause no change in output, regardless of the initial speed or direction of rotation inputs.

In accordance with still other embodiments of model vehicle control systems in accordance with the present invention, speed pulse combinations could be utilized to initiate sounds and/or motion commands. Thus by considering speed pulse signals occurring over time, additional information can be extracted from the input signal.

Consider, for example, the following sequence of speed pulse signals. An initial speed control setting of zero, followed by a rapid deceleration command, followed in turn by a pause, and then followed by any type of acceleration command. Such a sequence of command signals could first initiate a direction change prior to issuance of the forward command. The actual resulting velocity of the vehicle may thus be determined by looking at a group of signals received over time.

In accordance with still other embodiments, a speed of rotation of the velocity control knob may be translated into different states of operation. Such states may be viewed as a group to lock or unlock different features of play by the train, allowing the model train system to implement a "game mode."

For example, in a model railroad control system, a manner of rotation of the velocity knob could be used to determine the difficulty or level of play, or particular features to be allowed or disallowed. In one embodiment of the present invention, a user could move motor throttle 410 to the '0' position, where a model train could stop in response to such a command. Then, the user could quickly move motor throttle 410 past the '0' position, where motor throttle 410 has a 360° free moving capability. In response to the quick 'flick' of motor throttle 410, the model train could quickly change direction. Such a motion could be referred to as a "direction flick."

An alternative state of the system can be accessed by rotation of the control knob, and could introduce or control create a level of randomness that is based on operator input, changing the sequence of the game. In one embodiment of the present invention, the random rotations of motor throttle 410 could produce quick changes to the model train layout, testing the user's ability to adjust to such changes in the model train layout. For example, if the user produced the "direction flick" as explained in the example above, the model train system could throw train switches, etc. which challenge the user to respond to the system in "game mode." Thus, the model train system of the present invention has the ability to not only trigger sound/smoke/light effects, but also influence other actions in the model train layout, such as throwing train switches.

Finally, while the particular embodiment of the look up table of FIG. 7 has relied upon inputs based upon movement of a velocity control knob, the present invention is not limited to systems and methods employing this manner of velocity control. For example, inputs from alternative types of velocity control devices could also be employed to produce other system outputs, such as the frequency or duration of depression of velocity control buttons.

In addition, it should be noted that the concepts provided above can be applied to input devices other than a velocity knob. For example, a single switch can be made to output manydifferent types of commands based on the rate in which the button is depressed. When used in combination with other similar function switches, additional outputs may be created, with the basic concept of creating variations based on user input.

Additional Interfaces of the Controller

The controller unit of the present invention utilizes new and innovative user interfaces to more accurately recreate the experience of operating an actual locomotive. Furthermore, the controller unit of the present invention utilizes novel ways of addressing, such as the Trainlink™ car location addressing system, described in copending application Ser. No. 11/187,592, filed concurrently herewith, entitled "System for Sending Commands to Train Cars Based on Location in Train", the disclosure of which is hereby incorporated herein by reference.

In one embodiment, the train number can be determined by pointing the remote control unit at the train engine, and receiving an infrared or other wireless signal from the train engine. This is described in more detail in copending application Ser. No. 10/723,430, filed Nov. 25, 2003, entitled "Direct Wireless Polling of Model Trains," the disclosure of which is hereby incorporated herein by reference. In addition to the train number, its name, speed, direction, and road number may be obtained in this manner.

In one embodiment, the remote control unit has a display screen that shows speed graphs, velocity levels, train brake air pressure, etc. for more realism and better control. In addition, to aid in viewing the controller under all lighting conditions, a variable automatic backlight may be found on the controller based on ambient light surrounding the controller unit.

The controller of the present invention has a window for viewing addresses and other information related to a train operating experience. Full screen speed graph 438 is shown in FIG. 4. Black line 442 represents the target speed. This is also referred to as the target speed line. Gray bar 440 representing the command speed (also known as commanded speed) approaches the target speed line at a rate determined by the train's momentum. When command speed gray bar 440 reaches target speed line 442, the target speed has been attained. A user can view whether a model train has achieved its target speed, or what the command speed is compared to the target speed. In addition, the user can view other information on the controller such as the locomotive's location, condition routing information, goods on board the train, etc.

Controllers may also be located along a model rail track (i.e., trackside controller), where these controllers employ force feedback capability, levers, and other unique user interfaces such as, but not limited to, spring return pressure sensitive rocker switches, rotary throttles, etc. Different hardware configurations for trackside controllers exist. One configuration might have a velocity throttle, while another may have a sliding motorized fader. Touch sensitive buttons as well as other types of buttons can be used alongside more mechanical levers, rockers, and rotary throttles. These devices could all be modular. As interfaces that fit into a trackside controller base, they would comprise a trackside controller that is configurable by the user. In another embodiment of the present invention, a few dedicated models, each one employing a unique combination of levers and throttles, etc. can be implemented. These distinct models would accept the memory cartridges and assign the correct handles or throttles, etc. to correct functions, with an appropriate readout in the control panel window for the accessory being controlled. The distinct models could also pass information about the devices they are controlling to other control devices.

In alternative embodiments of the present invention, the functions on a remote control unit could be split up. The hand-held remote control unit could be used to control the train, for example, while a trackside controller could be used to control accessories. Furthermore, two remote control units could be used, with different controls, or identical remotes with different controls enabled. Two people could then control a train, with one being the engineer, and the other being the conductor/brakeman, controlling switches, devices at a station, etc. Other examples are, but not limited to, a walkie talkie feature, where users can talk to each other with a microphone over the Internet or around a local layout, remote to remote and remote to Central Control Module transfer of a road name database, allowing users to name engines, customizing road names/road numbers that are stored in the train or remote, and including a plug for connecting serial devices. In other embodiments of the present invention, other examples of interacting with the remote control unit include using single or multiple memory module slots for expansion (i.e., a first remote will not have IR but an IR add-on in the form factor of a memory module can be plugged into the remote's memory module slot, so that the software can be updated, and necessary IRDA [InfraRed Data Association] hardware can be added to a non-IRDA remote), interfacing a remote control unit with a computer to control the computer (i.e., a train simulator can be made that uses a handheld remote to control), lighting up buttons to identify/clarify selections, and using a display to simulate engine cab, generating instrument panels that reflect train operation parameters such as water temperature or oil pressure. These instrument panels may be generated by the engine or the accessory itself, then transmitted to the remote for display.

A speaker may be placed in the remote. Special audio files may be played through the remote that are specific to the engineer/user. For example, while the user is operating the train and the train approaches railyard, the speaker located on the remote could generate a voice command coming from a railyard operator, the railyard operator giving instructions for entering the railyard, such as "proceed at caution speed" or "hold position until further notice." It should be appreciated that the remote speaker could be used for other purposes where the individual operator receives voice commands.

In addition to controlling the layout, the remote may be used to configure the model train layout. Menus may exist that allow for users to, edit names and road numbers. According to one embodiment of the present invention, it may be possible to plug external keyboards, mice, and/or joysticks into the remote to expand human interface. The remote may also allow users to retrieve and adjust parameters found inside of the locomotive or Central Control Module. It should be appreciated that the remote may allow users to retrieve and adjust parameters found inside layout objects connected to a communication network. In addition, a computer application can simulate a remote control unit. This provides the advantage of using a personal computer to control and configure the model train layout and layout objects.

The remote may also have a rotational input device used to traverse menus and control the speed of the train. This input device may also have a depression switch so that it can also be used as a button to select options when operating the remote and train. In one embodiment of the present invention, it is also possible to use the button (i.e., depression switch) as a select between two or more types of operation. An example of this type of operation would be to allow turning the rotational device while the button is depressed. In accordance with an embodiment of the present invention, the user can set the stall speed or maximum speed. If the button is not depressed while turning the knob, the user may control the speed. If the button is depressed while turning the knob, a bar on a display graph may move to set the stall speed. If the button is released and then pushed/held, it could adjust the maximum speed of the train. The rotary knob button could also be used for more complex combinations of long and short clicks for feature activation similar to that of telegraph key operation.

In another embodiment of the present invention, the remote may also detect items specific to a particular area of the model, train layout. For example, the title of a particular area of the model train layout may first be displayed on the remote. Weather for the particular area of the model train layout and local time may then be displayed for that area. Parts of the layout may detect that the remote is nearby, wherein accessories create effects accordingly, such as the particular area lighting up as the ieniote approaches the area. Detection of location can be done by an IR link between a layout sensor and remote, or other means such as a direct connection, RF identification tags, proximity RF, physical memory module insertion, or other methods of location based connectivity. It should be appreciated that other tasks/effects could be performed by the remote control unit.

Adapter for Other Control Systems

In one embodiment, an adapter may be used to convert commands from the protocol for one manufacturer to those used by another manufacturer. This would allow a customer to purchase locomotives or accessories from different manufacturers, yet control them with a common remote, or allow a user to switch manufacturers and still be able to control old equipment. The adapter could be a separate plug-in module to the remote control or control module, or could be a card, or could be integrated into the remote control or control module. The adapter could, for example, convert from spread spectrum RF to a serial stream, and could convert commands from a first command language to a format for a second command language. Alternately, multiple protocols could be simultaneously generated without the need to convert one to the other. This could also be done in reverse, translating information sent back to the remote or control module from the train or accessories. The translation could be triggered for a list of IDs entered by the user which correspond to the other manufacturer's equipment. Alternately, the commands could be routed through an adapter connected to the remote or controller of the other manufacturer, using the other manufacturer's remote or controller as a slave, and directing the issuance of desired commands from a master controller. In still another embodiment of the present invention, another adapter could be built to allow competitive remote control units (i.e., remote control units from other vendors) to communicate directly with the Central Control Module, allowing the remote control unit to operate seamlessly. In addition, the Central Control Module could create track signals that are compatible with other competitive systems (i.e., model train systems from other vendors) allowing operation of their trains. This allows for operation of competitive remote control units with the Central Control Module eliminating the need for two bases (i.e., one for each system).

Pressure Sensitive Sound Control/Sound Effects

Conventional model train control systems utilize a brake button to slow down the engine. In some cases, the engine will return to the original speed as soon as the button is released. There is a predetermined rate of braking applied, and the train follows a set behavior while the button is pressed. A prerecorded set of brake records plays while the button is pressed until the train stops or the button is released.

When the engine brake throttle of the present invention is applied, the engine slows down, and the engine's sound system may play a screeching brake sound and engine drift sounds. The rate of braking and intensity of the dynamic brake screech sound effects are relative to the amount of pressure/intensity applied to the engine brake throttle. The engine brake throttle may be located on a model train remote control unit. At the same time, train brake equipped cars being pulled by the braking engine could disable the brakes while not making a screeching brake sound. In this manner, the illusion of an engine brake is created. In one embodiment of the present invention, the engine brake throttle stays in effect until changed by the operator. Model train effects also remain in effect until the position of the engine brake throttle is changed. Thus, even if an alternate brake button located on the remote control unit is pressed and then released, the engine brake throttle of the remote control unit continues to apply a braking action to the model train. Furthermore, the display screen of the remote control unit may be configured to indicate the braking action by changing graphics of the display.

Conventional model trains have sound systems with warning sounds that are triggered by pressing a button and holding it down for the duration that the warning sound is desired. When the button is released, the warning sound ends. To achieve more realism through expression and to create a feeling of being in touch with the warning sound being produced, the warning sounds of the present invention are driven by a pressure sensitive button on a user controller. An example of this is shown with pressure sensitive button 416 on controller 400 in FIG. 4. By pressing pressure sensitive button 416 with more force, the sound effect produced is a louder and more aggressive warning sound. By pressing pressure sensitive button 416 more softly, the sound effect produced is a lighter and less threatening warning sound. The intensity of the sound effects produced is relative to the amount of pressure applied to the pressure sensitive button. The sound duration lasts as long as button 416 receives any pressure at all. Using these inputs, pressure sensitive button 416 can be used as a warning sound button to "play" the horn, similar to a real train engineer. By pressing button 416 harder and softer in a creative way, a distinctive personal signature can be created. Thus, model train users/engineers are freed from repetitive, unrealistic prerecorded warning sound effects and have the interactive opportunity to "play" or "quill" a signature warning sound of their own in real time. More details on such pressure sensitive buttons are set forth in co-pending application Ser. No. 10/986,459, filed Nov. 10, 2004, entitled "Touch-Sensitive Model Train Controls." It should be appreciated that the above description could be used to control other functions such as speed, throttle amount, brake amount, smoke intensity, or other variable functions of the model train layout objects.

Pressure inputs could also be used by the remote control unit internally. For example, a menu system could be used in the remote control unit where buttons used to navigate through the menu are pressure sensitive. A greater amount of pressure placed on the buttons of the remote control unit would generate faster movement through the menu compared to a lighter amount of pressure placed on the buttons.

In accordance with an embodiment of the present invention, audio may be broadcast to the model train over the rails. Audio could be sent in a similar manner as that of FM radio over the rails, rather than audio being sent via commands to the engine. This transmitting method is different from a method that sends data and commands to the model train in that a separate communication medium is used to broadcast audio, thereby avoiding using up bandwidth and interfering with the operation of the model train layout. In alternative embodiments of the present invention, additional circuitry in the model train receives the audio signal and plays the data out through train speakers.

Motion, Visual and Sound Effects Used in Combination

Previous inventions use the concept of maintaining a constant speed and use the amount of correction required to maintain that constant speed as the main factor in determining the intensity/amount of visual effects such as smoke, steam, or "firebox flicker" (a light inside of the firebox to simulate hot coals). This does not accurately replicate realistic train operation. For example, if a prototypical (real-life) locomotive is going down a hill, it first gains speed. The speed does not remain constant. The engineer first applies brakes to the train, keeping out the slack between the cars. A power increase may also be required to keep the cars taut while going down a hill. In conventional model train systems, if a power increase were required to control the tautness of the train, the engine's sound, lighting and smoke effects would also increase simulating the real process. Some conventional locomotives will determine the effects by only the speed and proportionally adjust to the amount of smoke and sound generated. This also does not accurately represent realistic train operation, where in a prototypical engine operation, the throttle setting which determines the engine RPM in a diesel engine does not directly control the speed the train. The determining factor for train speed is amount weight the train is trying to move.

In accordance with an embodiment of the present invention, realistic train operation is simulated by adjusting visual effects of motion, smoke, sound and lights based on the changes in locomotives speed combined with the changes from the input device level commanded by the user along with the dynamic speed compensator. In one embodiment of the present invention, the locomotive changes/varies in speed by itself without any change in the motor throttle. These changes are used to create a more realistic simulation of prototypical operation. Using the example of an engine going down a hill, the locomotive will first gain speed going down a hill and then automatically adjust back to the original speed. This in turn causes the smoke, sound and lighting effects to be adjusted to the appropriate levels being simulated.

It should be noted that other visual effects may exist such as motorized engine cooling fans, moving parts, other lights, etc. that affected by changes being simulating in prototypical operation.

Voice Activated Dispatcher System

Figure 8:
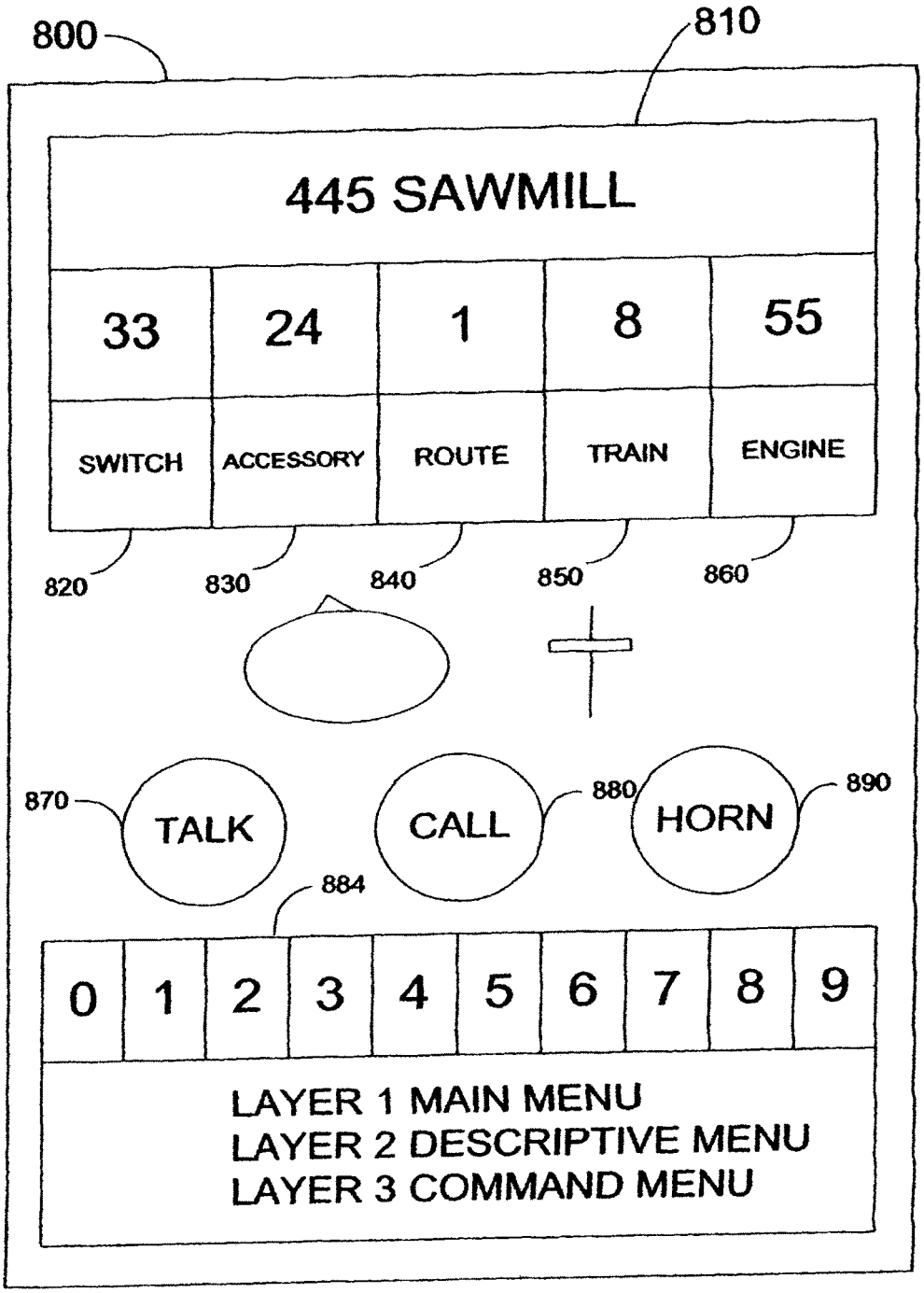
FIG. 8 illustrates a simplified embodiment of a controller menu in accordance with the present invention having multiple menu layers and model train commands.

FIG. 8 illustrates a controller menu for a voice activated control system in accordance with the present invention. The system of FIG. 8 is compatible with the train set shown in perspective view in FIG. 1.

Controller 800 may act as the master controller for a model train system. Controller 800 may be located in a user handheld remote control unit or a trackside controller. Within controller 800, hardware circuitry and/or software is implemented to take in voice commands from a user. The remote control unit is linked to train system components through a communication link, which may be implemented with wires or be a wireless system. Examples of commands to be sent to train system components are switching train tracks, opening/closing couplers that connect cars together, producing a bell or whistle sound, turning on/off lights, etc.

The voice commands give a realistic feel to controlling the train layout, so the user acts as an important part of the model train communication system. The user's voice activates interaction with an imaginary "dispatcher" which replies to the user acknowledging certain commands. The dispatcher can repeat the command to an engineer in the train, a station master, etc. Furthermore, the train system itself can relay information to the user, acting as a two-way communication system.

A hierarchical command statement tree is used to access specific commands within the model train system. The levels within the hierarchy can alternate between buttons or other physical inputs and voice commands. A user can "move" through the hierarchy of the command structure, accessing different menu layers. A word could have a different purpose depending on the layer accessed on the menu. A representative command tree is shown in FIG. 9. The following explains an example of the present invention, and in no way limits the embodiments of the present invention.

The statement tree consists of multiple layers. Any number of layers can exist within the statement tree. For example, on Layer 1, where the main menu is located, the base commands access the major components on a model train system layout (i.e., engine, train, route, switch, accessory, lashup, etc.). In one embodiment, layer 1 is implemented as the different buttons 820-860. The user can assign names or numeric descriptions to any number of model train components. Within controller 800 are indicators identifying the main components of a model train system. For example, display 810 shows a possible name (i.e., "445 SAWMILL") for an accessory located on the model train layout. Furthermore, display/button 820 indicates that switch 33 is being accessed, display/button 830 indicates that accessory 24 is being accessed, display/button 840 indicates that route 1 is currently in use, display/button 850 indicates that train 8 is being accessed, and display/button 860 indicates that engine 55 is being accessed. The example above is purely illustrative, and in no way limits the embodiments of the present invention. Layer 2 contains the descriptive menu including default names for engines, trains, accessories, routes, switches, etc. It can be appreciated that custom names can replace the default descriptions for the model train components. Layer 3 contains the command menu, where commands to open/close couplers, activate bells/whistles, etc. are located. Each layer can use buttons or voice commands, with many different possible combinations. A single layer could have both button and voice options.

Also located within controller 800 are buttons 884 representing digits 0-9 used to select numeric choices within menu layers. Horn sounds may be initiated by pressing pressure sensitive button 890. To initiate a voice command, a user may first press TALK button 870. To return to the main menu at any time, the user may press CALL button 880. Once a user is in a submenu, the user will stay there, unless the call button on the remote control unit is pressed to get back to the main menu.

In an embodiment of the present invention, interaction with model train buildings, and other accessories is performed. Examples of other accessories include, but are not limited to, train stations, switches, light posts/traffic signals, etc. A single voice command can initiate a sequence of events to interact with such accessories. For example, if a user presses TALK button 870 and says "twilight," the lights on buildings may turn on, sounds of people returning to their homes may play, etc. Thus, voice commands may activate macros or sequences of the model train system. It should be appreciated that macros or sequences are defined as a series of commands that may or may not have a time component associated with them.

Additional embodiments of the present invention include attaching a voice recognition adapter to existing model train remote control units to allow for older remotes to be "updated" so that the user need not purchase a new controller. The adapter can connect to the processor or other circuitry in the old remote control unit. Responsive to voice/button commands, it would provide electrical signals mimicking the button presses of the old remote control unit. In addition, a user may log onto a website through the Internet to download additional commands, route names, and/or request custom names within the model train system. Updates for the remote may be in the form of a memory module. The update would include voice recognition information for the name of a specific engine so that the user may address the engine directly by saying "Pennsylvania 2345, Union Pacific 2400, etc." This information could also be retrieved from via a computer connected to various sources (i.e., the Internet, CD, or other storage media). Such capability provides an easy way to upgrade controllers and add new commands/components within the train system.

A simple set of commands could be provided with a remote control unit, with more complex commands being programmable or downloadable from an Internet site. User specific independent voice recognition could be used, with different users having their own customized command sets on the same remote control unit. User nonspecific independent voice recognition could also be used allowing all users to pull from the full set of commands. It should be appreciated that commands may be accessed via both voice dependent and voice independent applications.

The present invention can be embodied in other specific ways without departing from the essential characteristics of the invention. For example, the layers specified could be placed in a different order, while maintaining the essential characteristics of the present invention.

The voice activated dispatcher system of the present invention takes on addressing in a whole new way. The following is another example of an embodiment of the present invention. By calling the "dispatcher" and calling the engine or train name, the user is in control of a particular unit. Any user can issue a voice command. The dispatcher recognizes the voices of a plurality of users. The dispatcher system of present invention involves pressing and holding the call button while the user says "dispatcher" into the microphone. After the dispatcher acknowledges a request, the call button can be released. When the dispatcher answers through the speaker in the controller, the interaction may be thought of like a "walkie talkie-like" communication that is taking place. The user now has access to a plurality of Level 1 commands in the hierarchy. The user may press TALK button 970 and proceed with an operation, i.e. TRAIN. The dispatcher may confirm the request with a "copy that" or some similar term. This informs the user that he/she now has access to Level 2 hierarchy commands. The user may subsequently address a particular engine, train accessory, etc. According to one embodiment of the present invention, the method of addressing by saying the numerical address (i.e., two, zero, would be equivalent to 20) is still available. At Level 2 in the hierarchy, the user may also address a particular train by simply stating the train name (i.e., Union Pacific 2400). The Voice Activated Dispatcher System of the present invention makes the association between "Union Pacific 2400" and the actual numerical address of the train (i.e., ENG 5). In return, the dispatcher says "copy that" or some other confirmation phrase. The Voice Activated Dispatcher System of the present invention then advances the user to Level 3 of the hierarchy of commands. Then, the dispatcher may talk to the particular train from the train's onboard sound system and the user can hear the engineer of that particular train answer to the dispatcher. The user could call a "caution speed" command or any other available command, and subsequently, that command is implemented. In one embodiment of the present invention, a menu of fifteen commands is available to the user, where standard buttons and the throttle is available in controlling the model train at the same time. The system has the ability to have additional/custom commands added at a later time via updates.

The dispatcher may be a program module storing a series of commands for generating synthesized voice output and other control signals. The dispatcher module would be activated by pressing the TALK button. The program could be stored in the remote control unit; while the voice signal could come out of a Central Control Module on the train layout, or any other combination of locations.

The commands may exist in a three level hierarchy. For example, on

Level 1

The user may first call the address type or category (engine, train, accessory, switch, route, etc.)

Then on Level 2

The user may call the name (i.e., Santa Fe, New York Central, Union Pacific, etc.)

On Level 3

The user may call the command (i.e., shut down, start up, caution speed, etc.)

In a voice activated system, reducing noise is very important. If the signal-to-noise ratio (SNR) is low, it may be hard for the system to understand the voice command over the surrounding noise, and the voice command might be lost or misinterpreted. In one embodiment of the present invention, the "dispatcher" is looking for one to fifteen words/phrases in a category and will take a best guess under some marginal circumstances. It may be appreciated that more that fifteen words/phrases could exist in the voice activated system without departing from the essential characteristics of the present invention. By using dedicated CALL and TALK buttons, the problem of noise may be reduced. Either the CALL button 880 or TALK button 870 must be pressed in order to issue a voice command for the dispatcher system to "listen" on the cue. This method avoids having the system always "listening" and trying to pick a voice command out of a marginal situation. The dispatcher enclosure is designed for close talking, like a walkie talkie. When the user speaks closer to the microphone, the accuracy of the voice commands increases. With these designs in place, a dispatcher system may be 95% accurate. In one embodiment of the present invention, the volume of a user's voice could be used to determine the intensity of an effect. For example, a soft 'brake' voice command could correspond to the train slowing down gradually, while a loud shout of 'BRAKE' could cause the engine to screech to a halt.

Another benefit of the dispatcher CALL button 880 is it always returns the user to Level 1 without any errors. The user can simply press CALL button 880 and say any sentence with "dispatcher" in it and the dispatcher system will recognize the call to Level 1. The benefit of TALK button 870 is that excess noise is removed until the TALK button is pressed and held, in order to make a request/command. The system may be limited to recognizing specific names or command levels. This eliminates any unwanted level one communication. In one embodiment of the present invention, the dispatcher system may confirm orders from the user through the speaker. Custom names and command sets for different accessories/engine trains etc. can be downloaded into the dispatcher remote from the Internet. Standard names for locomotives can be downloaded through the Internet. In one embodiment of the present invention, there may be approximately 15 names in any category, and as many as 12 categories on any level. It should be appreciated that many more names and categories could exist, without departing from the essential characteristics of the present invention.

Model Train Talking Station

Figure 10:
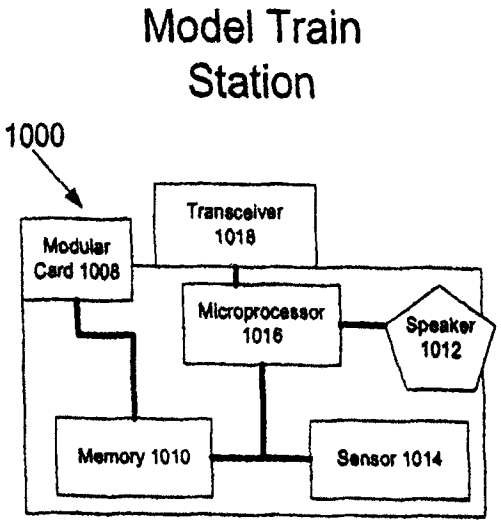
FIG. 10 illustrates a simplified embodiment of a model train station in accordance with the present invention.

FIG. 10 illustrates an example of a model train talking station in accordance with the present invention. The system of FIG. 10 is compatible with the train set shown in perspective view in FIG. 1.

Model train station 1000 is located within a model train system. Transceiver 1018 is configured to receive commands from a remote control unit. Memory 1010 may be located in model train station 1000. This memory stores information containing announcements which are directed to specific model trains. Microprocessor 1016 processes information from memory 1010 and sensor 1014, as well as sending signals to speaker 1012. Speaker 1012 plays the announcements stored in memory 1010. An example of an announcement is a voice announcing that a certain train is approaching the station, i.e., "Pennsylvania 12 is approaching the station." Within model train station 1000, hardware circuitry and/or software may be implemented to process the announcements from memory to the speaker. Modular card 1008 is configured to store new announcements. These new announcements could be downloaded from a website through the Internet. Furthermore, sensor 1014 provides model train station 1000 with the ability to recognize that a train is approaching the train station. An example of sensor 1014 is described in detail in copending application Ser. No. 10/837,440, filed Apr. 30, 2004, entitled "Model Vehicle Detection of ID and Direction," the disclosure of which is hereby incorporated herein by reference. As the train approaches the train station, speaker 1012 plays realistic train station sounds. Examples of realistic train station sounds are crowd noises, bell/whistle sounds, etc.

The model train station has the ability to automatically trigger a certain sequence of announcements and other actions. Each train may contain a unique address which distinguishes it from other trains. As a train approaches the train station, sensor 1014 determines that a particular locomotive and/or railcar are arriving at the station. Then, a series of commands/announcements that may be specific to a certain train are accessed in memory 1010. For example, a model train station conductor could yell "all aboard" and the sounds of baggage doors opening, the noise of people walking around the station could be played on speaker 1012. Alternately, transceiver 1018 can receive commands for a particular announcement, sequence of sounds, light activation, etc. from the remote control unit. The receiver can either directly receive a wireless command, or can be wired to the track to receive a command sent over the track.

Along with specific announcements to certain trains, the model train station contains generic announcements that may pertain to a broad range of model train layout objects. Examples of model train layout objects are rail cars, construction vehicles, matchbox cars, remote control cars, etc. Examples of generic announcements are sounds of a train crew talking, the sounds of a train leaving, etc.

The announcements and other actions for the train station could be updated using a modular memory card 1008. Modular card 1008 may comprise of standard memory modules such as Flash memory, Compact Flash, SmartMedia, etc.

Modular card 1008 has the ability to interact with a computer to receive new announcements via downloading information from a website through the Internet. In an alternate embodiment of the present invention, new modular cards already storing new announcements for new components, such as new train models, new layout objects, etc., may be purchased by the user and inserted into model train station 1000. Updates could be implemented from a PC connection through a model train Central Control Module.

Additional embodiments of the present invention include attaching a voice recognition adapter to the model train station to allow for the user to record personalized messages to be played by the model train station. In addition, a user may log onto a website through the Internet to download additional commands, route names, and/or request custom names within the model train system. Such capability provides an easy way to upgrade sounds and add new commands/components within the train system.

The present invention can be embodied in other specific ways without departing from the essential characteristics of the invention. For example, the model train station may receive new announcements through a wireless communication link, while maintaining the essential characteristics of the present invention. Furthermore, one or more model train stations could be used on one model train layout. The two model train stations could be connected via a wired or wireless method and would share information between the two stations and set up scenarios accordingly. For example, Station 1 could announce "Pennsylvania Express 2314 departing from Station 1 at 5 pm. Estimated arrival time at Station 2 at 7 pm." In addition, the two model train stations could use master timestamp information provided by a Central Control Module (CCM) to estimate whether the train departed from Station 1 on schedule and whether the train will be arriving to Station 2 on time or will be delayed. The master timestamp may be used to "sync" actions occurring within the model train system. The timestamp could also keep track of an imaginary "time of day" situation, where effects are based on the time of day. It should be appreciated that similar applications exist involving the use of the timestamp synchronizing model train layout items together, without using the model train station. In another embodiment of the present invention, applications may exist involving cars corresponding to specific model train layout locations having a logical sequence associated with them. An example involves, but is not limited to, a coal train that dumps its coal at a power house. A set of motions and sounds could complement the coal train dumping the coal, in a similar manner to the effects used with the model train station.

Datarail Reporter

Sensors for detecting a train car are described in copending application Ser. No. 10/837,440, filed Apr. 30, 2004, entitled "Model Vehicle Detection of ID and Direction." In accordance with an embodiment of the present invention, in order to achieve the goal of creating a lifelike layout, a feedback system may be implemented. A "datarail reporter" is used to identify the location of vehicles on the model train layout. As used herein, "datarail" refers to the system of a sensor for detecting at least the location of a train, and a communication link for providing the information to a plurality of other devices on the layout. In conventional model train systems, accessories such as a model train station were configured to read a "bar code" attached to the bottom of engines, wherein the model train station announced arrival of engines. Conventional systems do not centrally collect or utilize the location information. According to one embodiment of the present invention, the model train layout objects, as well as the Central Control Module, know what is happening on the model train layout. In another embodiment of the present invention, datarail reporters merely identify that a vehicle has passed. A simple statement could be transmitted over the network that states that a particular vehicle identification number has passed a certain location where the datarail reporter is located. Once this location information is known, it can be utilized by other model train layout objects, such as a railroad crossing that lowers its gates as a locomotive passes (an effect that takes place on real railroads), a locomotive that blows a warning signal while it passes the railroad crossing (a required practice on real railroads), or vehicles moving down the road, wherein the vehicles stop and wait for the locomotive to pass when a railroad crossing gate is lowered. The engine's control mechanism may receive information transmitted from a datarail reporter and may use this information as an input to the Dynamic Engine Loading Calculator. To further expand the capabilities of the system, more sophisticated datarail reporters have been developed. Datarail reporters may also determine the ground speed and direction of a vehicle, count the number of cars while keeping track of the arrangement of cars in the train as each car passes the datarail reporter, weigh each locomotive/car/vehicle, retrieve information from a locomotive or cars, trigger other motion, sound, smoke, and lighting events creating the synchronization points for proper playback of recorded sequences, and write information to onboard memory in the locomotive or cars. Datarail reporters can be connected to the network by any number of mediums available, such as hardwired or wireless mediums. Datarail reporters are not limited to interaction with locomotives, wherein datarail reporters may be in the form of a model road for road vehicles, or in the form of sensing mats. Location of datarail reporters can initially be determined by driving a vehicle in a loop at a close to constant speed, wherein it is possible to estimate the distance between and arrangement of the datarail reporters. In another embodiment of the present invention, a vehicle must pass every datarail reporter. Given the relation between the current datarail reporter and the previous datarail reporter in conjunction with a track switching or deviations from the track course made by the vehicle, a datarail reporter's location can be determined. From this information, a map may be generated on the remote control unit, stored in the Central Control Module, displayed on a computer screen, and/or shared on a website.

Many different types of datarail reporters may exist. In one embodiment of the present invention, a number of electrical breaks may be found on the surface of the datarail reporter, thereby creating switches. As the train wheels pass the datarail reporter, the train wheels sequentially trigger the switches. From this information, the speed of the vehicle can be determined. As the movement continues, it is possible to count the number of cars that follow the initial vehicle. Datarail reporters may comprise an extra rail contact, wherein a car can pass the extra electrical rail contact and the datarail reporter sends encoded data to/from the datarail reporter. In another embodiment of the present invention, datarail reporters may comprise IR sensors. Information such as model train identification numbers and contents of onboard memory may be retrieved by the datarail reporter as the train passes the datarail reporter. In an alternative embodiment of the present invention, low cost RFID stickers are placed on each model train car, wherein the RFID stickers may be non-writeable or writeable and interact with integrated circuits, and connected to external memory/microprocessor(s). A datarail reporter may comprise a transponder that powers and retrieves information from RF tags located on the train as the train pass the datarail reporter. It should be appreciated that contacts on the track between the datarail reporter and train may not be necessary when a communication link is established, wherein the train may transmit its speed directly. Other examples for retrieving information from a train are, but not limited to, receiving ultrasonic tones from the train, scanning "barcodes" from the train, receiving optical data from the train, and receiving a proximity RF signal from the train. In another embodiment of the present invention, a special camera could be mounted over the model train layout so that the camera can track activities and perform tasks of the datarail reporters and sensor mats.

A unique feature of the datarail reporter is that the system knows which train car is closest, because each datarail reporter has a sensor and direct transceiver. When a car is in place on a datarail reporter section, the car can be addressed in relation to the datarail reporter section can be addressed automatically and operated seamlessly from the datarail reporter. In this way, no additional addressing is required to operate many direct remote control cars as each car passes over the datarail reporter. It is also possible to use the datarail reporter as an extension of addressing the train relative to the location of the datarail reporter. The datarail reporter can be used to generate a 'train passing' effect, when a train approaches an observing area and the volume/tone of the sound effects can be adjusted to simulate a passing train effect.

Another way to update the actual speed of a model train is by using datarail reporters located within a model train layout. Datarail reporters at specific locations on the track layout can register when a train passes a section of the train track, and relay this information to a Central Control Module, calculating how long it takes for a train to cross certain tracks. Different speeds such as stall, red flag (emergency stop), caution speed, and high speed exist. Each engine arrives from the factory with these values stored as defaults. These values can be reset by the user and stored as parameters for any given engine or train. When the voice activated dispatcher system of the present invention is used, a user may say the words "caution speed" to slow the addressed engine to that speed. A user giving other preset speeds, such as calling "high speed", "red flag", or "stall" will get the directed result from the train. Datarail reporters can be used to create areas of different speeds. For example, a railyard may be enclosed by two datarail reporters, and as the locomotive enters the railyard, the locomotive may slow down to caution speed, and resume back to cruising speed as the locomotive leaves the railyard. Virtual goods could be moved using datarail reporters. Locally, users can move virtual goods from one datarail reporter to another datarail reporter. It should be appreciated that datarail reporters could be located in model train accessories such as a lumber yard or cattle yard. In one embodiment of the present invention, datarail reporters are used to create a virtual portal linked to other layouts. As virtually "filled" cars pass, they could be digitally emptied. The datarail reporter may announce that the goods have arrived by flashing lights, printing information on a screen, or announcing that type, amount, and location of the goods. A user could then retrieve these imported goods from the datarail reporter.

Two Digit Addressing

Another novel addressing feature is user selectable one or two digit addresses. Conventional model train systems use single digit addresses for trains. With single digit addresses, the highest address has the value of 9. By allowing for a single digit (for example, 9') to represent a call for two digit addresses, the user can expand the total amount of addresses in the system. For example, addresses 1 through 8 could represent single digit addresses, while the user may select address 9 to represent addresses 90 through 99, adding new double digit addresses that all begin with 9. In one embodiment of the present invention, the processor is programmed to send the address immediately when it is 1-8, but to require a second digit when it is 9. Short addressing may be used to call engines or other model train accessories. For example, an engine could have an address from 0 to 99, limiting the address to two digits. In another embodiment of the present invention, model train components may have a larger maximum number of digits in the address (i.e., four digit addresses). The addresses may be painted on the side of the model train components, and a remote control unit has the ability to learn, have programmed into memory, and/or retrieved from a Central Control Module the road number and address association. For example, when a user accesses component #2463, the remote control unit can recognize that address #2463 corresponds to locomotive address ID #10. Furthermore, an automatic road number retrieval is possible, where in ID from a plug and play, Trainlink™, datarail reporter, or other network medium aids in restoring the previous referenced number.

In one embodiment of the present invention, it is possible to use a database to set up the addressing scheme. A network could also be used in the addressing scheme. For example, a user could access component #2463 and physically switch the component into a program mode, and then broadcast an address command through the network. In one embodiment of the present invention, only the component in the program mode will set its address to the corresponding number for 2463, address ID #10. In another embodiment of the present invention, the user can use either a long address (i.e., #2463) or a short address (i.e., address ID #10) to address a model train component. Thus, long and short addresses can be made "transparent." For example, a statement such as "Engine 2463 is equal to address ID #10" would correspond to engine 2463 receiving the statement and setting the internal roadnumber/name to address ID #10. An acknowledgment signal, such as a horn sound, could be generated by the locomotive.

In one embodiment of the present invention, pressing ROUTE display/button 840 with a subsequent pressing of a number 1 through 9 will select that particular route immediately. A modification is to program the process to not immediately select the route when "1" is pressed. Rather, the processors waits for a second digit to be input. A user could select a first digit to initiate a two digit address mode, wherein all route addresses that begin with '1' will refer to double-digit addresses, thereby adding 9 new addresses to the roster. These addresses can be used in a yard where there may be 9 tracks. The user may then select a second digit to refer to a specific model train component (i.e., routes 10 through 19). With the two digit address method of the present invention, more model train components may be addressed. In alternative embodiments of the present invention, for route, train, or any other number addressing, any number could be designated at the number indicating a multiple digit address. In one embodiment, that number indicates two or more digits will be entered, allowing a larger number of 1-99 address. Thus, for example, selecting 1, followed by 4 and then 5 would select route 45. Furthermore, the first digit after 1 could indicate one of 10 yards (0-9), and the following digit could select the track in that yard.

In an alternative embodiment of the present invention, the two digit addressing scheme of the present invention could be applied to a Trainlink™ addressing scheme. The user could press the train button, then 1 and 3 on the keypad, thereby addressing locomotive 13. A second set of digits 0 and 3 could address train car number 3 located as the third car away from locomotive 13. In still another embodiment of the present invention, car positions could be directly displayed on a display screen of a remote control unit. The graphics used to represent the car help to further identify the car. The road number of the car could be displayed by using Trainlink™ for that train to locate all the cars and their position.

Controlling Multiple Train Traffic/Traffic Control System

Figure 11:
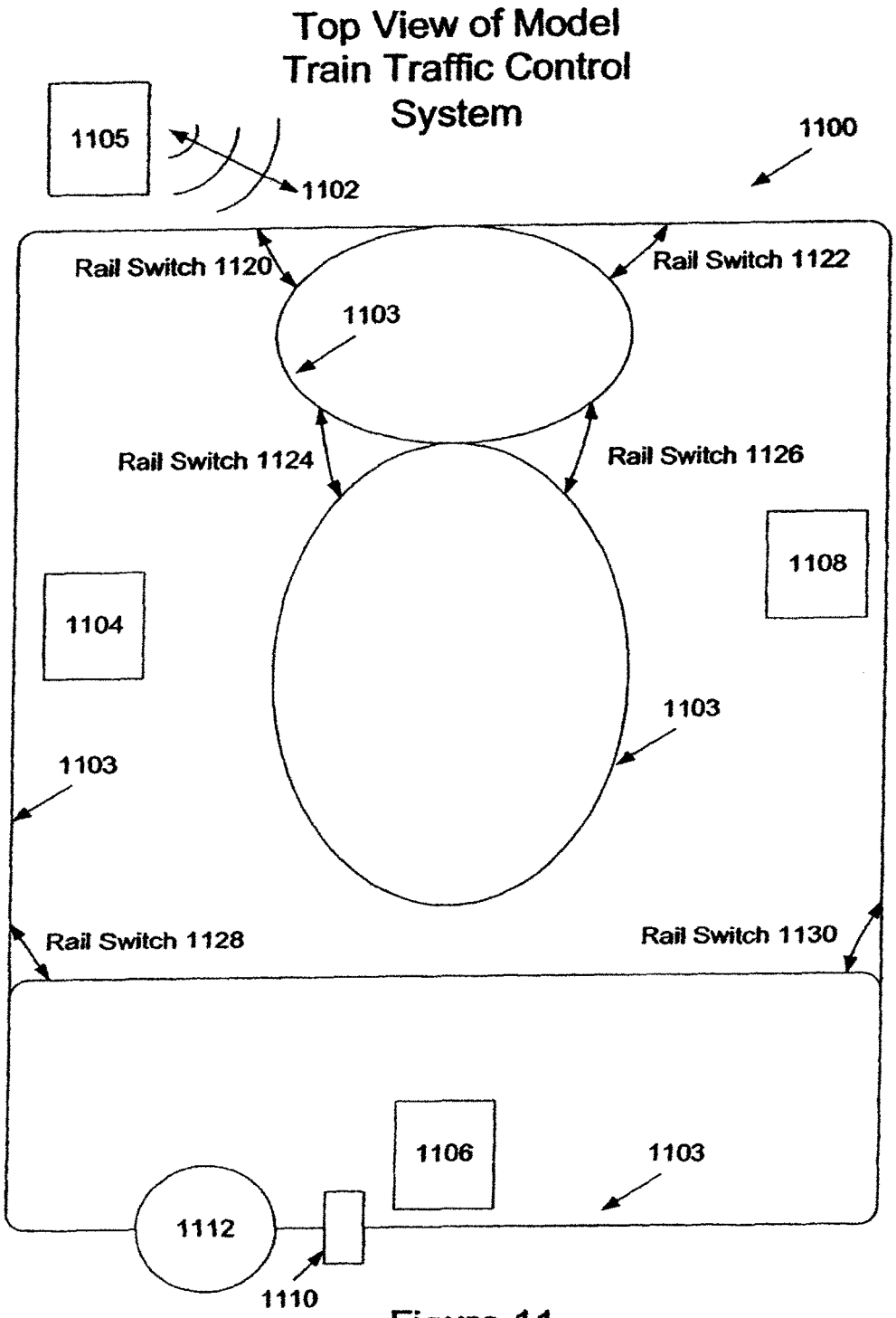
FIG. 11 illustrates a simplified embodiment of a model train traffic control system in accordance with the present invention.

FIG. 11 illustrates a computer display of a model train layout. Alternately, the display could be on a remote control unit or a stationary 'map' device.

Today's real trains operate on a schedule. They have to be on time and there are many trains using the same track. A computerized traffic control system is in use on many of today's model railroads. Knowing where all the trains are, the direction they are going, and how fast they are traveling, is paramount to the success of the model train system.

To achieve more realism on large layouts and provide complex routing and automatic multiple train operations, traffic control system 1100 of the present invention employs datarail reporters 1104, 1106, and 1108 (these would likely be omitted from the display in one embodiment) located along track 1103 and a computerized traffic control base 1105 that keeps track of the information gathered and issues instructions to the trains and engines involved. Alternately, the traffic control can be done in the remote control unit or other device with the display. The datarail reporters further comprise a sensor and transceiver. It should be appreciated that any number of datarail reporters may be used in traffic control system 1100.

In one embodiment of the present invention, datarail reporter 1104 reports to traffic control base 1105 whenever a train or engine passes that datarail reporter. All the real time information about that train (such as present location, speed, etc.), is computed by the train system and the appropriate orders for collision avoidance, routing, delivery, as well as operating and routing instructions are issued to all trains. Any train receiving a command will begin to attain the appropriate preset speed (e.g. caution speed) to avoid collision. With a larger model train layout, more reporters may be placed around the layout, allowing for more traffic that can be handled.

Another embodiment of the present invention involves trains transmitting directly to traffic control base 1105. When a train passes a datarail reporter, the train picks up that reporter's location and transmits that information, along with all real time information about that train, directly back to traffic control base 1105. This may be done through a wired or wireless communication link 1102. That information is computed by the system and the appropriate orders for collision avoidance are issued to all trains.

Furthermore, a new layout, with datarail reporters placed around the track so that rail blocks (such as rail block 1110) have datarail reporters with turnouts (such as turnout 1112), establishing block limits and other factors suggesting block limits, when traversed by a locomotive with a transceiver, will illustrate itself correctly on a computer screen like the railroad maps used in real life control rooms. Rail blocks may be defined as a section of track in which a train can operate without causing conflict with another train. The layout map illustrated on the computer screen can be used as a basis for monitoring controls of a model tram layout. In another embodiment of the present invention, the position of a train can be determined by using an engine encoder to count the rotations of the motor, sending the rotation information to a Central Control Module, and having the Central Control Module reference the rotation information with respect to a datarail reporter location to find the engine location.

Figure 12A:
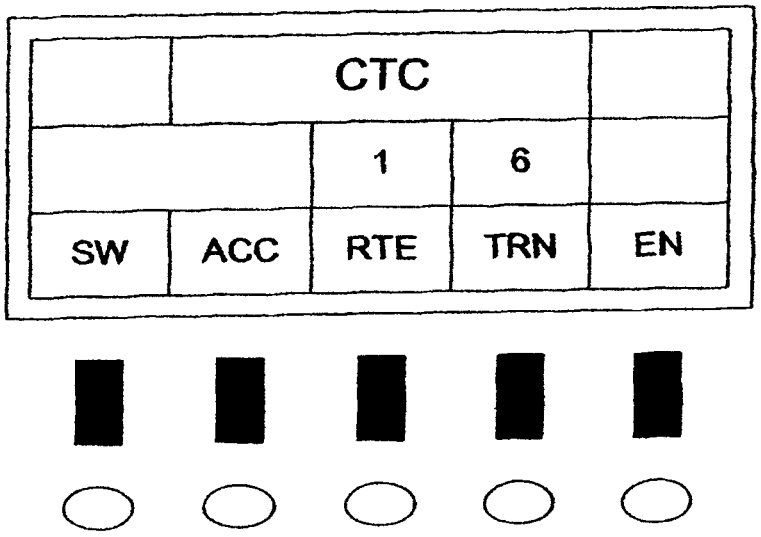
FIG. 12A illustrates a simplified embodiment of a controller menu displaying a particular route and train in accordance with the present invention.
Figure 12B:
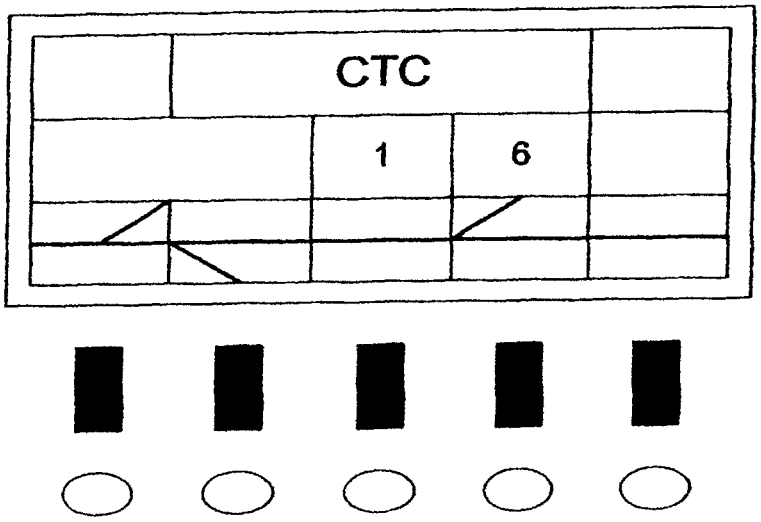
FIG. 12B illustrates a simplified embodiment of a controller menu displaying upcoming switches on a particular route in accordance with the present invention.

In addition, the map can be assigned to a train so that only that train is viewed with the track moving under it, previewing switches (such as rail switches 1120-1130), junctions, and traffic for the operator. This could be viewed in the window of a computer or a stationary or remote control unit. FIGS. 12A and 12B illustrate such a display on a remote control, such as the display 438 of FIG. 4. As can be seen, route 1 and train 6 are displayed in FIG. 12A. In FIG. 12B, the upcoming switches train 6 will encounter on route 1 are shown. Many uses for the system can be envisioned, including collision avoidance, roadside traffic control, train games, train playmate (drone trains), realistic and accurate signal systems, and layout action sequencer (i.e., moving a train to a location and interacting with an accessory automatically), tracking goods/cargos moving around the layout, challenging the locomotive operator by creating and tracking schedules for train operation, using accessories to request that a train/cargo be shipped (i.e., a coal factory may request coal from the operator), using operating cars to interact with accessories automatically when needed (i.e., coal hoppers may drop coal automatically after request is made and cargo arrives), and using trains to request that accessories stay on depending on resources (i.e., train 5 makes a request for water, the engine runs erratically or not at all if the train does not reach the water tower after a given amount of time. Once the train reaches the water station, it will create a link and generate water filling sounds. Once the water is filled, the train will return to normal operation), etc. In one embodiment of the present invention, train games could involve monitoring the amount of time taken, the amount of distance traveled, the amount of goods moved, key strokes, motions used, etc. to rate the skill of the model train operator/user. This would allow model train operators to compete between each other based on the operation of the model train.

The system utilizes communication to control engines and trains and all previous components with an expanded command set that offers almost 260,000 commands compared to the original 60,000. A protocol for such an expanded command set is set forth in copending application Ser. No. 10/705,216, filed Nov. 7, 2003, entitled "Expanding Instruction Set Using Alternate Error Byte." Using such a command set, the engine/train location and data, switch position, and control data, and accessory action and control data could be controlled and monitored with a direct wired or wireless two-way system.

Preset speeds may be demonstrated with the traffic control system of the present invention. When a train is about to enter a rail block that is next to an occupied rail block, an automatic "caution speed" command is issued to that train, causing it to slow down. If the next rail block is red or occupied, then a stall command is automatically issued. Another use for the preset speeds is demonstrated in smart accessory packages of the present invention. These modular sets include an accessory, such as a train station, that requires that the train runs through a sequence of factory or user programmed events as it enters the area of the station. In a typical accessory package, five datarail reporter track blocks would be included representing:

1. Far inbound
2. Close inbound
3. Main location
4. Close outbound
5. Far outbound At each one of these locations, the train might be automatically commanded to slow down to "caution speed," or come to a stop stall, leave the accessory location, proceed with the caution speed, and then resume to a "high speed." In addition, the model train talking station and other accessories are able to download specific information relevant to the train by either a direct communication link or by inserting a memory module cartridge that comes with each engine or train from the factory or downloading information for earlier trains on a website. Since the train station now knows the announcement that goes with a specific passenger train, and the train's location, whenever the train is near the station, approaching, departing, or resting at the station, the appropriate station announcement can call the specific train by name and number. For example, automatic accessories such as a fuel station could be triggered/controlled by a datarail reporter. In another embodiment of the present invention, one model train could be operated by a user, while other model trains are driven by the model train system. A model train layout could be split into specific sections, for example 4 quadrants, with multiple model trains operating within the 4 quadrants and their locations updated by datarail reporters, and as a user drives a particular model train into a particular quadrant (quadrant 1, for example), the model train system could automatically drive other model trains into other sections of the model train layout. In this way, the model trains could operate without the likelihood of any accidents or crashes occurring. In addition, the model trains being driven by the model train system could be configured to communicate with one another thereby adding an automated traffic control feature of the present invention.

It should be appreciated that the above mentioned presets can also be accessed and controlled by the user from the remote controller. This allows for quick access to functions that are predetermined in the system. Therefore, the system allows for both user controlled and automatic operations to take place. The accessories may or may not contain a datarail reporter. The accessories of the present invention have the capability to send and receive information to/from a Central Control Module regarding their status, mode, and capability. This information transfer can take place through the use of a direct signal.

Accessory Control

Two methods are used to control and monitor accessories. The 455 kHz magnetic field in proximity to the rails is used to control older accessories and individual vehicles on a trackside road or working with a trackside accessory. The direct communication signal (i.e., 455 kHz and/or 2.4 GHz wireless signal) of the present invention is utilized to control and monitor operating cars and accessories and monitor the locations of individual vehicles and operating cars that work with accessories. One example is a two-way communication system as described in copending application "Model Train Wireless Bi-directional Communication Protocol," Ser. No. 10/723,260, filed Nov. 25, 2003 and incorporated herein by reference. Location and identification numbers of operating cars is supplied by datarail reporters, while a trackside grid supplies location and data of the trackside vehicles. All of the monitored location and data associated with the rail cars, trackside vehicles and accessories may be sent to a Central Control Module for management.

Although an accessory can be controlled by a remote control unit, sometimes a dedicated controller that is located on the layout near the accessory is desirable to eliminate addressing steps and make it possible for those not familiar with a remote control system to operate trackside accessories in a traditional manner, with a dedicated stationary controller that has a user interface appropriate for the machine being modeled. These stationary controllers are dedicated to particular accessories. A modular connection scheme may be implemented by power modules, controller modules, feedback modules (i.e., LCD for operating information), status modules (i.e., LCD for status of accessory), track sections, and track modules, wherein the modules (as well as track sections) may physically connect thereby forming electrical connections. Such an implementation could be referred to as 'Quick Connect'. In one embodiment of the present invention, the modular connection scheme may be applied to stationary control devices. The face of the control may be changed to control different accessories and control systems allowing the user to customize the layout. A microprocessor can be used in new and existing accessories to add realism and control.

It should also be appreciated that these stationary modules could have the capability to not only operate accessories but also any item located in the model train layout environment including locomotives, operating cars, etc. In addition, the user can define and operate an accessory using short cut sequences. These sequences can either be defined by the user, exchanged, traded with other users, or acquired from the factory. Furthermore, these sequences may be transferred from a network interface, memory module, or other memory device. According to one embodiment of the present invention, the short cut sequences contain time and command information that allow the device to be operated in sequence as desired by the user. These command sequences can contain operational information for more than one device allowing them to work together seamlessly. The command sequence can be a series of sounds or announcements that are spaced by a time interval. The sequence can be triggered directly by the user with the remote control, or could be triggered by the detected approach of a train or the remote control. A sound or sequence could also be triggered by the remote control going farther away or turning off, such as a "goodbye" sound or message. Such sequences could also be triggered by the timestamp information, other aspects of the environment, or by the relative location of other moveable elements.

Central Control Module

In conventional model train control systems, a base and remote control unit were used. The base in these systems was used as a simple repeater. Commands sent from the remote control unit were gathered into a central point and then sent out to the locomotives and various components of the model train layout. According to an embodiment of the present invention, the Central Control Module (CCM) collects information from various aspects of the model train layout system. Rather than acting as a conventional central gathering base/module on the model train layout, the CCM acts as an information database that monitors various components on the model train control network (i.e., remotes, computer interfaces, datarail reporters, and other control network nodes) and updates them with the latest information, allowing these components to operate with the newest updates. A master database is created from the information recorded on these components. This master database also contains information about how the user operates the model train layout. The master database can log and analyze a user's train driving performance. From this information, the Central Control Module can develop scenarios for the user to operate, such as games involving schedules for moving stock, decisions on the movement of locomotives, decisions on which blocks or tracks should be occupied, decisions on which direction locomotives should be moving, bypassing occupied blocks, and many other decisions of the model train layout A Central Control Module of the present invention may be connected to a computer configured to access to the Internet or any other network to upgrade sounds, download control panels, update software, receive system upgrades, download controls specific to certain new devices, engines, and accessories, etc. The Central Control Module of the present invention processes and manages communication with direct wire equipped units, datarail reporters, datarail reporter sections, and datarail operating cars to aid in traffic control and other functions. In one embodiment of the present invention, when multiple layout components are used, a car does not move until operations have been completed by the other layout components, thereby allowing commands and simulations to complete for each layout component. The Central Control Module communicates with controllers and trains. The Central Control Module is not a base in colloquial terms, but rather another node on the wireless control network that allows remote control units to access the latest information for user interface and control of the model train layout. In one embodiment of the present invention, the Central Control Module may transmit and receive a 455 kHz signal. The Central Control Module can also communicate to trackside vehicles and accessories through various communication methods such as direct wired, wireless, and infrared. The Central Control Module may act as a method for accessing memory modules via a computer, base, or module. A video/audio output could be implemented to allow the use of a video module. In one embodiment of the present invention, the Central Control Module could be connected to a computer, directly to the Internet with its own TCIP stack, etc., or any other network, and be controlled from a remote location using video, audio, or any other command stream. In one embodiment of the present invention, the Central Control Module allows the user to set up and internally host a web server that allows users to log onto the Central Control Module via an Internet/computer/IAN connection and access a variety of information and control features. For example, the user can view and modify the list of engines and schedules for rolling stock, throw various switches on the layout, control engines and trains, view images/video/sound from the different available positions on the layout, and remotely run the layout. Pictures could be captured from train operation or cameras positioned throughout the layout. In another embodiment of the present invention, scaleable timestamp and other environment specific information could be transmitted over the network, so that users could choose to perform actions accordingly. For example, in simulating a nighttime scenario, lights could come on for accessories and trains. In simulating a "it's raining outside" scenario, a command could be set to activate windshield wipers. Weather effect generators, such as xeon flash lighting makers and rain sound players could be implemented in the model train system. LEDs may be used to change colors of the model train layout, allowing for rapid scene tone adjustment. Digital pictures of these different scenarios may be taken at different times by the Central Control Module, and be made available on a website. In addition, software could be used to allow control/configuration of the model train layout through the Central Control Module. A real-time map may be shown similar to that of a real dispatch.

In accordance with an embodiment of the present invention, a model train gathers a plethora of information while it is operated. This information is then relayed to the Central Control Module and remote control unit. The information may be picked up from datarail reporters, transferred via a memory module, communicated directly from train to remote (point and play method), and send via other communication mediums available on the model train layout. The Central Control Module incorporates the information into a master database regarding the model train layout. Information about train speed, average speed, miles traveled, etc. may be recorded in the Central Control Module and in the remote control unit. The information about the train can later be displayed for the user via a LCD display. The information can also be accessed in the Central Control Module via a computer of through a internal website of the Central Control Module.

In accordance with an embodiment of the present invention, while the model train is in operation, information regarding the model train is collected. This information may be stored in the remote control unit and Central Control Module for reference and diagnostics. The information may be retrieved via remote infrared transmission directly to the train, datarail reporters, memory modules, etc. Information that would be used for diagnostic purposes may comprise, but are not limited to, communication signal levels, percentage of good/bad messages due to poor communication, communication quality in certain areas of the layout, status of lights, whether the motor is running, target speed level, current speed level, whether sounds are on, sound volumes, and firmware versions. Users can self diagnose problems that arise on a model train layout.

In an alternative embodiment of the present invention, web users (i.e., HTTP users) may have different levels of access, as a viewer, user, or superuser. Users can create schedules, while superusers can import and export cars/engines to/from the model train layout. In addition, HTTP users may share virtual goods. The Central Control Module may operate a local train for a remote user. Virtual goods may also come in and leave from a track section devoted to import/export virtual goods. Two or more remote users may link trains and trade goods. Records of shipments could be kept and viewed via a web application on the Central Control Module. Users can be rated on a website for moving virtual goods, wherein the website may keep track of virtual profit, layout statistics, and overall monetary value of the user's "model train economy." Each digital load of virtual goods may have a unique identification number that may be issued by a central site. In one embodiment of the present invention, a "gate" comprising a datarail reporter may be located inside a boatyard, tunnel, railyard, etc. and the "gate" is configured to receive and send shipments to a model train. A user may receive a trade request with another user and an agreement to open borders (i.e., gates) would be made. Users can then trade goods between model train layouts. An exporting function could comprise a request for trade by email to another user. Once a trade agreement is established, the user could create a shipment schedule of deliver/receive goods on request. Once a schedule shipment is made, users can pickup/generate goods locally and export them by driving empty box cars to the location of the track associated with the virtual goods (such as in IR link with a datarail reporter, a sawmill, etc.). Once each boxcar is stopped in front of a mill for the 'nth' time, the boxcar would be noted as carrying wood. The user could then drive these cars through the import/export "gate" to trade goods. Goods could be electronically transferred to another user who requested them. Pricing of the goods may be kept track by the Central Control Module. In one embodiment of the present invention, users may have to stop the car at the "gate" for a short duration in order to transfer virtual goods.

Removable Model Train Memory Modules

The present invention provides a removable model train memory module, which may be attached to a remote control system for controlling one or more electrical devices of a model train system. Included within the remote control system is a transmitter, by which one or more electrical devices are controlled using control signals transmitted via a communication link within a model train system. The invention further provides a receiver for a remote control system in which control signals are transmitted to at least one receiver via a communication link within a model train system. The ability to upgrade model train systems allows users to keep up-to-date with the latest technology and add new trains, model train layout objects, etc. Further, the expense involved in keeping a model train system up-to-date has been relatively high. These costs have been particularly discouraging to certain beginning hobbyists who do not want to make a large commitment of money to a state of the art system, but do not want a model train system that they will have to replace altogether. Hobbyists who only want to upgrade certain aspects of their model train systems rather than the whole system have also been discouraged by these costs. Memory modules provide a medium for updating previously released products, wherein added functions of new features may be released.

FIG. 10 shows removable memory 1008 that can be inserted into an accessory, in this case a model train station. Similar memories, or the same memory, could be inserted into the remote controller of FIG. 4, or a Central Control Module. The electronic memory could be flash memory, in the form of a BIOS chip, CompactFlash, SmartMedia, a memory stick, PCMCIA Type I and Type II memory cards or any other memory device.

Information can be downloaded or uploaded to removable memory module, which may also be referred to as two-way information transfer. This ability of two-way information transfer provides several advantages. For example, the memory module acts as a portable storage element, where system upgrades could be stored on this module, and the upgrade could be transferred to any number of remote units or other model train layout components. Examples of such layout components are: engines, trains, routes, switches, accessories, etc. Factory upgrades could be sold in the memory module, and a user could easily maintain an up-to-date model train system. It should be appreciated that system upgrades could be protected by encryption or other security methods to prevent unwanted transfer of information.

Furthermore, the memory module has the ability to interact with a computer to receive new upgrades from downloading from a website through the Internet or any other network. In an alternate embodiment of the present invention, new modular cards already storing new announcements, new voice recognition files, and other information for new components, such as new train models, new layout objects, etc., may be purchased by the user and inserted into the remote control unit. When interacting with multiple model train layouts, the user could transfer his specific operator settings to another model train layout. Furthermore, the user could transfer his specific operator settings to other model train operators/remote control units. In addition, removable memory modules may be used as a peripheral expansion adding IRDA, spread-spectrum communication (i.e., using a communication port for adding devices), transfer of new sounds, transfer of operator history, and firmware upgrades.

In addition to allowing the user to download different sounds/upgrades into the train, the memory modules of the present invention could also alter the train "personality." The personality of a train is the collection of characteristics of operation and sound that dictate how the train operates. These include, but are not limited to, motion, lights, sounds, and smoke. Based on the scenario and world the user is trying to create with the model train layout, the memory module could be used to change the train accordingly. For example, a model train that has moved over 1000 cars of goods may start to develop engine trouble and accelerate slower, have a slower top speed, creakier brakes, etc. Through the use of the Central Control Module and datarail reporters, the engine could be taken to be serviced and the sounds could show the results as well as the "personality" of the train.

Furthermore, the memory modules of the present invention can be plugged into a computer and programmed to set up the train. In one embodiment of the present invention, a computer program may be used to schedule the movement of goods on the model train layout. The user plugs in the memory card from a new or existing train on the layout into the computer. The program adds the train to a yard with operations that the train will perform, set the address of the train, links the train with others if necessary, and then saves the information into the memory module. The user then plugs the memory module back into the train and the train is set up to operate on the layout and is synchronized to the schedule. It should be noted that a scheduling program is not necessary, merely a simple program could be used to set the train addresses. The user could also use the Central Control Module rather than a computer. The memory module could be plugged into the Central Control Module an accessed via the remote control unit. The address and other settings of the train could be entered and saved. The memory module could then set these settings when inserted into the train. This would keep the user from needing to remove the train from the track and flip the run/program switch to program.

Additional embodiments of the present invention include a user entering configurations into a remote control, and using the memory module to transfer such a configuration to another remote control. A user could also use this method to transfer configurations for accessory controllers, track power controllers, etc. Such capability provides an easy way to upgrade sounds and add new commands/components within the train system. Another example is a user storing voice commands in one remote control unit, and using a memory module to transfer such voice commands to other remote units, bypassing the need to connect all remotes to a website to download upgrades/information. Other examples include, but are not limited to, using a memory module to save a particular user's setting when a direct remote to remote connection is not available at the time, where the saved settings can be taken and used on another user's model train layout, using modules to hold multiple settings selectable by the user for different scenarios, and using a remote control unit to store a backup of a setting when it is changed to allow the user to revert to the last setting when a mistake is made. In addition, the memory module could be used to retrieve collector specific information such as production date, origin, hours ran, service notes, serial/model number, distance traveled, etc.

Trackside controllers of the present invention may use removable memory modules by "learning" the control panels of each accessory from a memory cartridge that comes with the accessory or vehicle from the factory. The memory cartridge is inserted into the trackside controller and the trackside controller learns the control functions of the accessory or trackside vehicle. Thus, different control panels can be loaded into any trackside controller. Dedicated control has the advantage of no addressing required. A dedicated trackside controller, controlling a trackside accessory that utilizes a datarail reporter section to identify and control operating cars and the accessory together is a good example of one of the goals of the present invention, where no addressing is required using the trackside controller. In one embodiment of the present invention, configuration of trackside controllers may be done by plugging in related memory modules.

Memory modules may be used to retrieve stored information from objects such as locomotives. A memory module could be plugged into the locomotive, and information of a user's interest could be retrieved. Information such as the production date, location, model number, and serial number could be of interest to collectors. In addition, operational information such as maximum speeds and running hours could be of interest. The memory module could be plugged into a device with a display, such as a remote or computer, for viewing such information.

Memory modules could also stored and used to repeat a series of commands generated by the user and/or generated by model train layout objects. For example, a user may operate a model train layout with a blank memory module installed in the Central Control Module. The user could choose to store commands issued to the layout into the memory module. Once operations are completed, the user may select the commands to be re-interjected into the layout based on a variety of triggers. When the commands re-enter the layout communication network, layout objects could perform the same actions. This would allow users to create many different pre-recorded scenarios and store them on memory modules for later replay. A computer application may be available that allows users to create scenes in a graphical user interface-like manner. These scenes would then be stored on modules in the Central Control Module.

In accordance with an embodiment of the present invention, memory modules can also be used as an addressing scheme. Different color memory modules could be associated with different users on the model train layout. Plugging the memory module into a device could automatically issue control over that device. For example, user 1 may place a blue memory module into a locomotive and user 2 may place a red memory module into a trackside vehicle. Then, without any addressing, the "blue" remote held by user 1 may automatically be set to control the locomotive, where the "red" remote may be automatically set to control the trackside vehicle.

In one embodiment of the present invention, statistics may be stored on the memory module in a file specific to a user, containing statistics such as "user traveled 14.5 scale miles in 20 scale minutes, at peak speed of 66 scale mph" or "user has spent a total of 500 scale hours behind control of locomotive #2—Amtrak #254 with no accidents or violations." It should be appreciated any number of statistics could be stored in the memory module. Furthermore, the statistics could also reside on internal memory located in a remote control, locomotive, and/or Central Control Module, etc.

A memory module could be used to store desired songs or other sounds, with the songs and sounds being upgradeable by downloading new ones to the memory module. The memory module could be plugged into a remote or controller and used to stream sounds to a train or accessory. Alternately, instead of a memory module, a re-transmitter module could be used to receive wireless sounds from a computer or stereo, such as through a Bluetooth interface, and stream them over an existing interface to the train or accessories. For example, a radio station could be retransmitted to a train station's speakers in this manner. Alternately, a hard wired connection could be used, such as simply connecting a speaker wire from a stereo system to a controller which then streams the sounds to a train or accessory.

Virtual Playmate

In one embodiment of the present invention, a model train is used as a virtual playmate. Because the location and movements of all trains can be tracked and controlled, they can be controlled as part of a game. For example, the game may have a goal of the user moving train A with its cargo to a particular location. The game programming could cause other trains to get in the way, forcing the user to figure out how to get around them, and how to get to certain points before another train can block him. Sounds and other effects could be triggered as appropriate, such as a taunting horn sound by an interfering train.

In one embodiment, the game combines both real world and simulated world (computer or video) events, synchronizing them. For example, a video display is provided, and actions could be required in the video simulation in order to complete tasks or quests in the real world layout, or vice-versa. An example is a video showing robbers trying to capture the engineer in the simulation to stop the train in the real world layout. The user could be playing against someone locally or remotely, or against the computer, trying to both avoid capture of the engineer in the simulation and rush the train in the real world layout to the destination.

Running Trains from Remote Locations

Model train operators have a desire to share layouts and experiences with other model train users/operators. This creates the need for model train layout operations to be conducted in a number of locations. Traditionally, model train layouts have been operated in the same room. A number of operators/users may control a different aspect of the model train layout in the same room. According to an embodiment of the present invention, the Central Control Module gathers information and creates a database about how the trains are being operated in the model train environment. Details about the track and switch arrangements could be used to control the movement of trains. Details about the cars and engines may include real/virtual goods being carried, current location, etc. and are entered into the Central Control Module's data base. In addition, video and sound information may be gathered by the Central Control Module, giving a real time scenario of the operation and action taking place. Thus, the Central Control Module may monitor and control aspects of the model train layout. Once the information in the database is compiled, it can be sent to any location through an external connection available with the Central Control Module. The Central Control Module could be located in any number of locations. The operator can process the information being relayed to the Central Control Module, where decisions about train operation can take place. An interaction between the actual model train layout and the model train operator is created, giving the sense that the user and Central Control Module are at the same physical place.

In one embodiment of remote operation in accordance with the present invention, the concept of a remote dispatcher that controls the routing and movement of the trains across the entire model train layout is used. A remote user/operator could use a display interface that displays a layout schematic of the model train track plan. This schematic may contain a complete muting list, switch locations, track locations/lengths, and virtual goods located in each car/siding. Switching or movement lists are used to initiate movements of the cars so that a sense of order can be applied to the process of moving cars throughout the layout. These lists contain information about the car, the starting and ending locations, and the goods being moved from one place to the next place. A remote dispatcher could issue commands to the remote user(s)/operator(s) on the model train layout directing their movements in an orderly manner.

In another embodiment of remote operation in accordance with the present invention, the remote user/operator may control the train movements from a remote location. Information about the possible routes, the track conditions, and locations of other trains could be sent to the remote operator (i.e., at a remote location). This could be accomplished through the use of a control interface that has the same functionality as a remote controller used at a physical layout. This allows the operators involved to have the same experience without being in the same physical location.

The above descriptions are examples and should not limit the scope of the possibilities of the present invention. The concept being expressed comprises people who share a common interest in model trains having the ability to interact with one another without physically being at the same model train layout location. This comes from the Central Control Module's ability to create and maintain a complete database, controlling model train operation. In accordance with an embodiment of the present invention, users running trains only on a computer simulated layout could also create, operate, and trade goods with users that have actual model train layouts.

Material Movement

The movement of goods throughout a model train layout can provide a mission or purpose for which the train is moved about. Each car may have a matching accessory destination. Cars and accessories may have the ability to be operated either manually or via remote control. Cars that make it obvious as to the destination would eliminate the need for printed switch lists. For example, a tank car carrying petroleum would have an obvious destination of a tank plant. A second example could be a log car that would deliver logs to a saw mill. The goods moved by a train may be real as mentioned above or virtual. The content of a box car could contain automobile parts, but in reality the box car is empty. An illusion that transporting goods is required provides one purpose in running the model train layout.

Data Security

The use of data in model trains has become important as connections are increased. The Central Control Module of the present invention has data communications to the remote controller, trains, layout devices, computers, and the Internet. The data between these devices needs protection from unwanted, unauthorized, and unlicensed access. Previous systems use encryption to protect the data being transferred. Encryption provides a method for converting a giving set of data, performing a function, and then representing the set of data during the transfer phase from one system to another system that is seemingly unrecognizable and undecodeable data. Once data is secure inside the receiving system, the data is decoded back into the original data format. Encryption can be used throughout a system whenever security and privacy of the information is of the greatest importance. Encryption is based on limited knowledge and access to the encoding and decoding algorithms. These algorithms are not disclosed and typically remain trade secrets. The disadvantage of encryption is that once the encoding and decoding methods are known, the data is no longer protected.

In accordance with an embodiment of the present invention, a method of data security is provided that adds a series of additional data bytes that represent the method of encoding and decoding data. The encoder uses several unique encoding methods to transform the data being transferred into unique signatures. The method of encoding is embedded in the signatures, and then transferred between systems. Once transferred, the receiving system uses the encoding method transferred to decode the remaining data which is used to issue commands and requests for various operations to the model train layout. In this method, the same data set may be represented in thousands of different ways. Furthermore, additional bits are added to the data used to represent the signature, creating millions of possible configurations, but only one result which is correct using any given encoder and decoder algorithm. The data security that adds a series of additional data bytes of the present invention utilizes novel ways of encoding and decoding data, described in copending application Ser. No. 11/188,117, filed concurrently herewith, entitled "Model Train Command Protocol Using Front and Back Error Bytes", the disclosure of which is hereby incorporated herein by reference.

Use of Redundancy in Data Transfer

Model train layouts may comprise a very high electrical noise environment. This environment makes the transfer of commands between devices very difficult. This problem is combated by the use of redundant transmissions. According to an embodiment of the present invention, two different types of redundant transmission techniques are used. The first technique involves repeating the same sequences more than once. These command sequences contain data validation bits which may be used to determine/correct any errors in transmission. These repeated commands are then interpreted by a receiver as repetitive and are therefore removed. In one embodiment of the present invention, velocity commands are transmitted in an absolute format rather than a relative format. The absolute commands can then be repeated with redundant commands being removed. If the receiving device requires relative velocity information, it can be derived by calculating the difference between two successive absolute velocity command sequences.

The second technique of redundant transmission involves using multiple transmission bits to represent a single data bit. A single data bit may be represented by two or more combinations. These combinations are fed into a receiver which then uses a soft decision decoder to make a decision as to the value of the transmitted data bits. In addition, these high level recovered data bits can be interpreted to contain error detection and correction information. In accordance with an embodiment of the present invention, this second technique is used in wireless aspects of transferring data between system modules, due to the difficulty in transmitting this information between these types of devices.

According to an embodiment of the present invention, both techniques of redundant transmission are transparent to the user/operator. The techniques of redundant transmission are desired when a receiver acknowledgement is not used to verify that the information has been received.

Transfer Acknowledgement and Data Verification During Communications Between Systems The transfer of data between various parts of the model train system may be bi-directional. In other words, data can be transferred to and from any two system components. In accordance with an embodiment of the present invention, after an initial data transmission is made (which may comprise sending model train commands) to a receiving device, the receiving device receives the data, constructs a responding message (to verify that commands were properly sent) to be sent by a transmitter, wherein the responding message is a unique response based on the data received. It should be appreciated that the transmitter may be configured to send the responding message via a "newer medium" of 2.4 GHz and/or 900 MHz. Thus, more than a mere simple acknowledgement signal is used to transfer data from one location to another location. The unique response is then transmitted back to the originator (which may be a remote control unit or a Central Control Module) for verification and acceptance by the originator. If the originator does not receive the response, or fails to accept the response (i.e., if multiple command sequences are simultaneously sent), the data that was transferred is considered to be invalid and is discarded. The transfer is then reinitiated to ensure system integrity.

During this response period by the receiver, it could be desirable to construct and transmit a separate data sequence from the receiver to the originator. This process saves the overhead required to transfer information about the system. The receiver is now considered the originator for the second message being transferred, and the acceptance process is repeated.

Central Control Module Communications and Connections

Many types of connections can be made to the Central Control Module. Such connections include, but are not limited to, RS232 serial, Universal Serial Bus (USB), Ethernet, Frequency Modulated (FM), audio, and video connections. These connections provide a method for transferring data throughout the system. These connections may be protected using the data security methods described above based on access and priority.

Due to the complexity of communications, there exists a need for multiple connections of the same type of devices. According to one embodiment of the present invention, multiplexers are used to coordinate the transfer of information to and from the Central Control Module. The multiplexer resolves issues associated with simultaneous access from two or more different sources. Without the use of a multiplexer, function data collisions could occur causing data corruption or loss.

In accordance with an embodiment of the present invention, a remote control unit may be accessible via a computer. The computer can be used to control a model train layout via the remote's wireless connection. Information can be sent from the computer to various parts of the model train layout via the remote control unit. Upgrades, sounds, information about the train, etc. could be transferred from the computer to the remote and vice versa. New remote screens and functionality can also be downloaded from the computer. Through this connection, the remote control unit can retrieve the Central Control Module database and upload it to the computer for later use. According to an embodiment of the present invention, when the remote is connected to the computer, it could also be used to control a model train layout through a remote connection. Users controlling a model train layout through a remote connection may not want to use standard computer input devices to control the layout, but would rather use an actual remote control unit to enhance the model train operating experience. This could be done by simply connecting the remote control unit to the computer, and logging in to the remote layout. The user could then have all the operations of the remote available to him/her as though he/she were standing next to the layout.

Use of Single Central Microprocessor in the Locomotive with a Communication Link to Distribute Tasks In accordance with an embodiment of the present invention, a single microprocessor may be used to receive and transmit commands. This microprocessor may also control other various operations inside the locomotive which include, but are not limited to, Dynamic Variable Speed Compensator, lighting details, sound generation, smoke generation, and coupler control. In addition, the microprocessor may communicate with other hardware devices through the use of a bi-directional communication line. This communication line can be used to transfer information from both the originator and the receiver, allowing the information in various subsystems to be shared. Furthermore, the communication line allows for the expansion, remote location, and task offloading of the main microprocessor. The communication link can be protected from unauthorized access by the use of data security methods described above. The advantage of this approach is that additional features may be added as required by a particular application without changing the central controlling microprocessor.

Use of in-Circuit Programming to Upgrade System Components

According to one embodiment of the present invention, microprocessors and memory systems are used that allow for in-circuit programming. This function is used to upgrade system functions as necessary. This allows for changes in the hardware and software without the removal of the device. Furthermore, the entire system could be changed without replacing any components. In addition, errors made during production of certain model train layout components could be corrected without the complete disassembly of the product and the need for an external programmer.

Detail about Keyboard Entry from Input Devices that Control the Train

In accordance with an embodiment of the present invention, commands can be generated from both the pushing and releasing of keys from any input device the model train system could use. These commands may control the synchronization of the motion, smoke, light and sound segments. These segments can be either triggered or terminated based on the making and breaking of these key stokes. In addition, the time between these actions can be used to create variation and selection of different effects. These affects give the current invention a sense of realism and randomness.

In addition to the making and breaking of key sequences, the pressure and duration of pressure sensitive keys are considered in event generation while they are being pressed and released. Events can be made up of motion, smoke, sound or lighting effects including any combination. This is the same process used in the playing of a musical instrument. The accents of pressure and duration affect the sounds being heard. This same affect is used to create individual control and expression of the device being operated. This type to control could be used to operate or "blow" the whistle on a steam engine. When combined with the present invention's sound system, which has various recorded whistle segments further combining the pressure and duration information which can be used to select, combine and control pitch and sound intensity, great variation and personal control is given to the operator creating a personal connection between the operator and the device he/she is controlling.

Creation of Custom Sounds for Play on Layout Devices

According to one embodiment of the present invention, custom sounds, icons, menus, keying sequences, engine parameters, and operating conditions may be created by the operator of the model train layout. With regard to creating custom sounds, the custom sounds can be constructed on a computer or other sound producing equipment. Sound files are then input into the current invention's custom sound generator that converts the sounds from a standard format like MP3 and others to the custom compressed format used by the different sound devices used throughout the layout. These sounds are then transferred by various ways which include but not limited to wireless, hardwired or use of memory modules. These custom sounds are stored in the sound system and can be used until replaced by another custom sound for that specific operation. These sounds are treated as voices by the sound system which can be overlaid with the ones supplied by the original manufacturer. An example would be to create custom announcements for a passenger train arriving at a station. The ruckus of the station supplied by the manufacturer could be overlaid by custom arrival and departure announcements for a particular train. Many voices could be installed for individual announcements of many trains. One method is to use the train identifier to select and trigger a custom announcement for an individual train created by the train operator. An additional application includes custom dialog between the trains or between trains and accessories. Any layout item that contains sound generation could have this capability. In addition, the user can create custom parameters of specific trains in the model train layout Custom parameters may comprise sound effect settings, light settings, motor settings, etc. According to one embodiment of the present invention, custom parameters may be adjusted by holding a particular parameter button on the remote control unit for more than a threshold amount of time, while turning a knob to adjust a variable control input, thereby increasing or decreasing parameters. The model train system may be configured to store in a memory the newly adjusted parameters corresponding to the specific train, thereby allowing the model train system to instantly recall these parameters when the specific train is in use.

It will be understood that modifications and variations may be effected without departing from the scope of the novel concepts of the present invention. For example, individual systems described above can be integrated as one unit or separated into many parts based on, but not limited to, cost, function and location requirements. As used herein, a model train controller can be a wireless remote control, a base unit wired to the tracks, or any other controlling device. A train car can be a locomotive, a caboose, a boxcar, or any other part of a train. Accordingly, the foregoing description is intended to be illustrative, but not limiting, of the scope of the invention which is set forth in the following claims.

What is claimed is:

1. A model train controller comprising:

a housing;

at least one input device coupled to the housing;

a display coupled to the housing and for displaying information on a status of a model train;

a processor disposed within the housing and being operatively coupled to the at least one input device and the display, the processor generating at least one model train command to be transmitted to the model train in response to a user interacting with said at least one input device; and at least one transmitting/receiving device for communicating the at least one model train command to the model train and for receiving feedback data from said model train;

wherein said at least one model train command comprises a throttle command and causes said model train to traverse a model train track, said feedback data comprises data that is stored on said model train and pertains to said status of said model train, and said processor is configured to receive said feedback data and to use said feedback data to display said information on said status of said model train on said display;

wherein said model train track includes at least one device configured to receive said feedback data from said model train and to provide said feedback data to said model train controller.

2. The model train controller of claim 1, wherein said feedback data comprises at least one of a name and a number of said model train.

3. The model train controller of claim 1, wherein said feedback data comprises data on water status of said model train.

4. The model train controller of claim 1, wherein said feedback data comprises data regarding laboring of said model train.

5. The model train controller of claim 1, wherein said at least one device is configured to provide said feedback data to said model train controller via a wireless communication module.

6. The model train controller of claim 5, wherein said at least one model train command is transmitted to said model train via said wireless communication module.

7. The model train controller of claim 1, wherein said feedback data comprises a current speed of said model train.

8. The model train controller of claim 1, wherein said feedback data comprises data on at least one of a light, a sound and a smoke of said model train.

9. The model train controller of claim 1, wherein said feedback data comprises a location of said model train on said model train track.

10. The model train controller of claim 1, wherein said feedback data comprises data on a road that said model train is on.

11. The model train controller of claim 1, wherein said feedback data comprises data on an odometer of said model train.

12. The model train controller of claim 11, further comprising said model train, a processor disposed within said model train, and a motor disposed within said model train, wherein said processor disposed within said model train is configured to use rotational information of said motor to calculate said odometer of said model train.

13. The model train controller of claim 1, wherein said processor is further configured to download an application from the Internet, said application allowing a user to transmit said throttle command and to view said feedback data.

14. The model train controller of claim 1, wherein said device is configured to receive said feedback data from said model train via an infrared (IR) signal.

15. The model train controller of claim 1, wherein said input device comprises a touchscreen over said display, said touchscreen being interacted with to address at least a portion of said status of said model train.

16. A method for controlling a model train, comprising:

receiving an input from a user;

using said input to generate at least one model train command;

transmitting said at least one model train command from a remote control to a model train, said at least one model train command instructing said model train to traverse over a model train track;

storing data concerning said model train on a memory device disposed within said model train;

transmitting said data from said model train to said remote control via at least one device affixed to said model train track, said at least one device being configured to receive said data from said model train and to provide said data to said model train controller; and using said data to display on a display device disposed within said remote control information on said status of said model train.

17. The method of claim 16, wherein said step of status of said model train comprises data on water in said model train.

18. The method of claim 16, wherein said step of transmitting said data from said at least one device to said model train controller further comprises using a module to transmit said data wirelessly to said model train controller.

19. The method of claim 16, wherein said a status of said model train further comprises at least one of a current speed and a maximum speed of said model train.

20. The method of claim 16, wherein said status of said model train comprises data on a road.

21. The method of claim 16, wherein said step of status of said model train comprises an odometer of said model train.

22. The method of claim 21, further comprising using at least rotational information of a motor disposed within said model train to calculate said odometer of said model train.

23. A model train system comprising:

a model train controller, comprising:

at least one input device;

a display for displaying information on a model train;

a processor operatively coupled to the at least one input device and the display, the processor generating at least one model train command to be transmitted to the model train in response to a user interacting with said at least one input device; and at least one transmitting/receiving device for communicating the at least one model train command to the model train and for receiving feedback data from said model train;

a model train track, comprising:

at least one infrared (IR) device configured to receive said information from said model train, said information being provided to said model train controller via a wireless control module;

wherein said at least one model train command comprises a throttle command and causes said model train to traverse a model train track, said feedback data comprises data that is stored on said model train and pertains to an odometer of said model train, and said processor is configured to receive said feedback data and to use said feedback data to display said information on said odometer of said model train on said display.

* * * * *